US007673370B2

(12) United States Patent
Frederick et al.

(10) Patent No.: US 7,673,370 B2
(45) Date of Patent: Mar. 9, 2010

(54) MODE CONTROL ARRANGEMENT FOR A FLOOR

(75) Inventors: Lynn A. Frederick, Ravenna, OH (US); Kevin E. Scheifele, Tallmadge, OH (US); Chan Chi Tong, Chaiwan (HK)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 1034 days.

(21) Appl. No.: 11/223,595

(22) Filed: Sep. 9, 2005

(65) Prior Publication Data

US 2006/0101604 A1 May 18, 2006

Related U.S. Application Data

(63) Continuation-in-part of application No. 10/990,837, filed on Nov. 17, 2004.

(51) Int. Cl.
*A47L 11/30* (2006.01)

(52) U.S. Cl. ..... 15/354; 15/362; 15/319; 15/339

(58) Field of Classification Search ..... 15/354, 15/355, 356, 359, 360, 362, 368, 373, 319, 15/339; *A47L 11/30*
See application file for complete search history.

(56) References Cited

U.S. PATENT DOCUMENTS 0,909,131 A 1/1909 Antic (Continued)

FOREIGN PATENT DOCUMENTS

| | | |
|---|---|---|
| CA | 2525306 | 5/2006 |
| CA | 2526596 | 5/2006 |
| CN | 1781439 | 6/2006 |
| DE | 20314878 | 1/2004 |
| EP | 0928595 | 7/1999 |

(Continued)

OTHER PUBLICATIONS

Page 6 of Owner's Manual for Eureka Atlantis Model No. 2593, purchased Jan. 2004.

(Continued)

*Primary Examiner*—David A Redding
(74) *Attorney, Agent, or Firm*—Michael Best & Friedrich LLP

(57) ABSTRACT

The invention is a bare floor cleaning appliance provided with a foot pedal for raising and lowering the suction nozzle while simultaneously energizing and de-energizing the independent drive motor powering a horizontal axis rotary agitator. The foot pedal is depressed once to lower the suction nozzle to a position closest to the floor surface and the horizontal rotary agitator is energized to clean the floor surface. Suction from the motor-fan assembly is used to pick up dirt and used cleaning solution. The foot pedal is depressed one more time to raise the suction nozzle from the floor surface and de-energize the horizontal rotary agitator. In this mode, suction from the motor-fan assembly is used to pick up dry objects including dirt. The foot pedal operates the switch for energizing and de-energizing the independent electric motor by rotating a mode indicator operably connected to the foot pedal. Depressing the foot pedal once rotates the mode indicator to a first position which toggles the switch from the off position to the on position. When rotated into this position, an first indicating portion on the mode indicator is rotated underneath a first viewing window formed in the hood of the cleaner foot. Depressing the foot pedal another time rotates the mode indicator to a second position which toggles the switch from the on position to the off position. A second indicating portion on the mode indicator rotates underneath a second viewing window formed in the hood of the foot. At the same time the first indicating portion is rotated out of sight of the first viewing window.

6 Claims, 46 Drawing Sheets

U.S. PATENT DOCUMENTS

| | | | | |
|---|---|---|---|---|
| 2,409,082 | A | | 10/1946 | Troxler |
| 2,450,172 | A | | 9/1948 | Stoner |
| 2,523,770 | A | | 9/1950 | Marette |
| 2,534,122 | A | | 12/1950 | Hamala |
| 2,747,214 | A | | 5/1956 | Allen |
| 2,923,960 | A | | 2/1960 | Davidson |
| 3,245,698 | A | | 4/1966 | Fromknecht |
| 3,284,834 | A | | 11/1966 | Waters |
| 3,339,168 | A | | 8/1967 | Belicka et al. |
| 3,460,184 | A | | 8/1969 | Dyer |
| 3,520,012 | A | | 7/1970 | Carabet et al. |
| 3,540,072 | A | | 11/1970 | Wolter et al. |
| 3,705,437 | A | | 12/1972 | Rukavina et al. |
| 3,771,191 | A | | 11/1973 | Cain |
| 4,079,965 | A | | 3/1978 | Moughty et al. |
| 4,159,554 | A | | 7/1979 | Knight et al. |
| 4,249,280 | A | | 2/1981 | Goodrich |
| 4,429,433 | A | | 2/1984 | Burgoon |
| 4,443,910 | A | | 4/1984 | Fitzwater |
| 4,541,142 | A | | 9/1985 | Pudwill |
| 4,545,089 | A | | 10/1985 | Oxel |
| 4,580,309 | A | | 4/1986 | Ogden |
| 5,042,109 | A | | 8/1991 | Stephens |
| 5,233,722 | A | | 8/1993 | McKnight et al. |
| 5,247,719 | A | | 9/1993 | Wareham et al. |
| 5,255,768 | A | | 10/1993 | Kasper et al. |
| 5,303,447 | A | | 4/1994 | McKnight |
| 5,309,600 | A | | 5/1994 | Weaver et al. |
| 5,332,266 | A | | 7/1994 | Canale |
| 5,462,311 | A | | 10/1995 | Cipolla |
| 5,467,502 | A | * | 11/1995 | Johnson et al. ..... 15/339 |
| 5,493,752 | A | | 2/1996 | Crouser et al. |
| 5,499,425 | A | | 3/1996 | Glenn, III |
| 5,500,977 | A | | 3/1996 | McAllise et al. |
| 5,551,731 | A | | 9/1996 | Gray et al. |
| 5,568,943 | A | | 10/1996 | Kilstrom et al. |
| 5,615,448 | A | | 4/1997 | Crouser et al. |
| 5,755,578 | A | | 5/1998 | Contant et al. |
| 5,841,259 | A | | 11/1998 | Kim et al. |
| 5,970,576 | A | | 10/1999 | Maurer et al. |
| 6,009,594 | A | | 1/2000 | Grey |
| 6,073,300 | A | | 6/2000 | Zahuranec et al. |
| 6,076,228 | A | | 6/2000 | Aiken |
| 6,108,865 | A | | 8/2000 | Veser et al. |
| 6,179,104 | B1 | | 1/2001 | Steinmuller et al. |
| 6,243,912 | B1 | | 6/2001 | Grey |
| 6,286,181 | B1 | | 9/2001 | Kasper et al. |
| 6,349,808 | B1 | | 2/2002 | Bryant |
| 6,453,506 | B1 | | 9/2002 | Sumner |
| 6,519,807 | B1 | | 2/2003 | Thomson |
| 6,572,711 | B2 | | 6/2003 | Sclafani et al. |
| 6,588,051 | B2 | | 7/2003 | Hashizume et al. |
| 6,640,386 | B2 | | 11/2003 | Morgan et al. |
| 6,832,409 | B2 | * | 12/2004 | Morgan et al. ..... 15/354 |
| 6,886,865 | B2 | | 5/2005 | Jung |
| 7,155,774 | B2 | | 1/2007 | Jung |
| 7,159,272 | B2 | | 1/2007 | Holsten et al. |
| 7,213,297 | B2 | | 5/2007 | Nam et al. |
| 7,350,262 | B2 | | 4/2008 | Scheifele |
| 7,367,082 | B2 | | 5/2008 | Gordon et al. |
| 7,458,619 | B2 | | 12/2008 | Cassel et al. |
| 7,581,288 | B2 | | 9/2009 | Zhang |
| 2004/0226584 | A1 | | 11/2004 | Guest et al. |
| 2006/0101608 | A1 | | 5/2006 | Tong |
| 2006/0101612 | A1 | | 5/2006 | Gordon et al. |

FOREIGN PATENT DOCUMENTS

| | | |
|---|---|---|
| EP | 1027856 | 8/2000 |
| GB | 1210536 | 10/1970 |
| GB | 1318099 | 5/1973 |
| GB | 2239789 | 7/1991 |
| GB | 2336993 | 11/1996 |
| GB | 2365758 | 2/2002 |
| GB | 2379866 | 3/2003 |
| GB | 2412572 | 10/2005 |
| GB | 2414383 | 11/2005 |
| GB | 2415361 | 12/2005 |
| GB | 2420268 | 5/2006 |
| GB | 2445317 | 7/2008 |
| GB | 2445318 | 7/2008 |
| JP | 6054784 | 3/1994 |
| JP | 2003245228 | 9/2003 |
| WO | 20041054422 | 7/2004 |

OTHER PUBLICATIONS

GB0806223.4 Search Report, 1 page, dated Apr. 28, 2008.

Exhibit B and C, Photographs of Eureka Atlantis Model No. 2593 carpet cleaner, released Feb. 2004.

Exhibit E, Photograph of Hoover Floormate H3000 "Breeze" Bare Floor Cleaner, released Oct. 2001.

Exhibit F, Photograph of Hoover Floormate H3000 "Breeze" Bare Floor Cleaner, showing detail of suction nozzle height/mode selection foot pedal, released Oct. 2001.

Exhibit G, Photograph of Hoover Floormate H3000 "Breeze" Bare Floor Cleaner, showing mode selector/agitator brush block actuator switch, released Oct. 2001.

Exhibit H, Photograph of Dirt Devil Floorkeeper Model CE5500, purchased Jan. 2004.

Exhibit I, Photograph of Dirt Devil Floorkeeper Model No. CE5500, showing detail of suction nozzle height/mode selector foot pedal, purchased Jan. 2004.

Exhibit J, Photograph of Dirt Devel Floorkeeper Model No. CE5500 showing detail of mode selector/agitator actuator switch, purchased Jan. 2004.

* cited by examiner

MODE CONTROL ARRANGEMENT FOR A FLOOR

This application is a continuation-in-part application of U.S. Ser. No. 10/990,837 filed on Nov. 17, 2004.

BACKGROUND OF THE INVENTION

1. Field of the Invention

This invention relates to floor care appliances. More specifically, the present invention pertains to a bare floor cleaning appliance a foot pedal for raising and lowering the suction nozzle while simultaneously energizing and de-energizing a horizontal axis rotary agitator.

2. Summary of the Prior Art

Floor cleaning appliances having one or more cleaning modes are known in the art. Such appliances include both carpet and bare floor extractors. Typically, such floor cleaning appliances are comprised of a suction nozzle, a suction nozzle height adjustment mechanism, a motor-fan assembly, a liquid recovery system, one or more agitators, and controls for selecting the cleaning mode. One such bare floor cleaning appliance, as disclosed in U.S. Pat. No. 6,640,386 and incorporated be reference as if fully rewritten herein, has three cleaning modes, namely, wet scrub mode, wet pickup mode and dry pickup mode. The bare floor cleaning appliance is shifted between the various cleaning modes with the use of a slide switch to raise and lower the rotary agitators and to energize the agitator drive motor. Afoot pedal is provided to raise and lower the suction nozzle in relation to the floor surface for proper suction nozzle height as required for some of the cleaning modes. Heretofore unknown in the art is a bare floor cleaning appliance having the plurality of cleaning modes such as those disclosed in the '386 patent wherein the control of the plurality of cleaning modes is accomplished through the use of a single mode selector. The present invention provides such as bare floor cleaning appliance having a plurality of cleaning modes controlled by a single mode selector.

Also heretofore unknown in the art is a bare floor cleaning appliance having a foot pedal for raising and lowering the suction nozzle while simultaneously energizing and de-energizing the independent drive motor powering a horizontal axis rotary agitator. In another aspect of the present invention, a bare floor cleaning appliance is provided with a foot pedal for controlling both the height of the suction nozzle and the energizing and de-energizing of the independent drive motor powering the horizontal axis rotary agitator. The foot pedal is depressed once to lower the suction nozzle to a position closest to the floor surface and the horizontal rotary agitator is energized to clean the floor surface. The foot pedal is depressed one more time to raise the suction nozzle from the floor surface and de-energize the horizontal rotary agitator.

Also known in the art is floor cleaning appliances having an accessory hose and/or wand for cleaning upholstery and the like. However, unknown in the art is a strictly bare floor cleaning appliance having an accessory hose and telescoping wand and cleaning accessories for cleaning other bare surfaces such as tile walls such as shower walls, hard to reach floor areas such as behind toilets, and the grout between tile. The present invention fulfills this need by providing a bare floor cleaner having an accessory hose and telescoping wand and accessories that is connected to the bare floor cleaning appliance through a connection port that connects both suction and cleaning solution to the accessory hose and telescoping wand.

It is an object of the invention to provide a bare floor cleaning appliance.

It is another object of the invention to provide a bare floor cleaning appliance having an accessory hose and telescoping wand.

It is yet another object of the invention to provide a bare floor cleaning appliance having plurality of cleaning modes.

It is yet still another object of the invention to provide a cleaning appliance with a pivoting handle for compact storage.

It is another object of the invention to provide a cleaning appliance with a caddy for storing the accessory hose, telescoping wand, accessory tools and cleaning supplies.

SUMMARY OF THE INVENTION

The invention is a floor care appliance for cleaning bare surfaces such as tile, marble, linoleum and wood. The floor care appliance is comprised of a base portion having a suction nozzle and a brush assembly for cleaning bare floors. The brush assembly has a plurality of vertical axis rotary brushes driven by a brush motor for agitating the surface. With the addition of an accessory hose, telescoping wand, and accessory tools the cleaning utility can be expanded to areas wherein the suction nozzle cannot normally reach such as behind the toilet, shower walls, and the grout between tile. While used in the capacity for cleaning bare floors, the floor care appliance can be moved between three cleaning modes by a rotating knob located on the upper housing. The suction nozzle and brush assembly includes a lifting mechanism for moving the suction nozzle and brush block from a first mode wherein the suction nozzle and brush block is off the surface to a second mode wherein the suction nozzle and brush block is on the surface. The lifting mechanism also moves the suction nozzle and brush block to a second mode wherein the suction nozzle and the brush block is on the surface. The lifting mechanism also moves the suction nozzle and brush block to a third mode wherein the suction nozzle is on the surface and the brush block is off the surface. A switching assembly is responsive to the rotating knob to energize the brush motor when the brush block is in the second position on the floor surface. A cleaning solution tank located in a cavity in the housing provides cleaning solution to the floor surface through a gravity fed manifold located above the brush block. A trigger located on the handle is pressed to dispense cleaning solution. A dirty solution recovery tank is also located on the housing to recover dirty solution picked up by the suction nozzle. A switch located on the handle is used to turn the current on and off to the suction motor and the brush block.

In another aspect of the invention; a floor care appliance is provided having a port for connecting the accessory hose to the floor care appliance. The port is comprised of a suction inlet for connecting the suction hose portion of the accessory hose and a solution distribution inlet is provided for connecting a solution distribution conduit is located in the accessory hose to the solution distribution manifold on the floor care appliance. Adjacent the suction inlet and solution distribution inlet is an air turbine pump inlet for allowing atmospheric air to enter and rotate an air turbine pump for pressurizing solution supplied to the solution distribution inlet. When connected, a trigger located on the accessory hose handle is used to dispense pressurized solution from a spray nozzle located on an accessory tool located at the end of telescoping wand connected to the accessory hose. Several accessory tools are provided for connection to the end of the telescoping wand including an accessory suction nozzle and grout tool. A door normally biased in the closed position seals the suction inlet, solution distribution outlet, and the air turbine inlet when the accessory hose is not in use. Sealing the air turbine inlet prevents the air turbine pump from functioning and pressurizing the solution at the solution distribution outlet.

In yet another aspect of the invention, a floor care appliance is provided having a an accessory tool caddy for holding accessory tools for connection to the end of a telescoping wand and accessory hose. Accessory tools such as the accessory-suction nozzle and grout tool may be stored in the accessory caddy as well as cleaning solution for cleaning bare surface and the grout between tile. The accessory caddy is designed to rest above the suction nozzle and in front of the upper housing in the stored position. When in the stored position, the caddy has feet which are designed to elevate the accessory caddy over the suction nozzle with the accessory caddy actually touching or resting upon the suction nozzle.

In still yet another aspect of the invention, a floor care appliance is provided with a removable brush block having a plurality of vertical axis rotary agitators. There is a plurality of bristle bundles extending vertically downward from the center of the rotary agitator. Another plurality of bristle bundles extend radially outwardly and downwardly from the hub. The plurality of bristle bundles extending vertically downward from the hub extend a distance vertically downward less than the distance the plurality of bristle bundles extend radially outwardly and downwardly from the hub extend in the vertical direction. In an alternate embodiment of the invention, a floor care appliance is provided with a suction nozzle and a removable brush block disposed therein. The brush block is configured for cleaning a tile floor surface having grout in the groove between adjacent tiles. The brush block is comprised of a plurality of vertical axis rotary brushes extending radially outwardly and downwardly from the hub. There are no purely vertical bristles bundles in the center of the rotary agitator as in the preferred embodiment. The purely vertical bristle bundles as in the preferred embodiment would prevent the bristle bundles extending radially outwardly and downwardly from penetrating the crack containing the grout to agitate the grout.

In another aspect of the invention, a floor care appliance is provided with an accessory hose and telescoping wand arrangement. One or more accessory tools are provided for specialized cleaning functions such as in hard to reach areas and the grout between tiled walls and floors. The accessory hose is connected to the floor care appliance through a port. The port has a suction inlet which connects the suction generated by a motor-fan assembly located in the floor care appliance and solution outlet which provides pressurized cleaning fluid from a solution tank in the housing of the floor care appliance to the accessory hose and telescoping wand arrangement. The cleaning fluid is pressurized by an air turbine pump which receives atmospheric air through an air turbine inlet in the vicinity of the port. A door is provided which is normally biased in the closed position to seal the air turbine inlet, suction inlet and solution outlet. When the door is open, air-enters the air turbine inlet and the air turbine pump provides pressurized cleaning solution at the solution outlet. The accessory hose and wand arrangement is comprised of a coiled accessory hose portion, a handle portion, and a telescoping wand portion all having a suction passage therethrough. A suction hose and solution conduit connector are located at one end of the accessory hose for connection to the port on the floor care appliance. The solution conduit extends to the remote end of the telescoping wand passing through the interior of the accessory hose, handle, and telescoping wand. The solution conduit is coiled inside the telescoping wand to allow for the extension and retraction of the wand. The opposing end of the accessory hose is connected to the handle. The handle has a trigger for controlling the dispensing of the cleaning solution. A connector at the remote end of the wand allows an accessory tool such as a suction nozzle or a grout cleaning tool to be removably attached to the end of the wand. A spray nozzle located on the accessory tool delivers cleaning solution to the surface to be cleaned when the trigger on the handle is depressed.

In yet another aspect of the invention, a bare floor cleaning appliance is provided with a foot pedal for raising and lowering the suction nozzle while simultaneously energizing and de-energizing the independent drive motor powering a horizontal axis rotary agitator. The foot pedal is depressed once to lower the suction nozzle to a position closest to the floor surface and the horizontal rotary agitator is energized to clean the floor surface. Suction from the motor-fan assembly is used to pick up dirt and used cleaning solution. The foot pedal is depressed one more time to raise the suction nozzle from the floor surface and de-energize the horizontal rotary agitator. In this mode, suction from the motor-fan assembly is used to pick up dry objects including dirt. The foot pedal operates the switch for energizing and de-energizing the independent electric motor by rotating a mode indicator operably connected to the foot pedal. Depressing the foot pedal once rotates the mode indicator to a first position which toggles the switch from the off position to the on position. When rotated into this position, an first indicating portion on the mode indicator is rotated underneath a first viewing window formed in the hood of the cleaner foot. Depressing the foot pedal another time rotates the mode indicator to a second position which toggles the switch from the on position to the off position. A second indicating portion on the mode indicator rotates underneath a second viewing window formed in the hood of the foot. At the same time the first indicating portion is rotated out of sight of the first viewing window.

BRIEF DESCRIPTION OF THE DRAWINGS

Reference may now be had to the accompanying drawings for a better understanding of the invention, both as to its organization and function, with the illustration being only exemplary and in which.

DETAILED DESCRIPTION OF THE INVENTION

Figure 1:
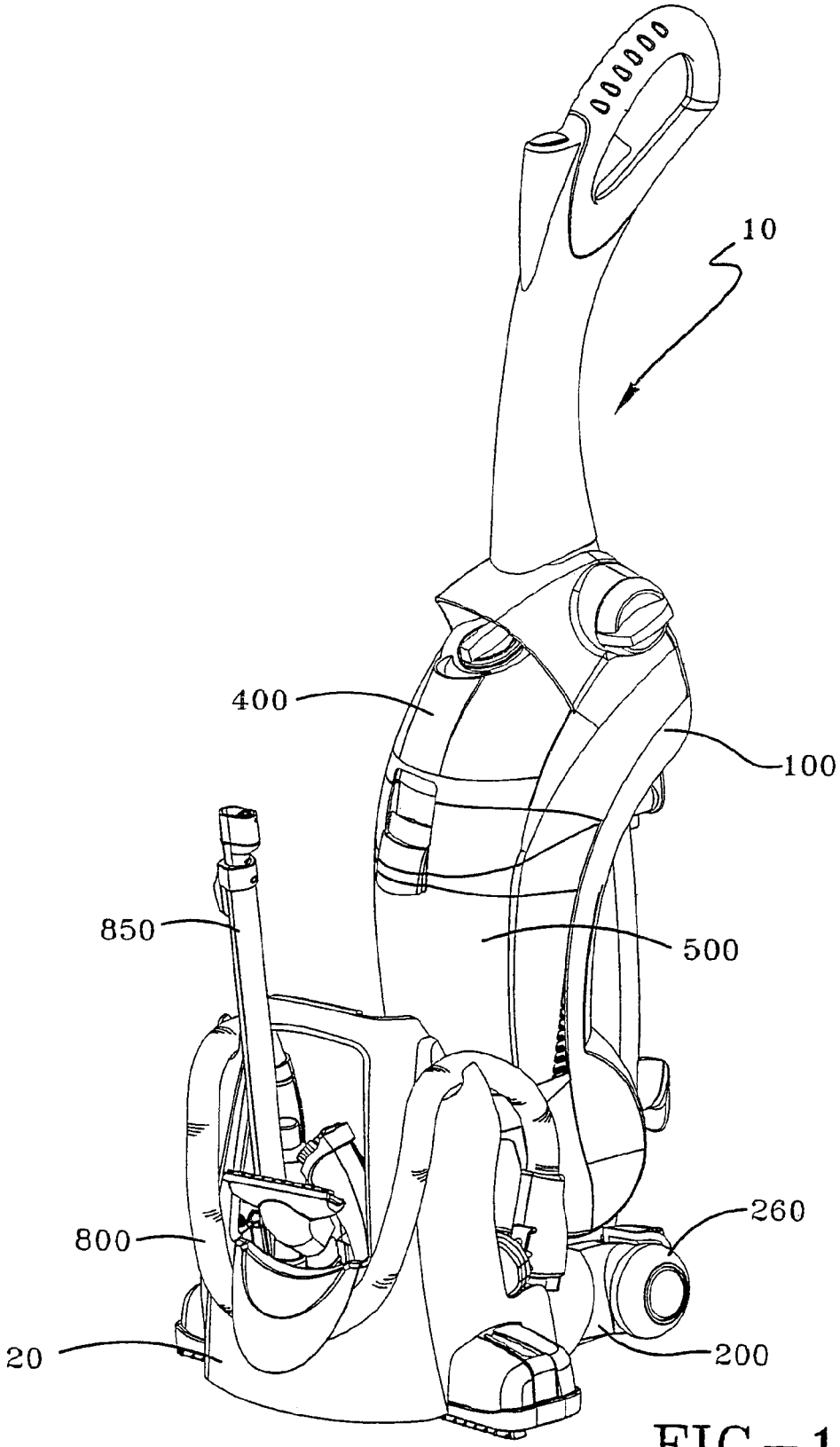
FIG. 1 is a front perspective view of a floor care appliance having an accessory tool caddy in the storage position above the suction nozzle, according to the preferred embodiment of the present invention.
Figure 2:
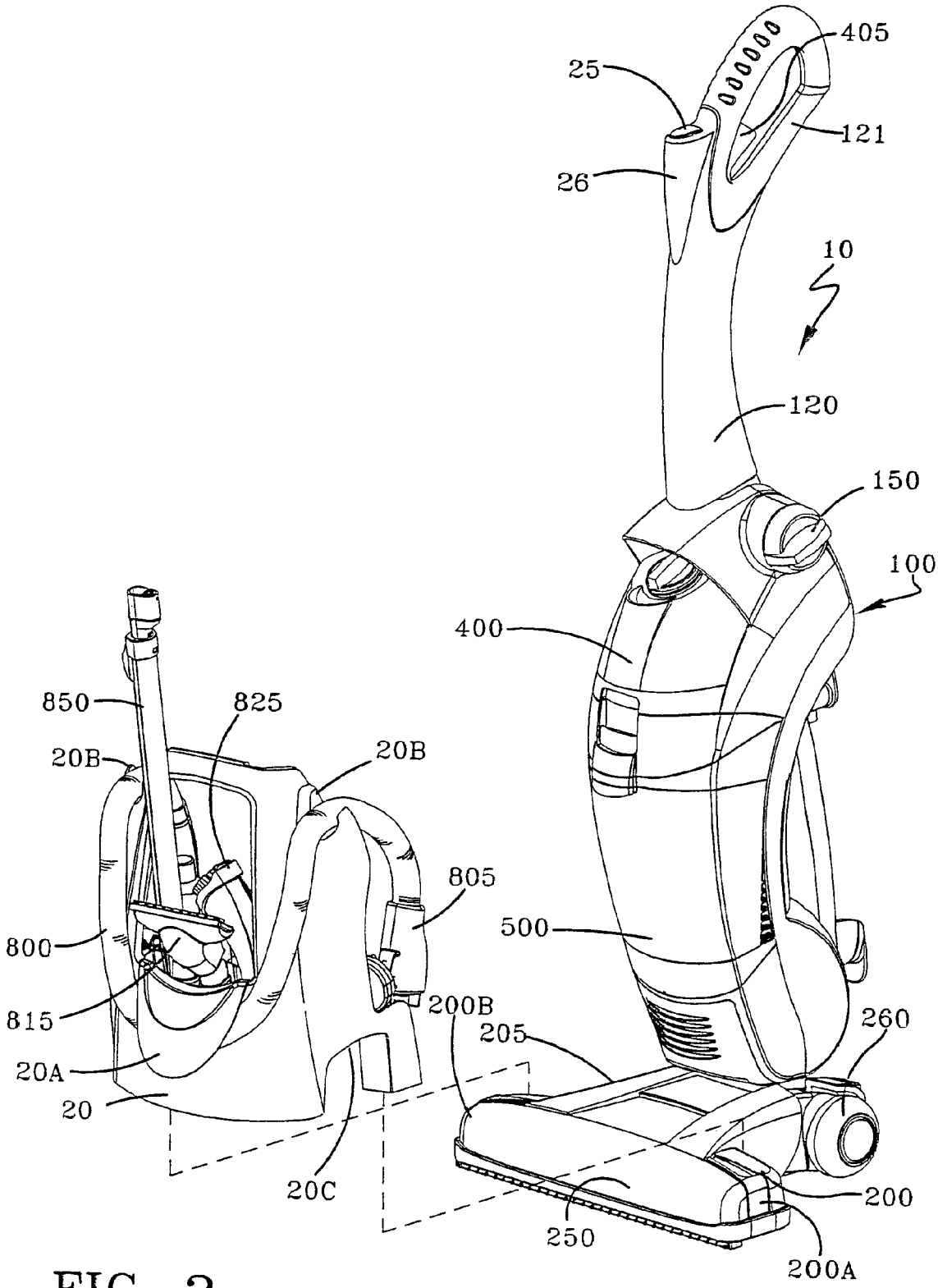
FIG. 2 is a front perspective view of a floor care appliance having an accessory tool caddy removed from the storage position above the suction nozzle, according to the preferred embodiment of the present invention.

Referring to FIGS. 1 and 2, shown is a perspective view of an upright cleaning appliance 10 for cleaning bare surfaces such as floors and tile, according to the preferred embodiment of the present invention. A similar upright cleaning appliance was disclosed in U.S. Pat. No. 6,640,386 owned by a common assignee and incorporated by reference fully herein. The upright floor care appliance 10 comprises an upright housing portion 100 pivotally connected to a base assembly 200 that is propelled over a bare floor surface for cleaning. A pair of trunnions (not shown) are formed on the lower end of upright portion 100 are journaled into a complementary pair of bores (not shown) in a frame (not shown) partially forming base assembly 200 to form the pivotal connection. The trunnions are secured into the bores by a trunnion cover (not shown).

A combined air/liquid separator and recovery tank assembly 500 (hereinafter recovery tank assembly 500) and a cleaning solution storage tank assembly 400 are located in cavities (shown in FIG. 3) in the upper housing portion 100. The upper housing portion 100 includes a pivoting handle 120 that pivots for easy storage, a motor fan assembly 300 (FIG. 4) for generating suction for liquid and soil recovery, a port 175 (FIGS. 12 and 12*a*) for connection of an accessory hose 800 (FIG. 12) and telescoping wand 850 (FIG. 12), a cleaning solution delivery assembly 415 (FIG. 4) including a trigger 405 on the pivoting handle 120 and an air turbine pump 425 (FIG. 4) for pressurizing cleaning solution to the accessory hose 800 and telescoping wand 850 (FIG. 12), a cleaning mode selector 150 located on the housing 100 and various ducts (FIG. 4) for fluidly connecting the motor-fan assembly (FIG. 4) to the recovery tank assembly 500 and a suction nozzle 250 in the base assembly 200 (described further hereinbelow). An electrical switch 25 is located on a pedestal 26 that is formed on the upper end of pivoting handle 120 forward of the looped handle portion 121. The electrical switch 25 controls the electrical power to the motor-fan assembly (FIG. 4) for generating suction for liquid and dirt recovery and an independent electrical motor 700 (FIG. 7A) that provides rotary power to a plurality of vertical axis rotary agitators 226 (FIG. 7D) in the base assembly 200. In an alternate embodiment of the invention, the electrical switch 25 could be combined with an electrical circuit breaker (not shown) to shut off the current in case of an overload which does not reset until the overload condition is removed. A separate microswitch 153 (FIG. 4J) is provided in the housing 100 for further controlling the operation of the plurality of vertical axis rotary-agitators 226 (FIG. 7D) dependent upon the position of the base assembly 200 relative to the floor surface when the electrical switch 25 is in the "on" position and the motor-fan assembly 300 (FIG. 4) is energized. The separate microswitch 153 (FIG. 4J) is operatively connected to the mode control selector 150 located on the housing 100. Both the motor-fan assembly 300 (FIG. 4) and the independent drive motor 700 (FIG. 7A) for the plurality of vertical axis rotary agitators 226 (FIG. 7D) are powered by electrical power source such as a conventional alternating current source or other power source such as rechargeable batteries.

Figure 7:
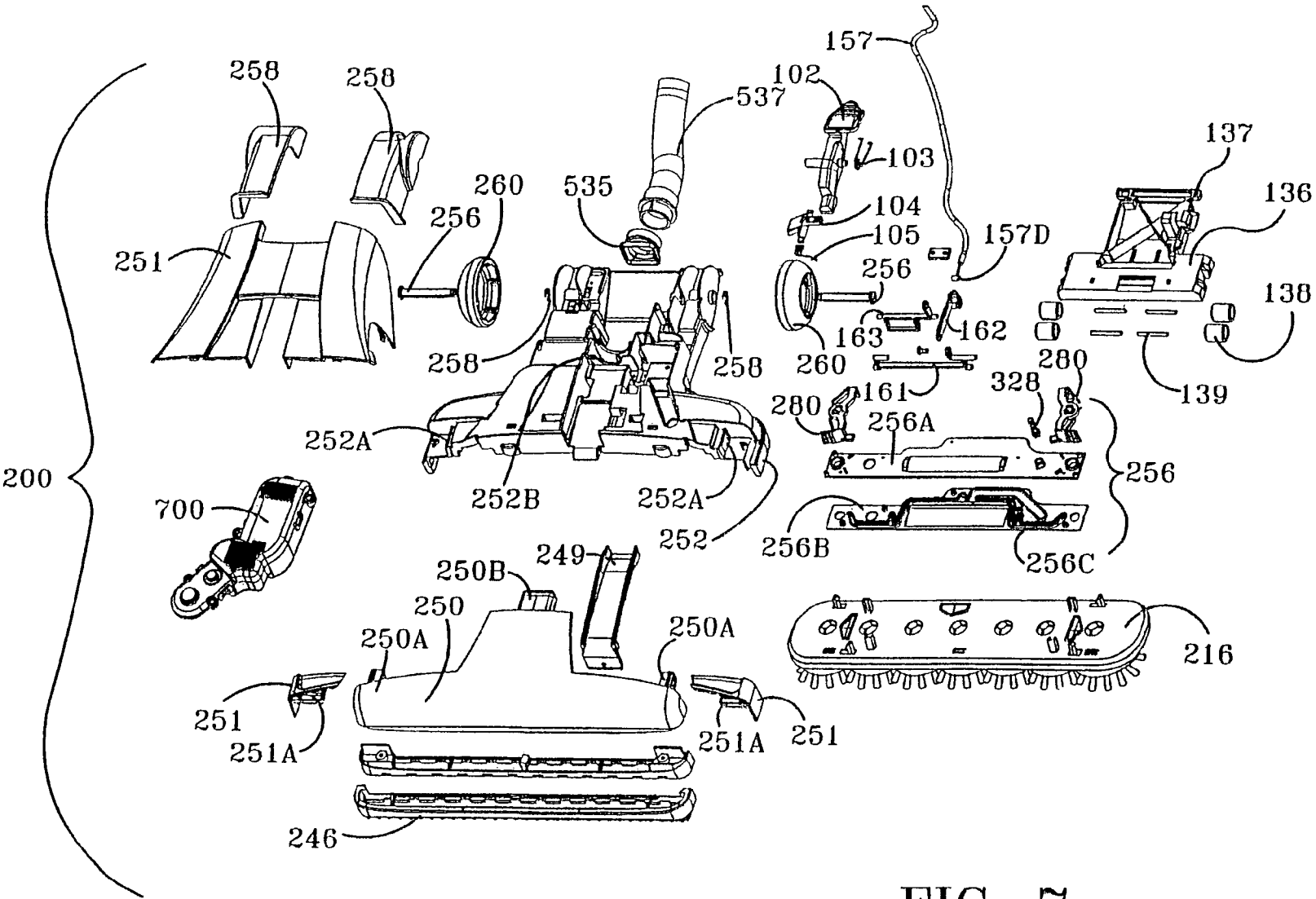
FIG. 7 is an exploded front perspective view of the base assembly of a cleaning appliance, according to the preferred embodiment of the present invention.

The suction nozzle 250 in base assembly 200 is used for the recovery of dirt and used cleaning solution delivered to the floor surface from the cleaning solution tank assembly 400. The cleaning solution is agitated on the floor surface to loosen soil and dirt by a plurality of vertical axis rotary agitators 226 (FIG. 7D) located in base assembly 200 behind suction nozzle 250. The cleaning appliance 10 is supported on the floor surface by a pair of wheels 260 at the rear of the base assembly 200 and two pairs of wheels (FIG. 7) mounted on a wheel carriage (FIG. 7).

A caddy 20 is designed to rest over the base assembly 200 in front of the upright housing portion 100 when the cleaning appliance 10 is in the storage position P (FIGS. 1-3 and 8) and can be removed for easy transport when the cleaning appliance 10 is in the in use or pivoted position P (FIGS. 1-3 and 8). The caddy 20 is for storing an accessory hose 800 and a telescoping wand 850 (partially shown in FIGS. 1 and 2) and related accessory tools (also partially shown in FIGS. 1 and 2) for cleaning hard to reach areas and other bare surfaces. Cleaning supplies (not shown) such as cleaning solution (not shown) may also be stored in the caddy 20 for allowing the user a wide versatility in cleaning. The accessory hose 800 and telescoping wand 850 (partially shown in FIGS. 1 and 2) and related cleaning accessories including the grout tool 825 and accessory suction nozzle 815 stored in the accessory tool caddy 20 are described more fully in detail hereinbelow The accessory caddy has a pair of arch shaped cutouts 20*c* (only one can be seen in FIG. 2) that fit over the left and right dog ear portions (200*a*, 200*b*) of base assembly 200 when in the storage position. The accessory hose 800 is stored by the connector 805 (FIG. 12) fitting into a pocket (not shown) on the rear side of caddy 20, passing through a channel 20*b* before looping around a curved rack 20*a* on the front of the accessory caddy 20 before being strung through another channel 20*b* on the opposite side of accessory caddy 20. The end of the accessory hose 800 has a handgrip (FIG. 12) which fits into a pocket (not shown) at the rear of the accessory caddy 20.

Figure 3:
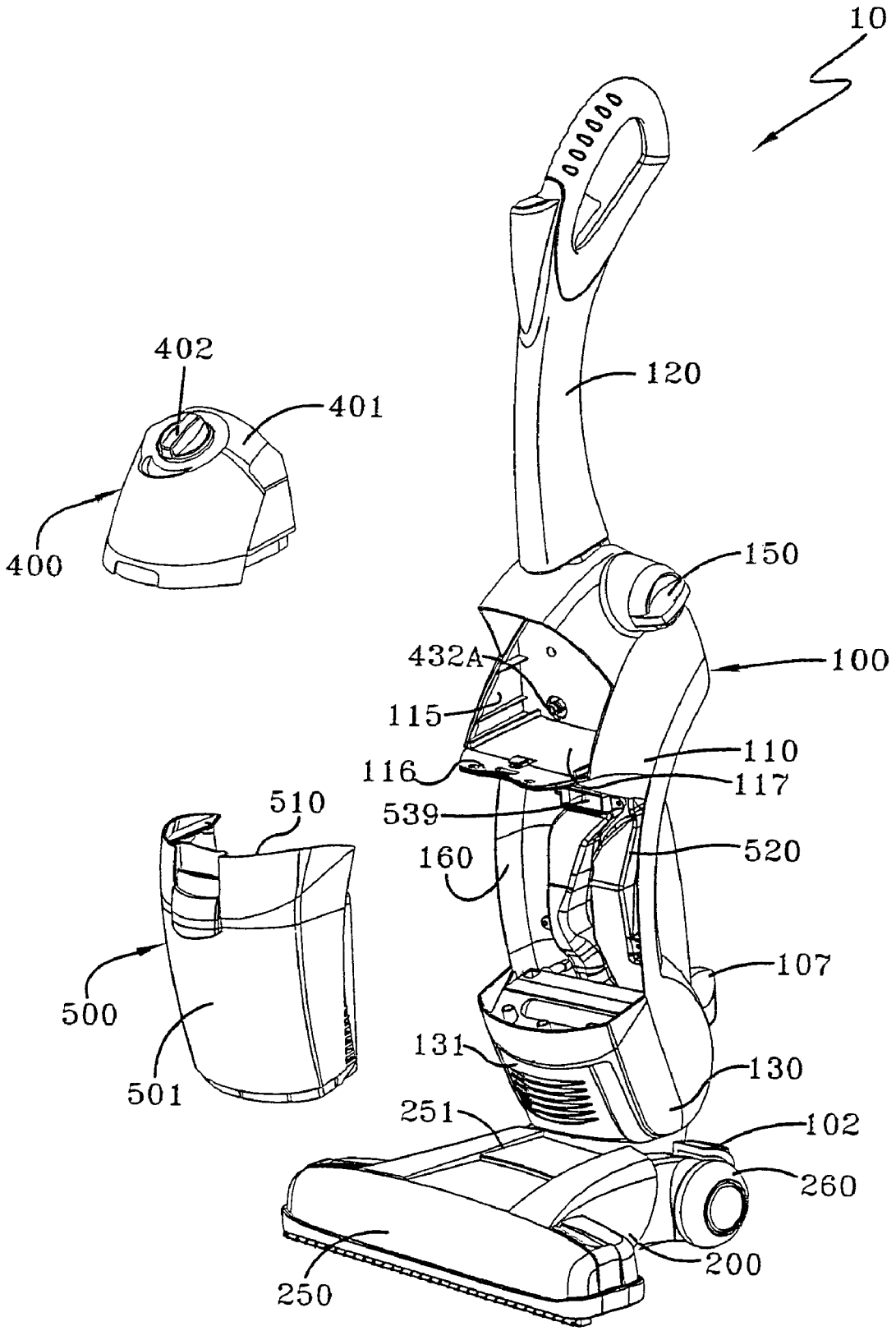
FIG. 3 is a front perspective view of a floor care appliance with the cleaning solution tank assembly and air/water separator and tank assembly exploded from the upper housing, according to the preferred embodiment of the present invention.

Referring now to FIG. 3, the base assembly 200 includes a suction nozzle 250 for the recovery of dirt and dirty cleaning solution previously applied to the bare surface being cleaned and a plurality of vertical axis rotary brushes 226 (FIG. 7D) located in a brush block assembly 217 (FIG. 7D) for loosening soil and dirt on the floor. The upper housing portion 100 includes a liquid recovery tank assembly 500 partially comprised of a liquid recovery tank 501 and a lid 510 for collecting dirt particles and/or used cleaning solution picked up by the suction nozzle 250. The liquid recovery tank assembly 500 is removably located in a cavity 160 in the upper housing 100 and is connected to a liquid recovery duct 530 partially located in the rear of the cavity 160. The cleaning solution storage tank assembly 400 is removably located in a cavity 115 and is connected to a solution supply connector 432*a* (seen in more detail in FIG. 4G) located in the rear of cavity 115. The cleaning solution storage tank assembly 400 sits on a ledge 117 partially forming cavity 115. A lip 116 extends forwardly from ledge 117 and has one or more notches formed therein for engaging a latch 409 (FIG. 4A) on the bottom of cleaning solution storage assembly 400 and a latch 561 (FIG. 4B) on the lid 510 of the liquid recovery tank assembly 500. The cleaning solution storage tank assembly 400 further includes a cap 402 for securing cleaning solution within the cleaning solution tank 401.

The cleaning appliance 10 can be used for three modes of cleaning, dry pickup, wet scrub, and wet pickup. The desired cleaning mode can be selected by rotating the mode selector 150 located on the upper housing portion 100 of the cleaning appliance 10. In the dry pickup mode (FIG. 9), when the mode selector is rotated to the "DRY VAC" position, the suction nozzle assembly 250 including squeegee 246 and brush block assembly 216 are raised above the surface 900 to allow pick up of dry particles only. In the wet pickup mode (FIG. 10), when the mode selector 150 is rotated to the "WASH" position, the brush block 216 is lowered for scrubbing the surface 900 as well as suction nozzle 250 to collect fluid and loosened soil from the surface 900. A microswitch 153 (FIG. 4J) operatively connected to mode selector 150 turns the current on to the independent drive motor 700 (FIGS. 7, 7D and 7G) powering the plurality of rotary brushes 226 in brush block 216 for agitating the surface 900. Also In this position, the squeegee 246 is in direct contact with surface 900 so that when base assembly 200 is moved over the surface 900, squeegee 246 pushes the fluid and particles from the surface 900 into the path of suction nozzle 250 for removal. Finally, in the wet pickup mode (FIG. 11), when the mode selector is rotated to the "WET PICKUP" position, only the suction nozzle 250 and squeegee 246 are positioned directly adjacent the floor surface to pickup the fluid and loosened dirt. Both the suction nozzle 250 and the brush block assembly 216 (FIGS. 7, 7A, 7C) are removable from the base assembly 200 (described in more detail hereinbelow).

Figure 4:
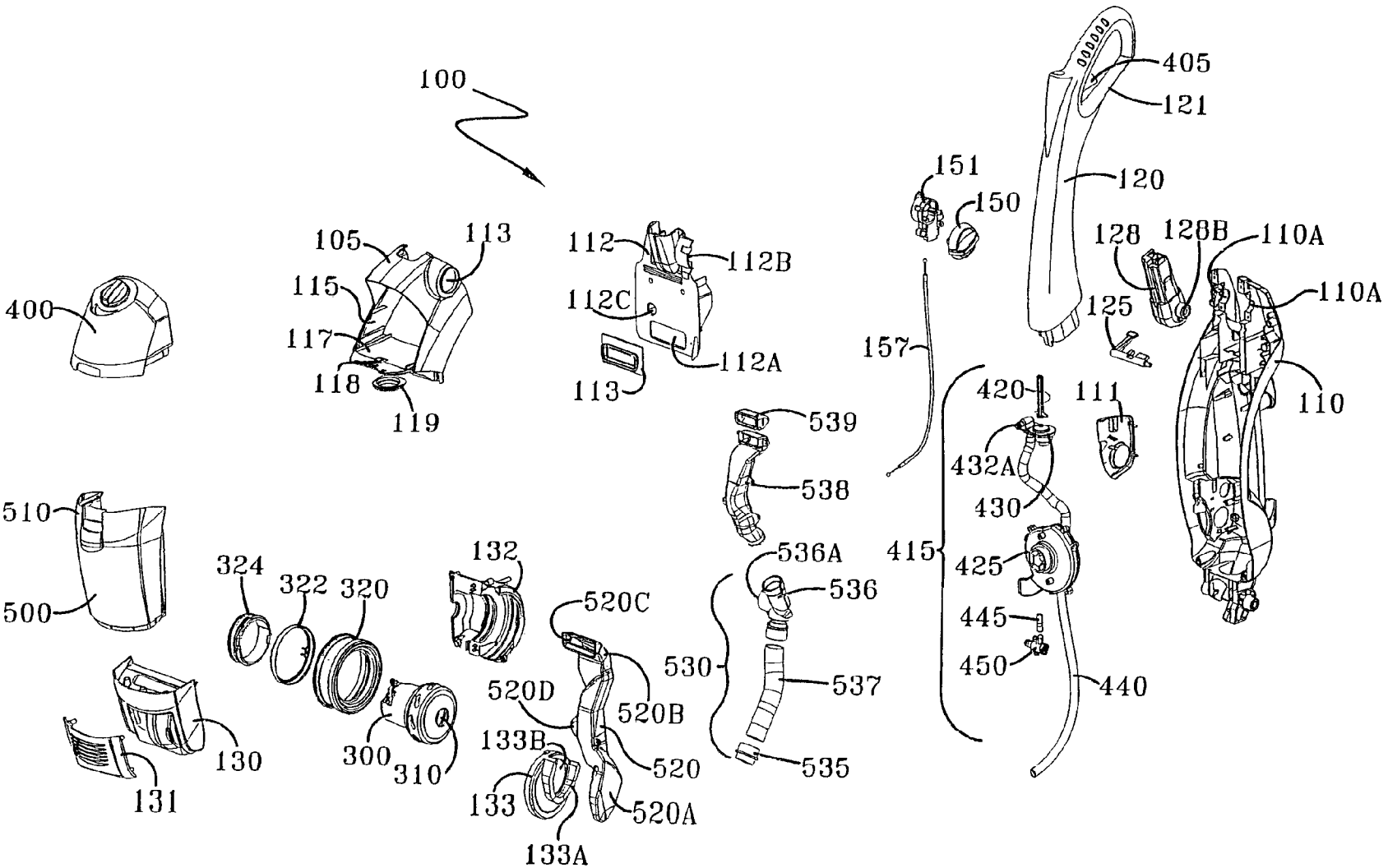
FIG. 4 is an exploded front perspective view of the upper housing of a cleaning appliance, according to the preferred embodiment of the present invention.

FIG. 4 is an exploded view of the upper housing assembly 100. The upper housing assembly 100 includes an upper body shell 110 connected to a pivoting handle 120. The pivoting handle 120 tapers upwardly into a narrow closed looped handgrip 121 at its upper end. An upper handle core 128 receives the lower end of pivoting handle 120. Upper handle core 128 has a pair of opposing trunnions 128B (only one shown in FIG. 4 and FIG. 4F) and is received in a pair of partially formed bosses 110A formed at the upper end of shell 110 and a pair of partially formed bosses 112B (only one shown in FIG. 4) located in handle retainer 112 to secure pivoting handle 120 to shell 110. The pivoting handle 120 is described in further detail in FIG. 4F. A rear motor cover 132 receives a motor-fan assembly 300 which are then both received within the lower portion of shell 110. Motor-fan assembly 300 is then covered by a fan shroud 130 and a plurality of vents formed in fan cover 131 allows air to enter into fan shroud 130. The suction inlet 310 of motor-fan assembly 300 is fluidly connected to a suction duct 520 which delivers suction to recovery tank assembly 500. The lower end 520A of suction duct 520 fits into a collar 133A formed in a gasket 133 having a specially formed aperture 133B formed therein for directing the suction from suction inlet 310 into suction duct 520. The upper end 520B of suction duct 520 has an outlet opening 520C that fits into aperture 112A in handle retainer 112A. When assembled, handle retainer 112 and handle 105 form a cavity 115 (FIG. 4E) where working suction is further directed to the liquid recovery system 500 which sits beneath handle 105 in cavity 160. An outlet opening (not shown) in a plate (not shown) forming part of handle 105 is fitted with an annular fitting 119 (FIGS. 4 and 4E) which fluidly connects with the suction inlet 568 (FIGS. 4B and 4C) formed in filter lid 566 which sits on top of lid 510. In this manner, working suction from the motor fan assembly 300 is delivered to the liquid recovery system 500 to generate a suction airstream originating at the suction nozzle 250.

Figure 9:
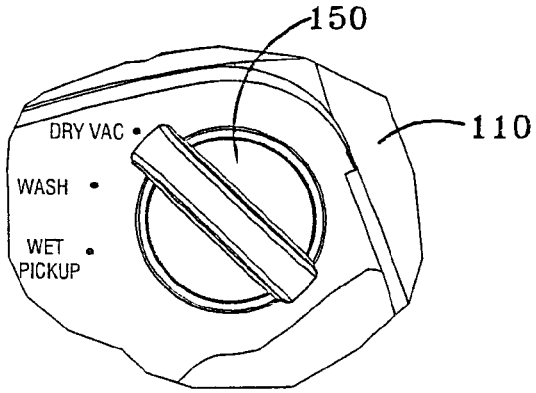
FIG. 9 is side cross-sectional view of the base assembly showing the position of the suction nozzle and the rotary agitators controlled by the position of the mode selector shown in a cutaway portion of the upper housing of a cleaning appliance, according to the preferred embodiment of the present invention.
Figure 9:
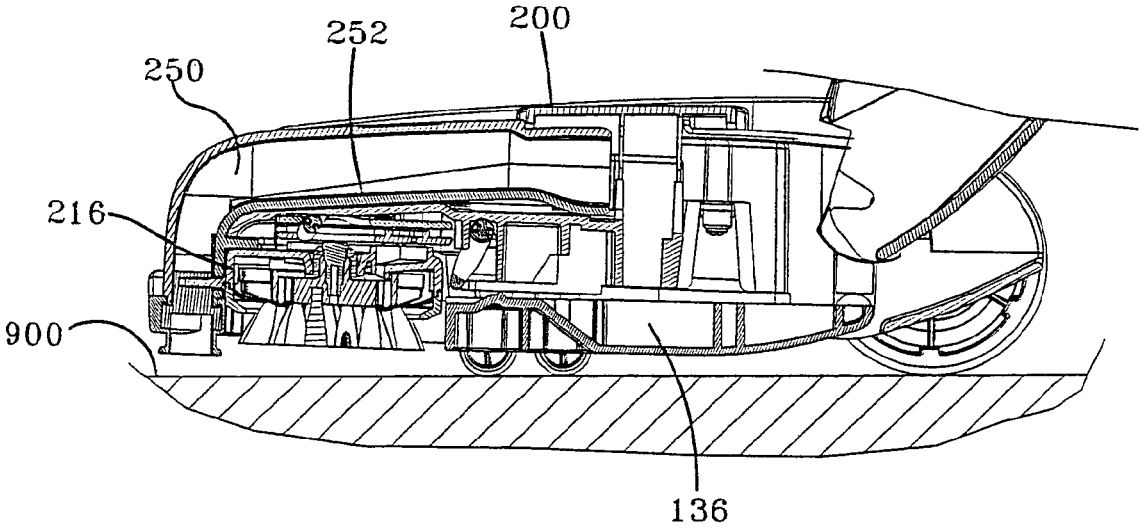
Figure 10:
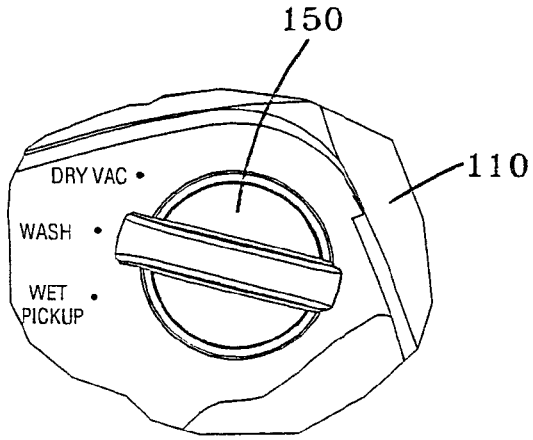
FIG. 10 is side cross-sectional view of the base assembly showing the position of the suction nozzle and the rotary agitators controlled by the position of the mode selector shown in a cutaway portion of the upper housing of a cleaning appliance, according to the preferred embodiment of the present invention.
Figure 10:
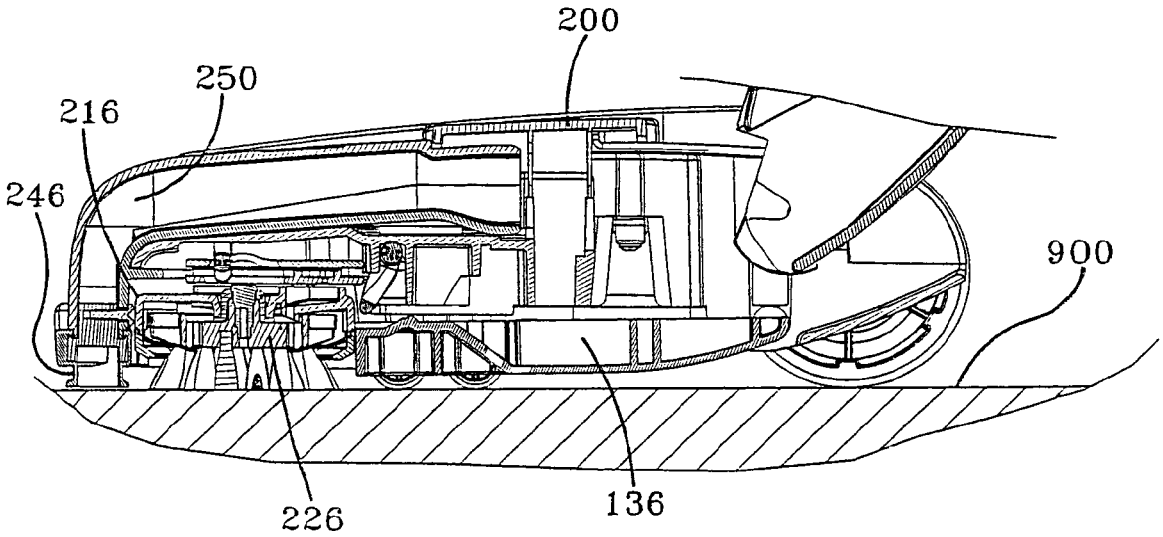
Figure 11:
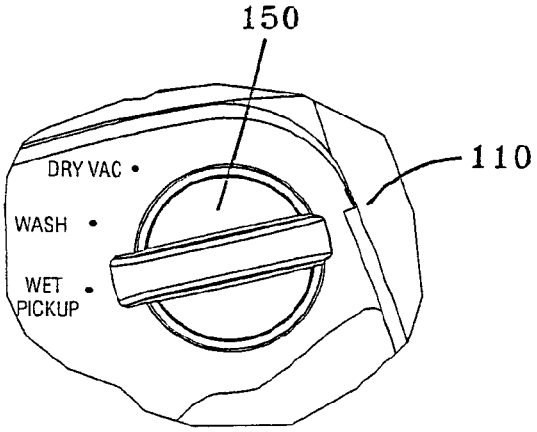
FIG. 11 is side cross-sectional view of the base assembly showing the position of the suction nozzle and the rotary agitators controlled by the position of the mode selector shown in a cutaway portion of the upper housing of a cleaning appliance, according to the preferred embodiment of the present invention.
Figure 11:
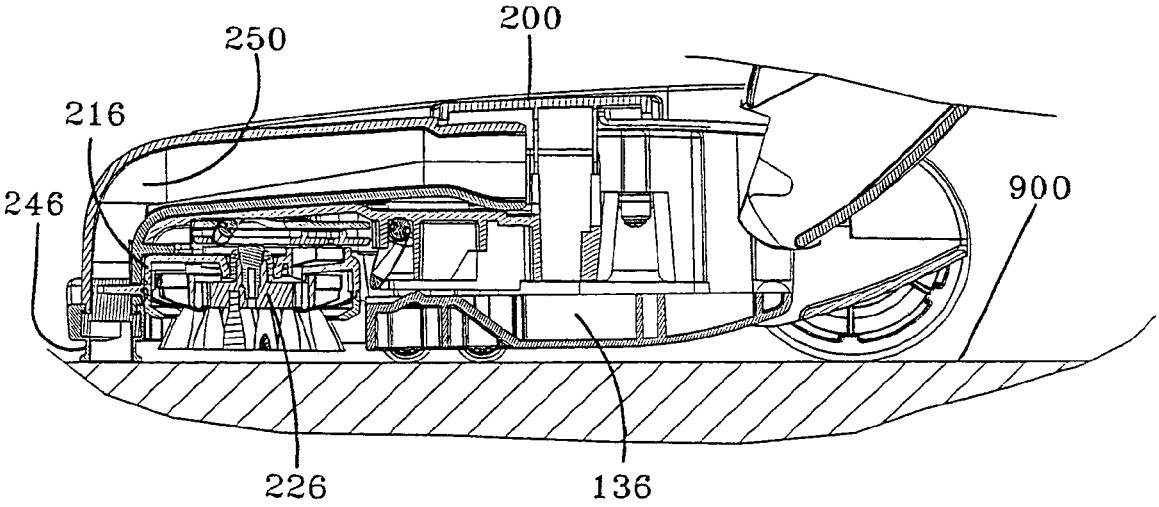
Figure 12:
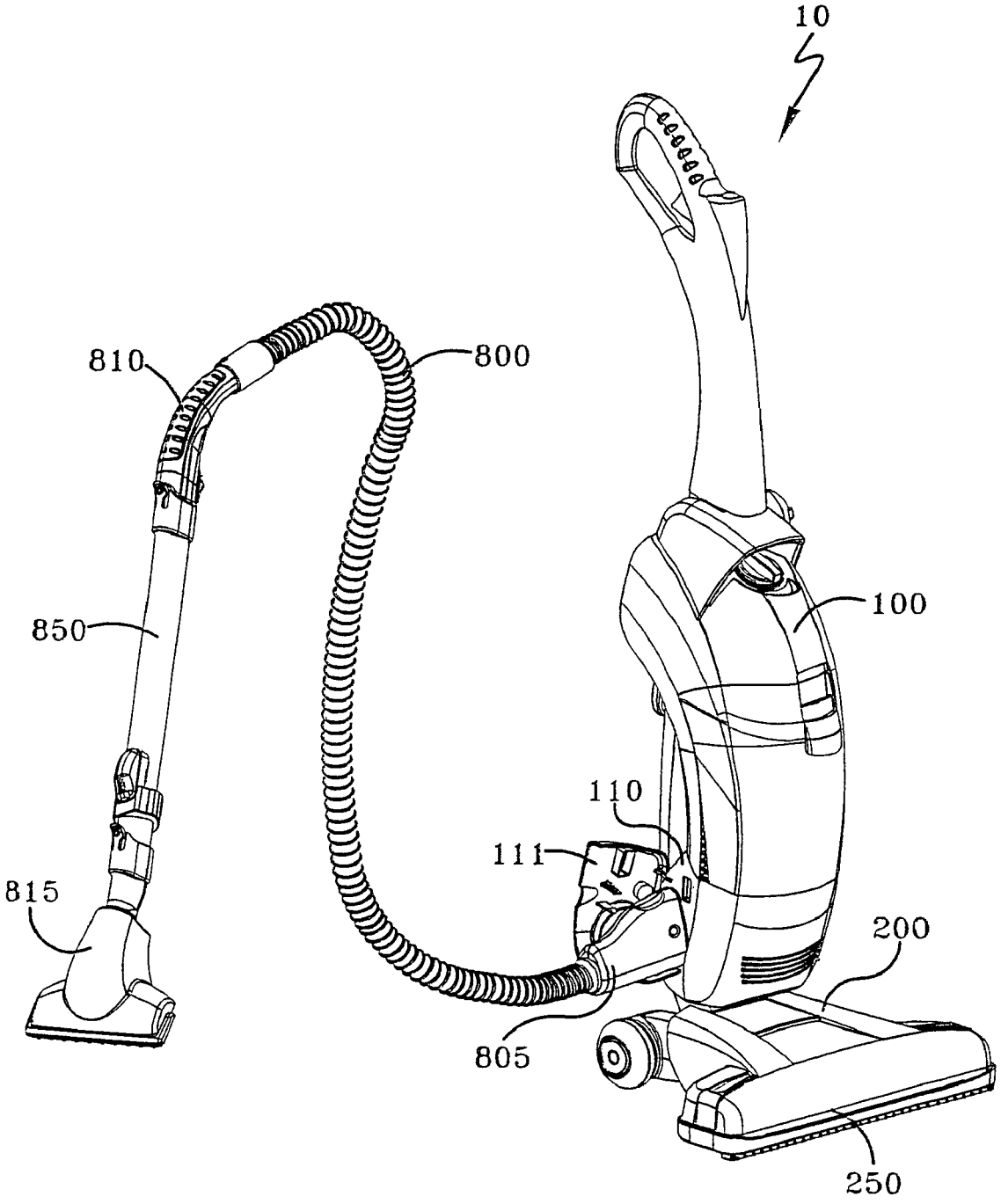
FIG. 12 is a front perspective view of a floor care appliance having an accessory hose and telescoping wand connected to a port on the upper housing, according to the preferred embodiment of the present invention.

Still referring now to FIG. 4, the upper housing assembly 100 includes a carrying handle 105 which attaches to the upper portion of shell 110 and to the front side of handle retainer 112. As previously described, the cleaning solution storage assembly 400 fits inside a cavity 115 formed in carrying handle 115. A mode control selector bore 113 is also formed in the side of carrying handle 105 so that the mode control assembly 151 can be installed on the interior of carrying handle 105 and the mode selector knob 150 can protrude therethrough. A mode control selector cable 157 (also seen in FIGS. 4J, 7 and 7A) transmits the rotary motion of mode selector 150 to the base assembly 200 to control the operation of the brush block assembly 216 and the suction nozzle 250 (FIGS. 9, 10 and 11). A cleaning solution distribution assembly 415 (described in more detail hereinbelow) delivers cleaning solution from the cleaning solution storage tank assembly 400 to a cleaning solution distribution bar 256 (FIG. 7A) in base assembly 200 and to a quick disconnect coupling 450 (best seen in FIGS. 4J and 12B) located beneath an air turbine pump 425 for providing cleaning solution to the accessory hose 800 (FIG. 12) and telescoping wand 850 (FIG. 12). An actuator rod 420 operatively connected to trigger 405 causes cleaning solution from a solution reservoir assembly 430 (described in greater detail in FIG. 4H) to be distributed. Actuator rod 420 is depressed by a control rod 416 (FIG. 4F) that passes through pivoting handle 120 that is actuated by trigger 405 (shown in greater detail in FIG. 4F). When pivoting handle 120 is moved to the storage position, control rod 416 (FIG. 4F) is no longer positioned to depress actuator rod 420 and release cleaning solution as described more fully hereinbelow.

As depicted in FIG. 4, positioned rearwardly of the recovery tank 501 is a recovery duct 538 fluidly connected to a lower recovery duct assembly 530. The lower recovery duct assembly 530 is comprised of a recovery duct connector 535, a lower recovery duct 537 and a recovery duct tee connector 536. One portion of the recovery duct tee connector 538 is connected to the lower end of recovery duct 538 and another portion is fluidly connected to a port 175 (FIG. 12A) for the selective connection of the accessory hose 800 (FIG. 12) and telescoping wand 850 (FIG. 12). The port 175 (FIG. 12A) is located on the lower right hand side of shell 110. The port 175 (FIG. 12A) located on the lower right hand side of shell 110 is covered by a pivoting door 111 (FIGS. 12 and 12A) that is normally in the closed position. The remaining portion of the recovery duct connector 535 is fluidly connected to the suction nozzle 250 (shown exploded in FIG. 7). The upper end of recovery duct 538 is fluidly connected to the recovery tank 501 by a connector 539 that is inserted into a recovery inlet 584 (FIG. 4C) formed in a channel 583 (FIGS. 4B and 4C) in the rear of lid 510 (FIGS. 4B AND 4C). The lower recovery duct 537 is flexible, yielding to permit pivoting of the upper hosing 100 relative to base assembly 200.

The suction duct 520 is fluidly connected to the recovery tank assembly 500 through a connector 520C that protrudes through an aperture 112A in handle retainer 112. Connector 539 fits into a suction inlet 568 (FIGS. 4C and 4B) formed in the top of filter lid 556 (FIGS. 4B, 4C and 4E) of recovery tank 501 (FIG. 3) so suction is delivered to recovery tank 501. One end of the suction duct 520 is connected to the suction inlet 310 of motor-fan assembly 310 by a gasket 133 (FIGS. 4 and 4E). The suction duct 520 has a sidewardly extending outlet 520Dd for fluidly connecting to an air turbine pump 415 (FIGS. 4 and 4E) used to pressurize cleaning solution delivered to the accessory hose 800 (FIG. 12) and telescoping wand 850 (FIG. 12).

The motor-fan assembly 300 is positioned into a cavity located in the lower portion of the body shell 110. As depicted in FIG. 4, a motor cover 132 surrounds the motor-fan assembly 300 being fitted therein with a motor seal assembly 320, motor seal 322 and motor mount 324. A front motor cover 130 is then attached to motor 132 enclosing motor-fan assembly 300. Slotted air inlets are formed in a vent cover 131 that is fitted onto the front motor cover 130 to allow air to be exhausted to the atmosphere from motor-fan assembly 300. A suction inlet 310 on motor-fan assembly 300 provides suction to the recovery tank assembly 500. A rubber motor fan seal 133 provides a seal between the suction inlet 310 of the motor-fan assembly 300 and the suction duct 520 delivering suction to the liquid recovery assembly 500. An aperture 133B in the motor fan seal 133 allows air to flow to duct 520 and a collar 133A aligns the lower end 520A of suction duct 520 with aperture 133B.

Figure 6:
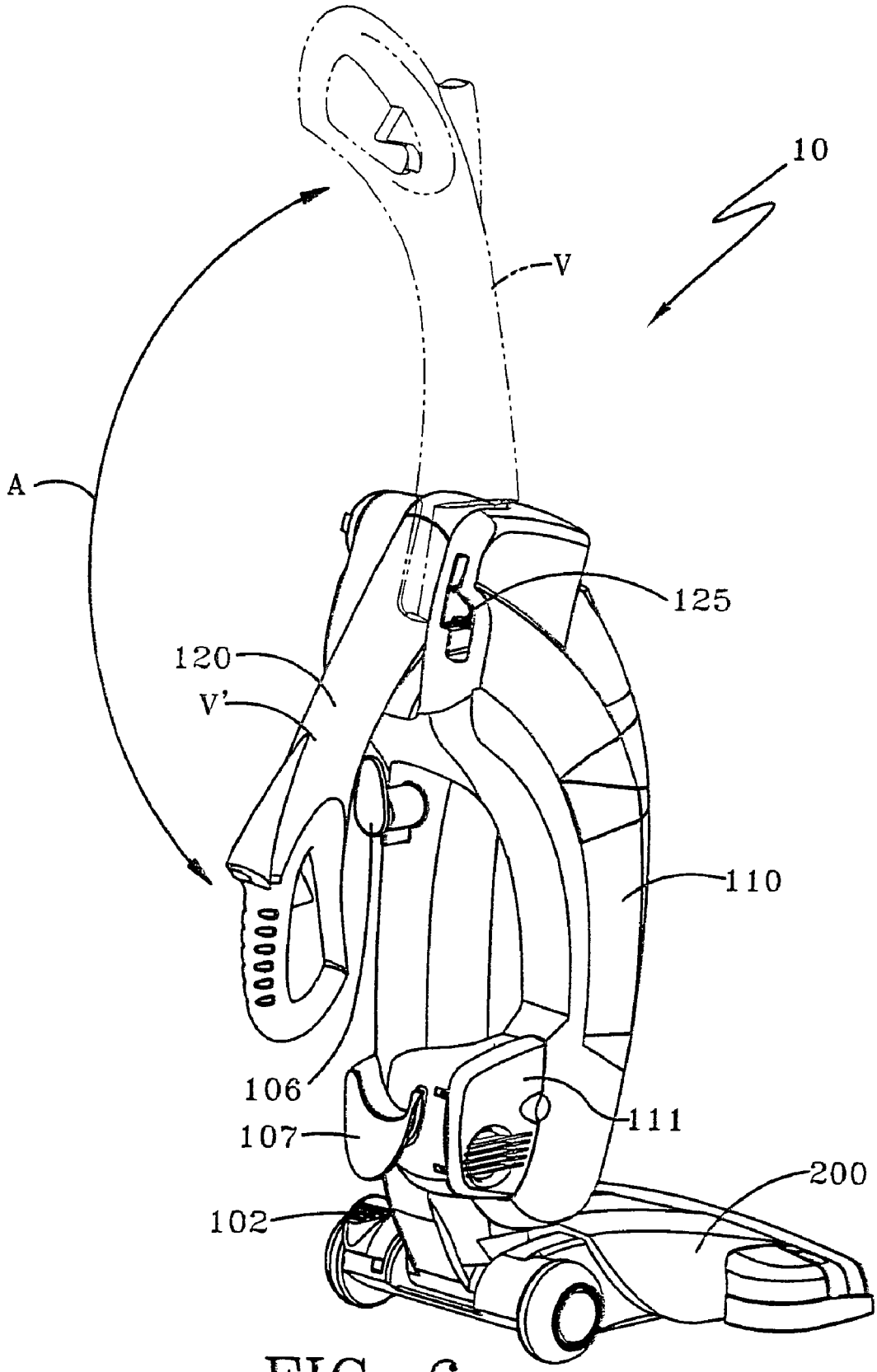
FIG. 6 is a rear perspective view of a cleaning appliance having a pivoting handle that pivots from an in-use position to a storage position, according to the preferred embodiment of the present invention.

Also located in the upper portion of the body shell 110 is a handle release lever 125 (best seen in FIGS. 6 and 6A) for selectively locking or releasing the pivoting handle 120 from the in-use position to the stored position (FIG. 6). The operation of pivoting handle 120 and handle release lever is more fully described hereinbelow.

Figure 4A:
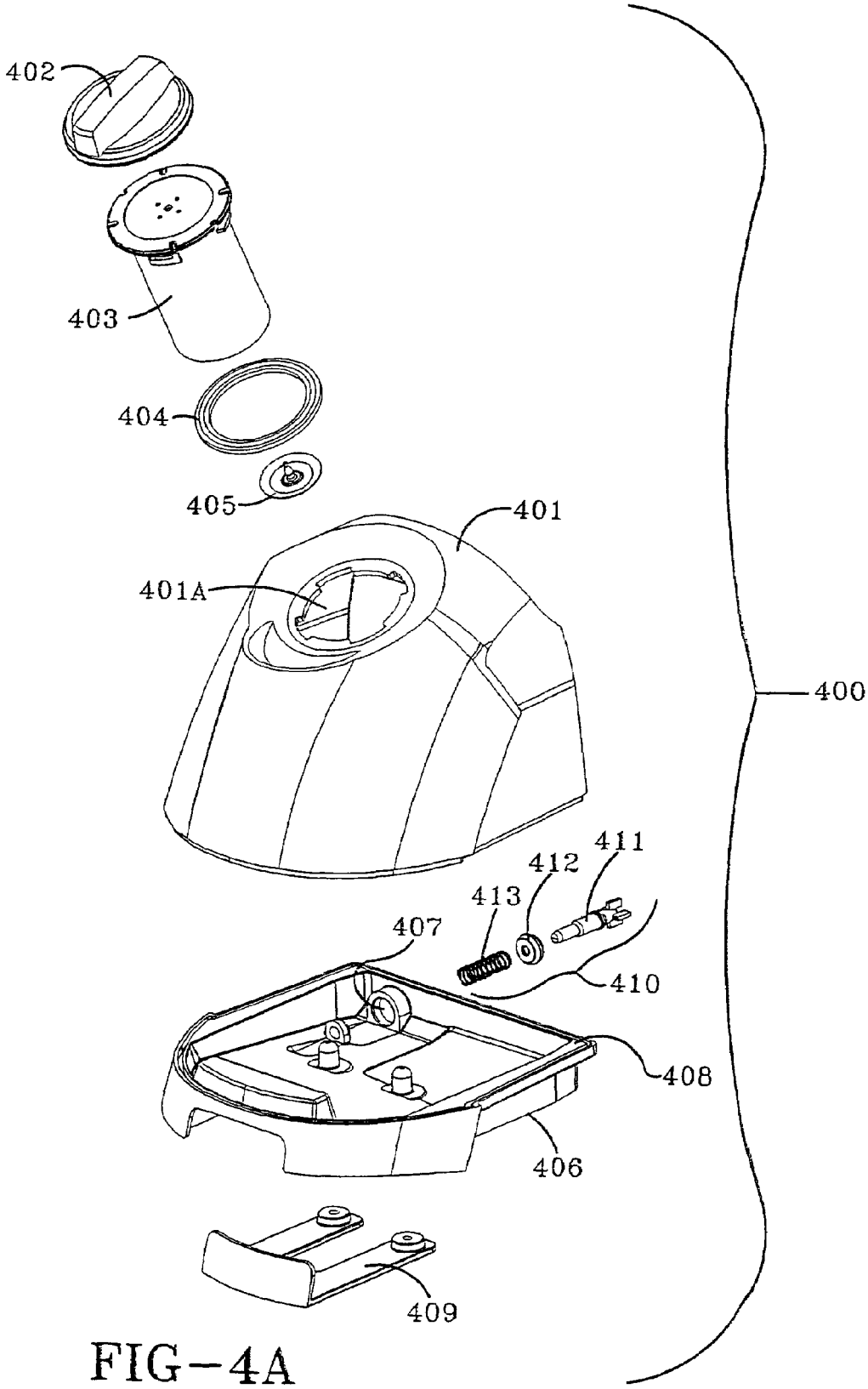
FIG. 4A is an exploded front perspective view of a cleaning solution tank assembly for a floor care appliance, according to the preferred embodiment of the present invention.
Figure 4B:
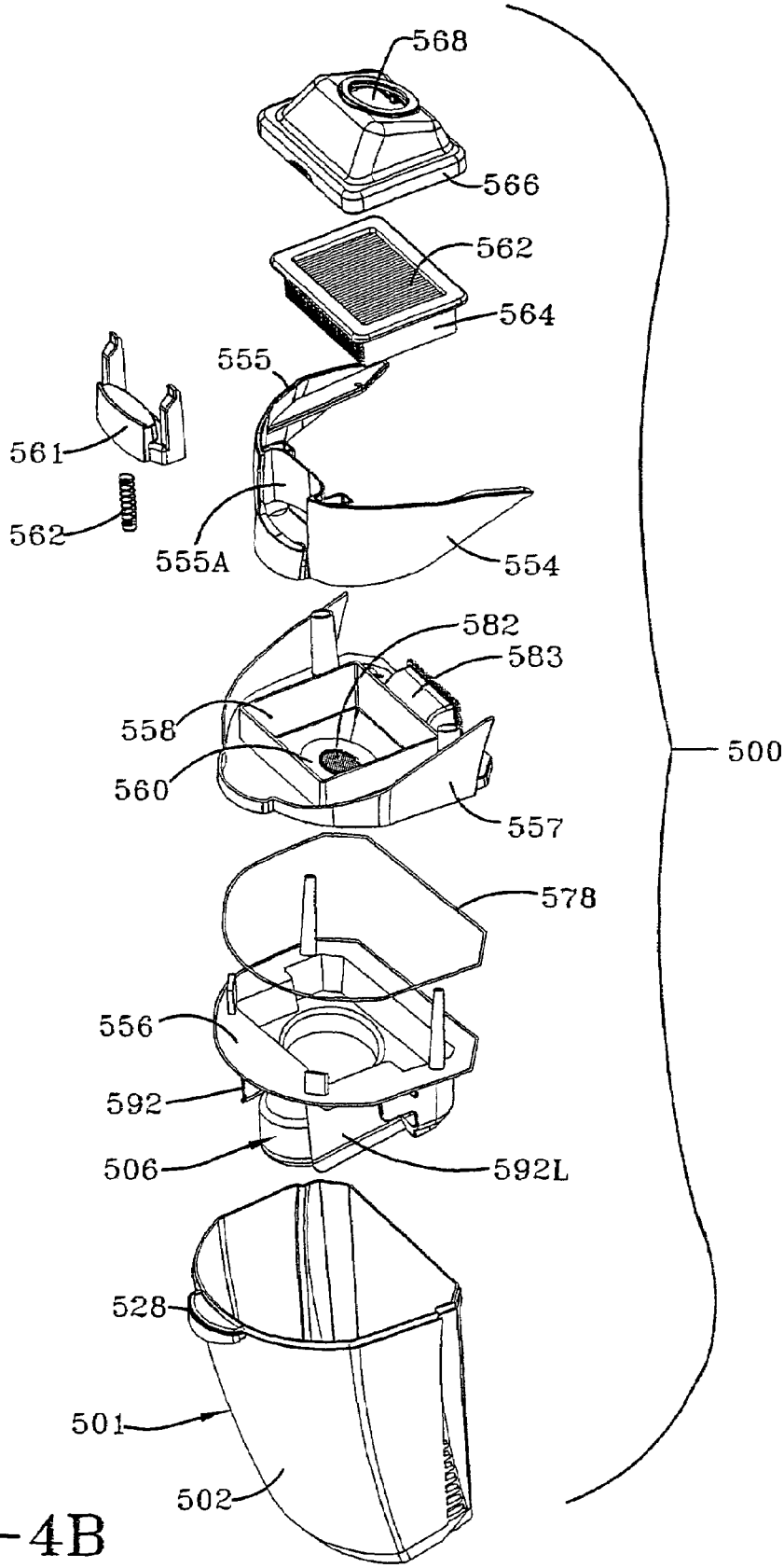
FIG. 4B is an exploded front perspective view of an air/water separator and tank assembly for a cleaning appliance, according to the preferred embodiment of the present invention.
Figure 4C:
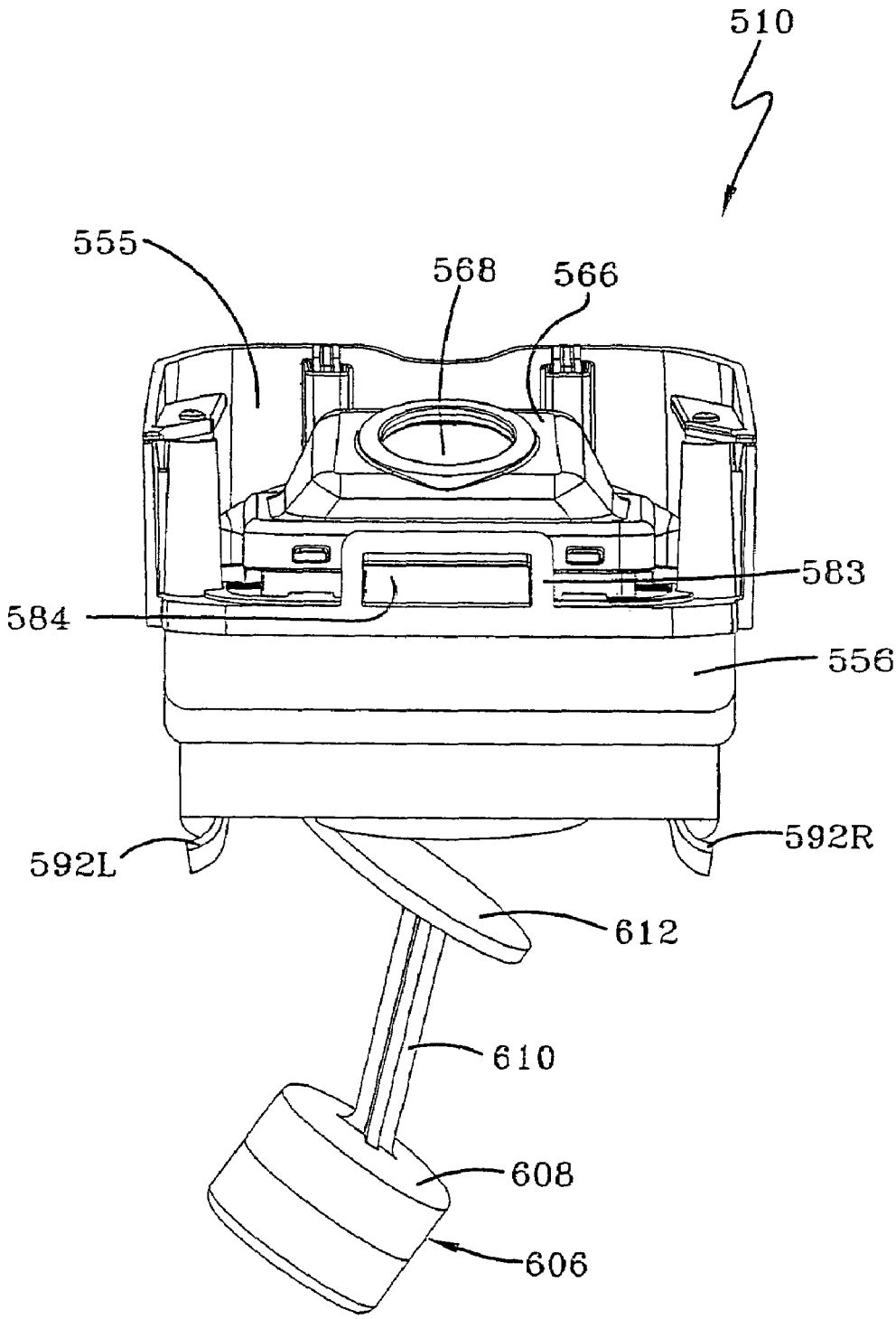
FIG. 4C is a rearview of the lid from the air/water separator and tank assembly for a cleaning appliance, according to the preferred embodiment of the present invention.

Referring now to FIG. 4A, cleaning solution tank assembly 400 includes a hollow upper body 401 and a relatively planar solution tank base 406 which is fusion welded, about its periphery, to the upper body 401. The cleaning solution tank assembly 400 fits into a cavity 115 in carrying handle 105 (FIGS. 3 and 4) resting therein on a ledge 117. The cleaning solution tank is similar to the cleaning solution tank in U.S. Pat. No. 6,640,386 owned by a common assignee and incorporated by reference fully herein. The solution tank base 406 has a valve seat 407 formed in a rear lip 408 in which a solution tank valve assembly 410 is fitted. The solution tank valve assembly 410 is comprised of a spring 413, valve seal 412 and valve stem 411. Valve stem 411 is provided with at least three flutes to maintain alignment of valve plunger 411 within valve seat 407 as plunger 411 axially translates therein and permits the passage of fluid therethrough when plunger 411 is in the open position. Located at the top of upper body 401 of solution tank assembly 400 is a fill opening 401A through which solution tank assembly 400 may be filled with cleaning solution. To assure that the ambient pressure within solution tank assembly 400 remains equal to atmospheric, as cleaning solution is drawn from solution tank assembly 400, an elastic umbrella valve 405 is provided in cap 402. As the ambient pressure within solution tank assembly 400 drops, by discharging cleaning solution from therein, atmospheric pressure acting upon the top side of the umbrella valve 405 causes the peripheral edge to unseat from the surface of cap 402 thereby permitting the flow of atmospheric air into solution tank assembly 400 until the ambient pressure therein equals atmospheric. Once pressure on both sides of the umbrella valve 405 equalizes, the energy stored by deflection of the umbrella valve 405 causes the peripheral edge to reseat itself against the lower surface of cap 402 thereby preventing leakage of cleaning solution from through orifices 424 during operation of the extractor.

Figure 8:
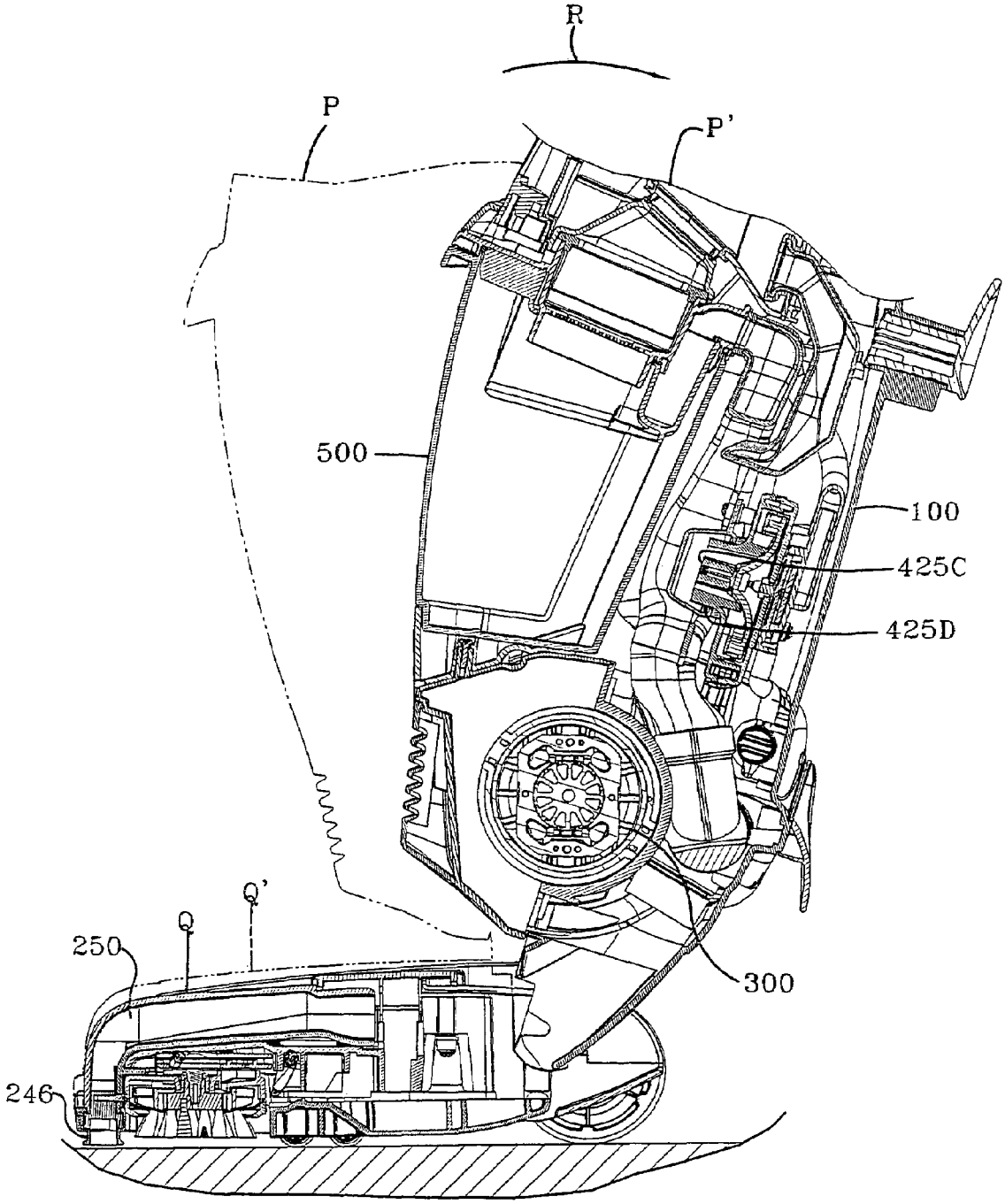
FIG. 8 is side cross-sectional view of the base assembly and a portion of the upper housing of a cleaning appliance, according to the preferred embodiment of the present invention.

The supply valve assembly 410 is normally in the closed position being biased into the closed position by spring 413. However, as supply tank 400 is placed upon the ledge 117 of handle 105, the bore 407 in solution tank base 406 aligns with the nipple 432A (FIGS. 3, 8 and 8A) of the solution reservoir assembly (FIG. 8A). An o-ring 432B fitted on a groove 432B (FIG. 8A) creates a fluid tight connection between the bore 407 in solution tank base 406 and nipple 432A (FIG. 8A). When the solution tank assembly 400 is placed in cavity 115, valve stem 411 is pushed inward inside valve seat 407 so that fluid flows from within solution tank 401 to nipple 432A and reservoir assembly 430. When supply tank 400 is removed, valve stem 411 is released and forded into the closed position by spring 413. A latch 409 on the underside of solution tank base 406 secures solution tank assembly 400 in cavity 160.

Referring now to FIG. 4Bb, shown is an exploded view of the combined air/water separator and recovery tank assembly 500. The combined air/water separator and tank assembly 500 is nearly identical to the combined air/water separator and recovery tank disclosed in U.S. Pat. No. 6,640,386 issued to a common assignee and incorporated by reference fully herein. The recovery tank assembly 500 includes a recovery tank 501 having an inverted cup shaped handle 528 integrally molded to its front wall 502. The air/water separator and recovery assembly 500 further includes a lid 510 located above the recovery tank 501 (FIG. 3). The lid 510 includes an upper portion 555 mounted to a middle portion 557 which is then mounted to a lower portion 556 with a rope seal 578 therebetween. A rectangular shaped retainer 558 is integrally formed on the top surface of the middle portion 557 of the lid 554 and surrounds the center tank exhaust opening 560. An integrally molded screen 582 covers the exhaust opening 560. A pleated filter 562 integrally molded to a seal 564 is seated in the retainer 558. A cover 566 with an outlet opening 568 formed therein covers the seal 564 and filter 562. A latch 561 fits into a pocket 555*a* in the front of upper portion 555 and is biased upward by a spring 562 to secure the air/water separator assembly 500 in cavity 160 (FIG. 3.) A pair of upwardly extending projections on latch 561 engage the notches in the lip 116 (FIG. 3) when air/water separator assembly 500 is in the installed position.

Figure 4D:
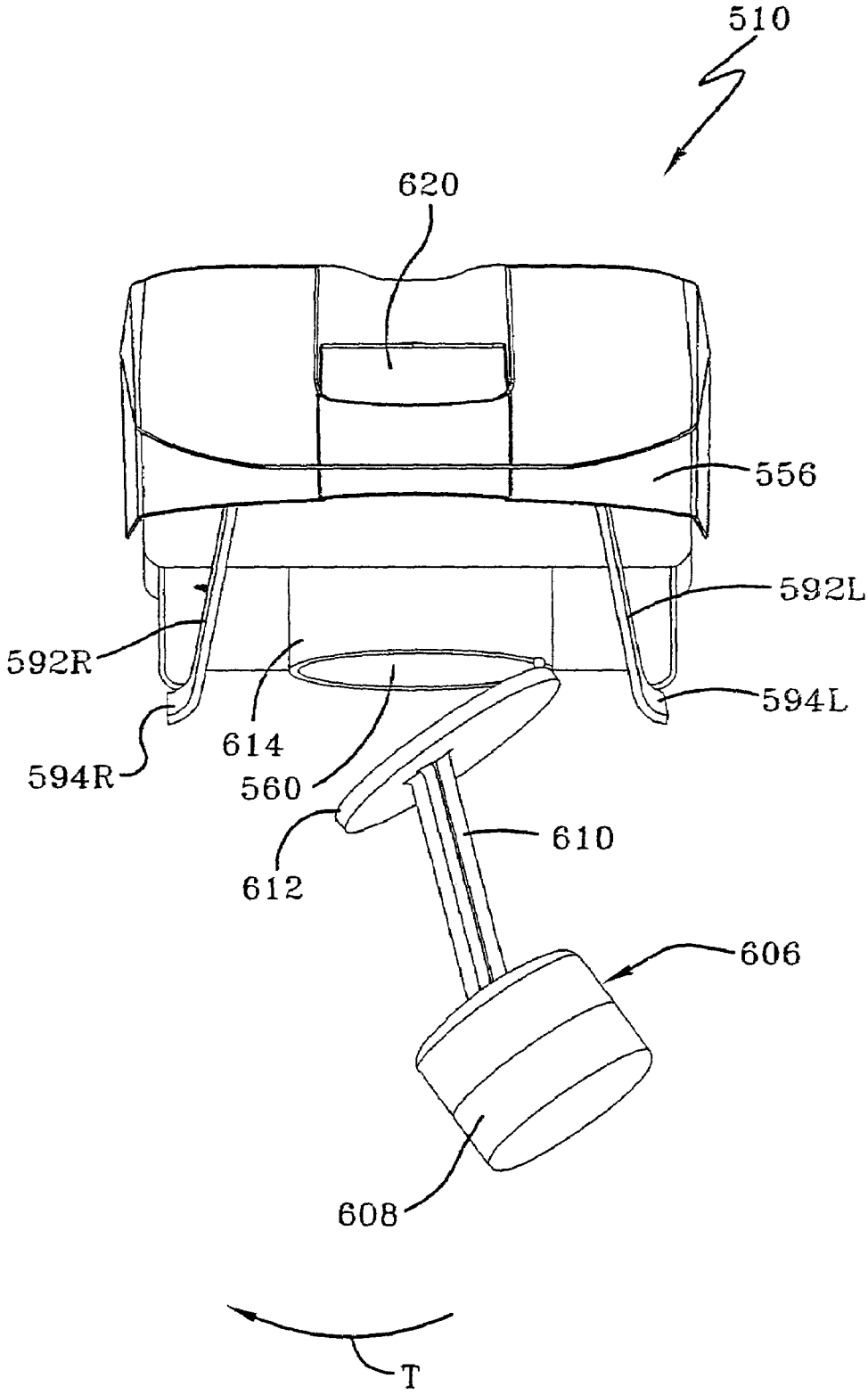
FIG. 4D is a front of the lid from the air/water separator and tank assembly for a cleaning appliance, according to the preferred embodiment of the present invention.
Figure 4E:
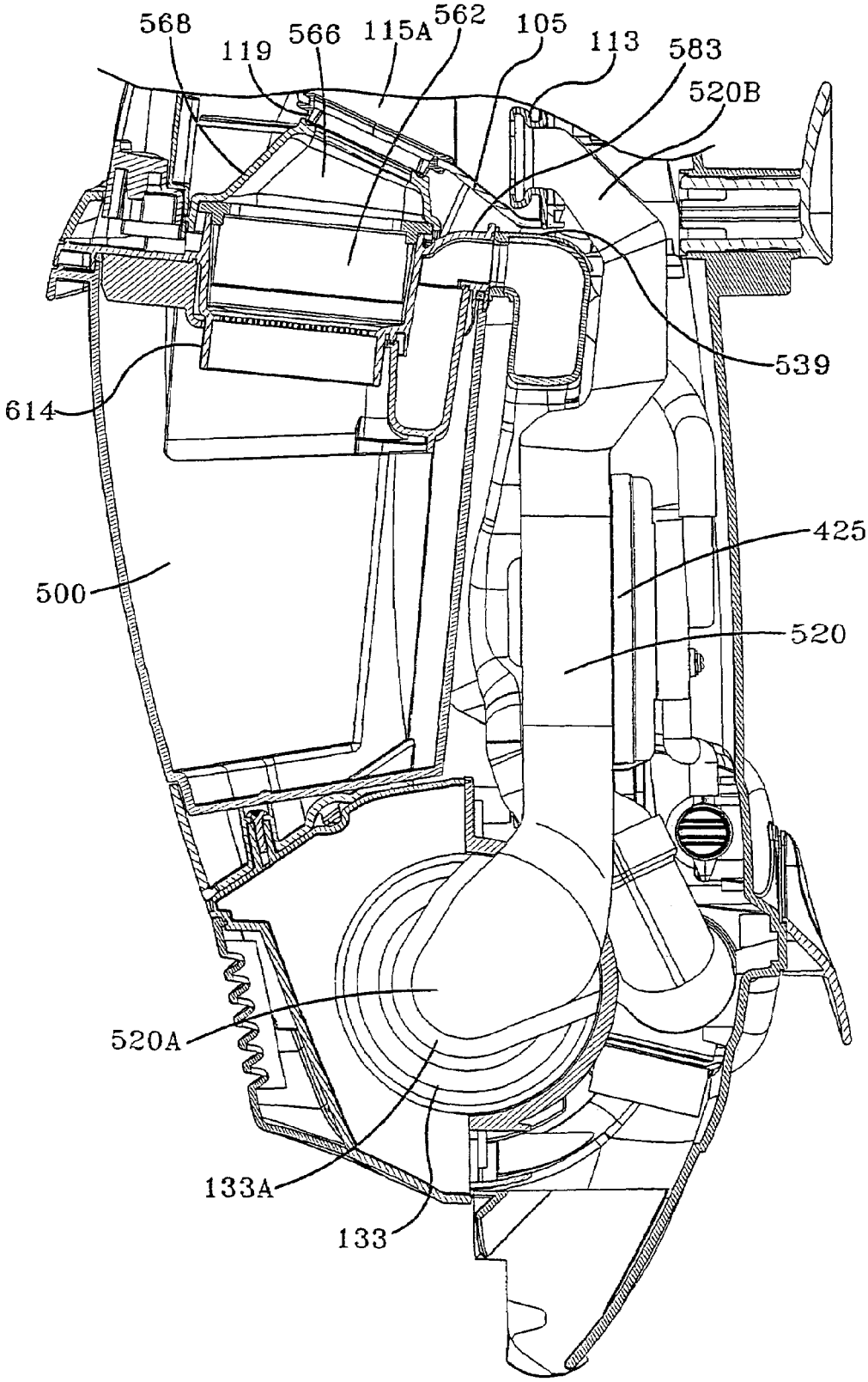
FIG. 4E is a cutaway side view of the upper housing of a cleaning appliance, according to the preferred embodiment of the present invention.

When the floor cleaner 10 is in operation, suction from motor fan assembly 300 is applied to the air/water separator and tank assembly 500 through an opening 568 in the filter lid 566. The suction inside the air/water separator and tank assembly 500 creates an airstream originating at the suction nozzle 250 for drawing in used cleaning solution and dirt. The suction inside the air/water separator and tank assembly 500 is directed to the suction nozzle 250 through a rectangular opening 584 in the rear of lid 510. The rectangular opening is fluidly connected to the upper recovery duct 538 and lower recovery duct assembly 530 which is then fluidly connected to suction nozzle 250. The airstream entering the air/water separator and tank assembly 500 through rectangular opening 584 is directed towards a pair of downwardly depending shields 592R, 592L (FIGS. 4C and 4D). As depicted in FIG. 4D, each shield 592 is slightly angled outward and also includes more pronounced outwardly angled drip edges 594R, 594L on the bottom ends. The shields 592R, 592L and drip edges 594R, 594L, and 596 aid in separation of the liquid and minimize the amount of liquid entering the exhaust opening 560. Air separated from the liquid flows through the exhaust opening 560, is filtered by the screen 582 and pleated filter 562, and exits through the outlet opening 568 in the cover 566. A float assembly 606 comprises a bottom float 608 connected by a stern 610 to an upper portion defining a seal 612. The seal 612 is pivotally connected to the underside of the lid 510 and drops down to open the exhaust opening 560. This design prevents water from traveling from the float 608 to the seal 612. When the liquid level in the recovery tank 501 reaches a full level, the float 608 will move upward thereby pivotally the seal 612 upward in the direction of arrow T to cover the neck 614 of the exhaust opening 560. In this position, the seal 612 closes the exhaust opening 560 to prevent the liquid from entering the motor area. When the hard floor cleaning unit 10 is used in the dry mode, the large objects drawn into the recovery tank 501 by the suction motor assembly 300 collect on the bottom of recovery tank 501 and small objects or particles such as dust are filtered out by the screen 582 and pleated filter 562 and prevented from entering the motor-fan assembly 300 area.

Figure 4F:
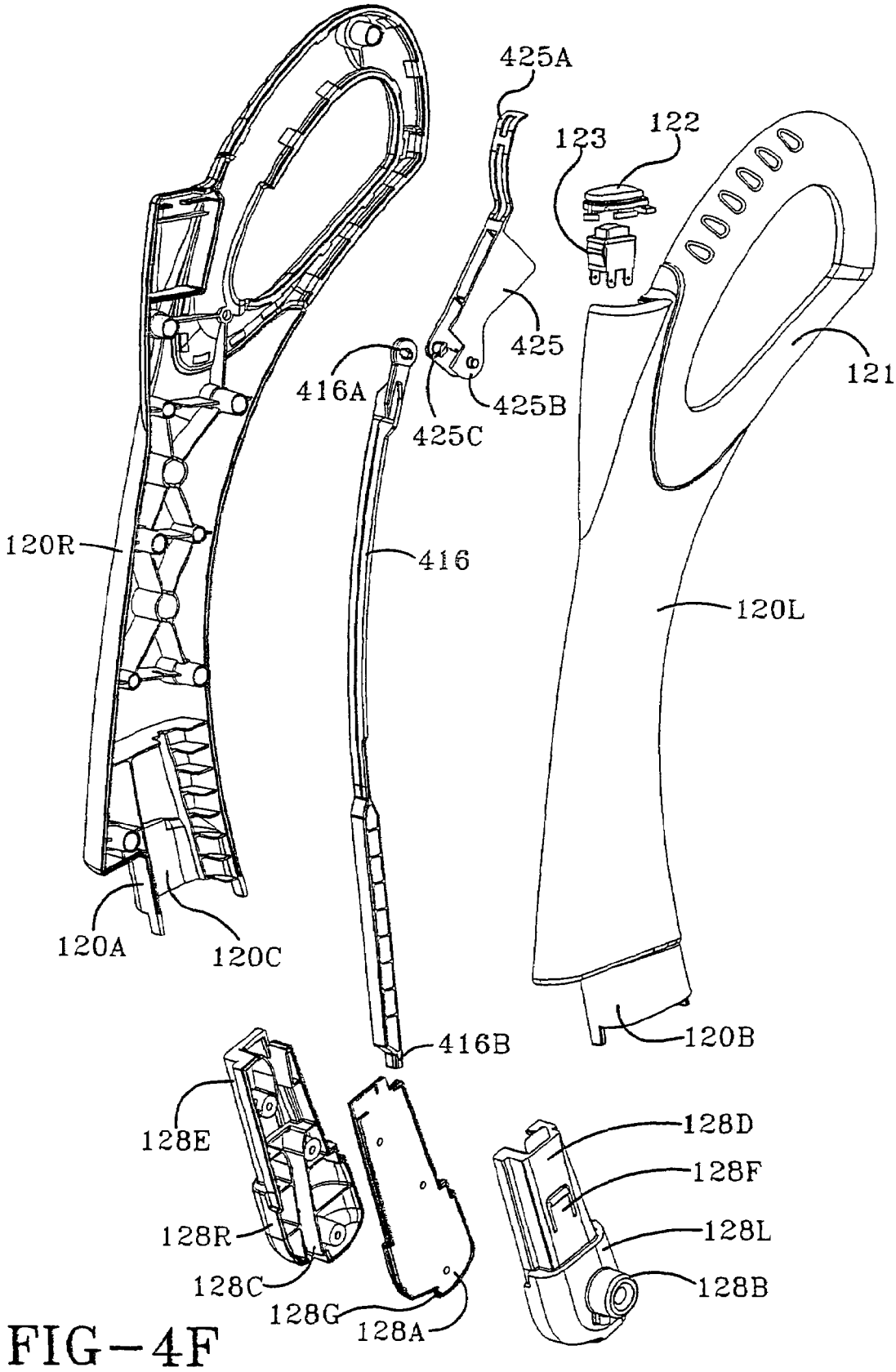
FIG. 4F is an exploded front perspective view pivoting handle of a cleaning appliance, according to the preferred embodiment of the present invention.
Figure 4G:
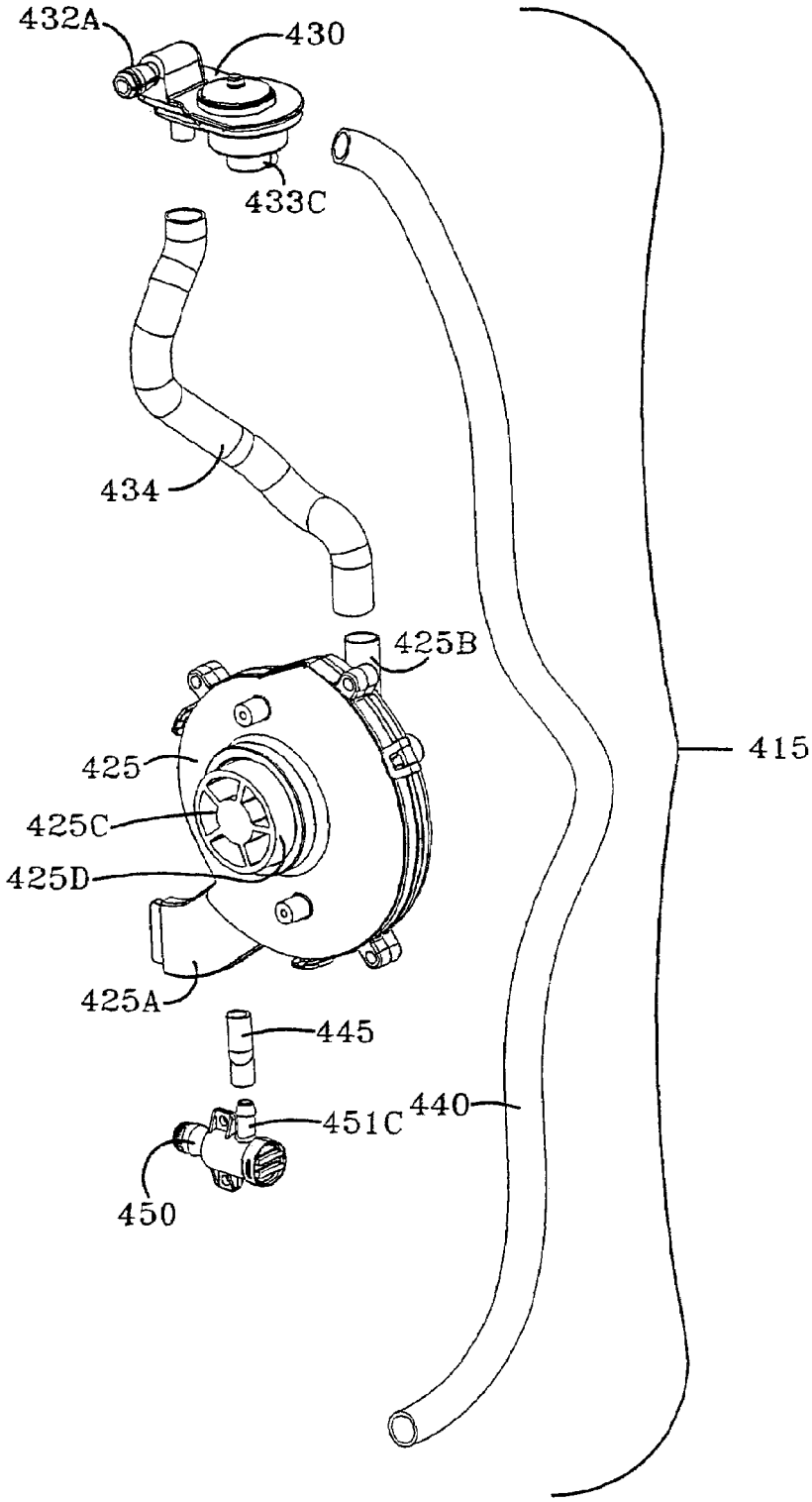
FIG. 4G is an exploded view of the cleaning solution distribution assembly for a cleaning appliance, according to the preferred embodiment of the present invention.
Figure 4H:
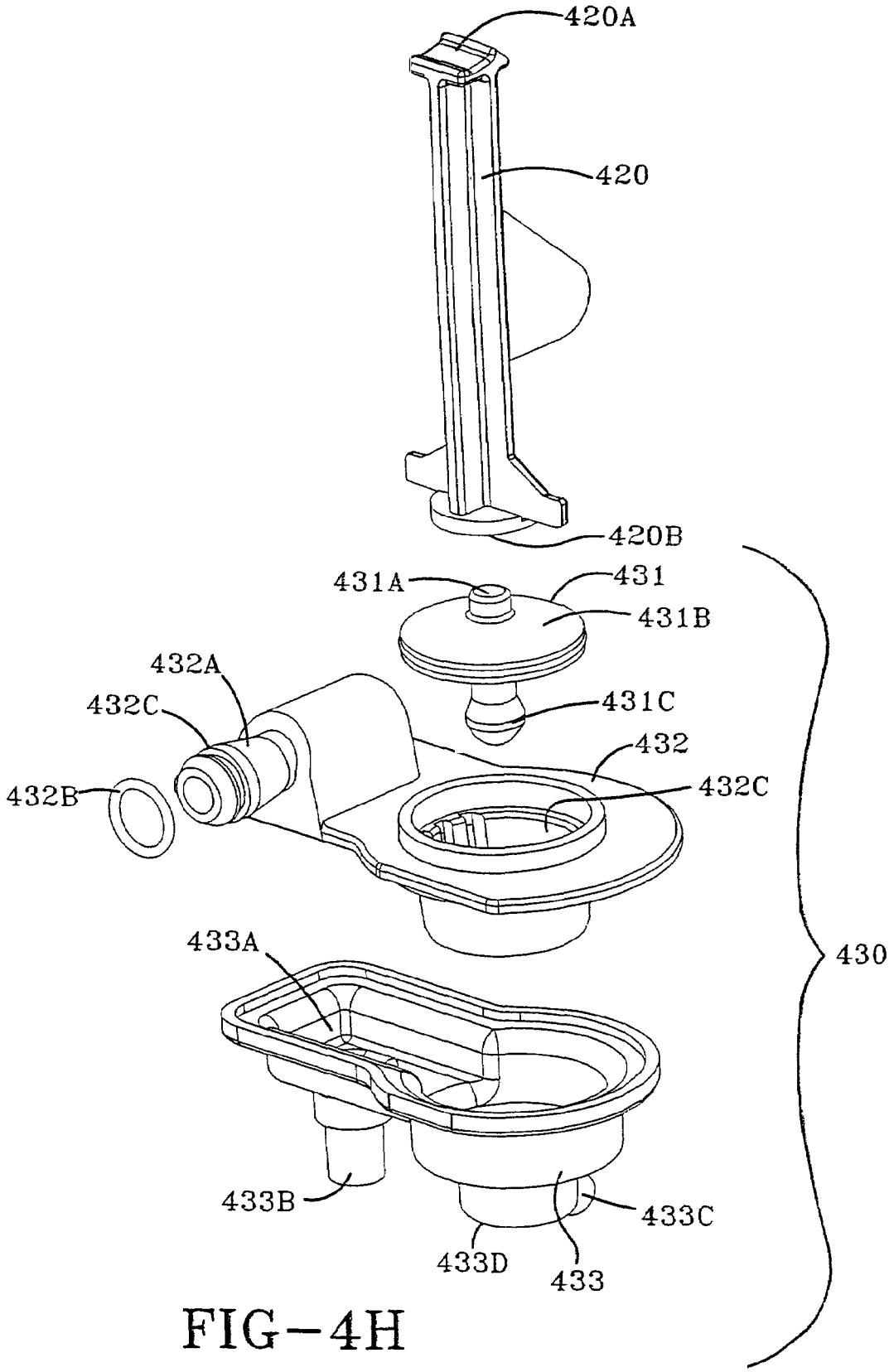
FIG. 4H is an exploded view of the cleaning solution reservoir for a cleaning appliance, according to the preferred embodiment of the present invention.
Figure 7A:
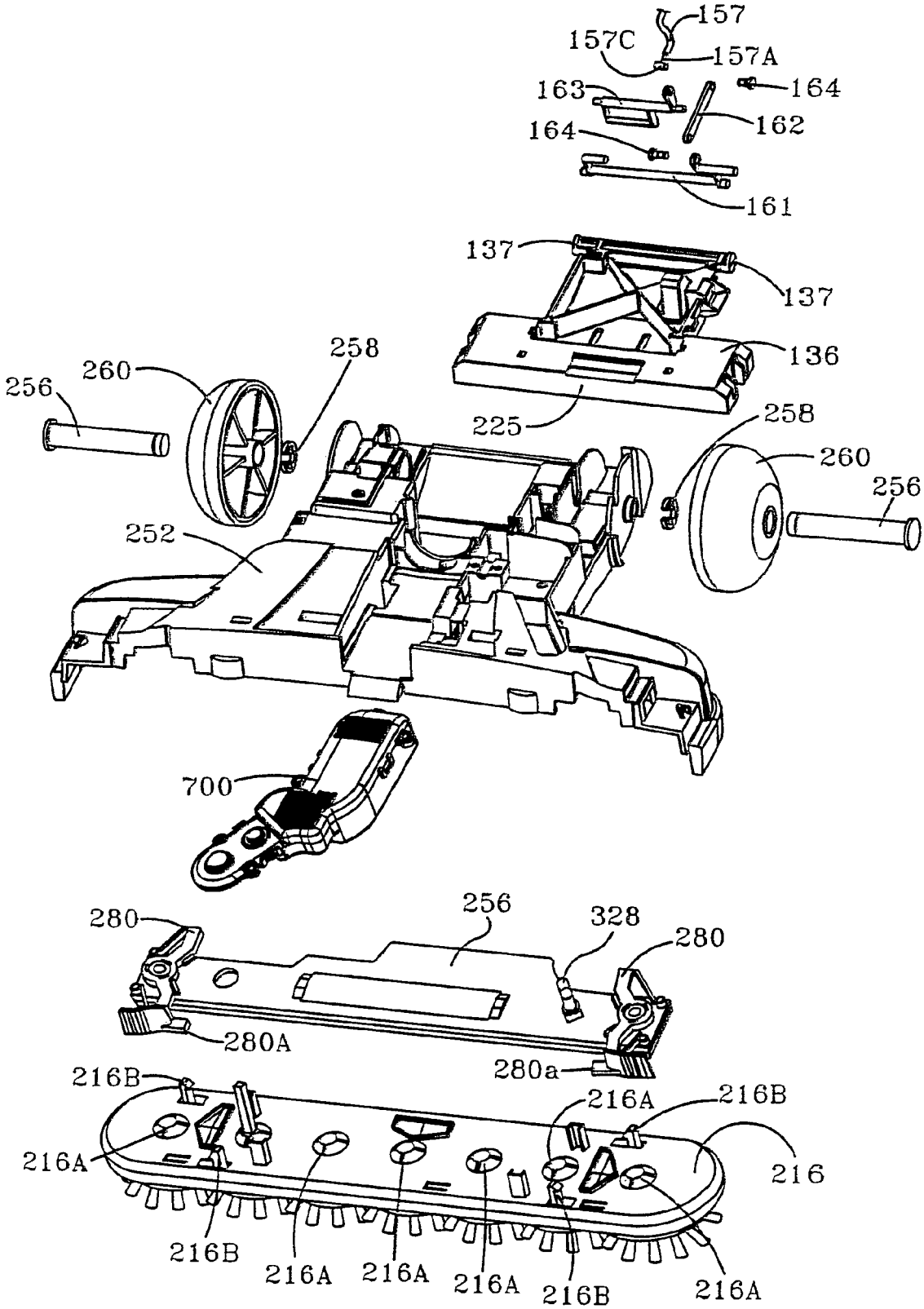
FIG. 7A is an exploded front perspective view of a portion of the base assembly of a cleaning appliance, according to the preferred embodiment of the present invention.
Figure 13A:
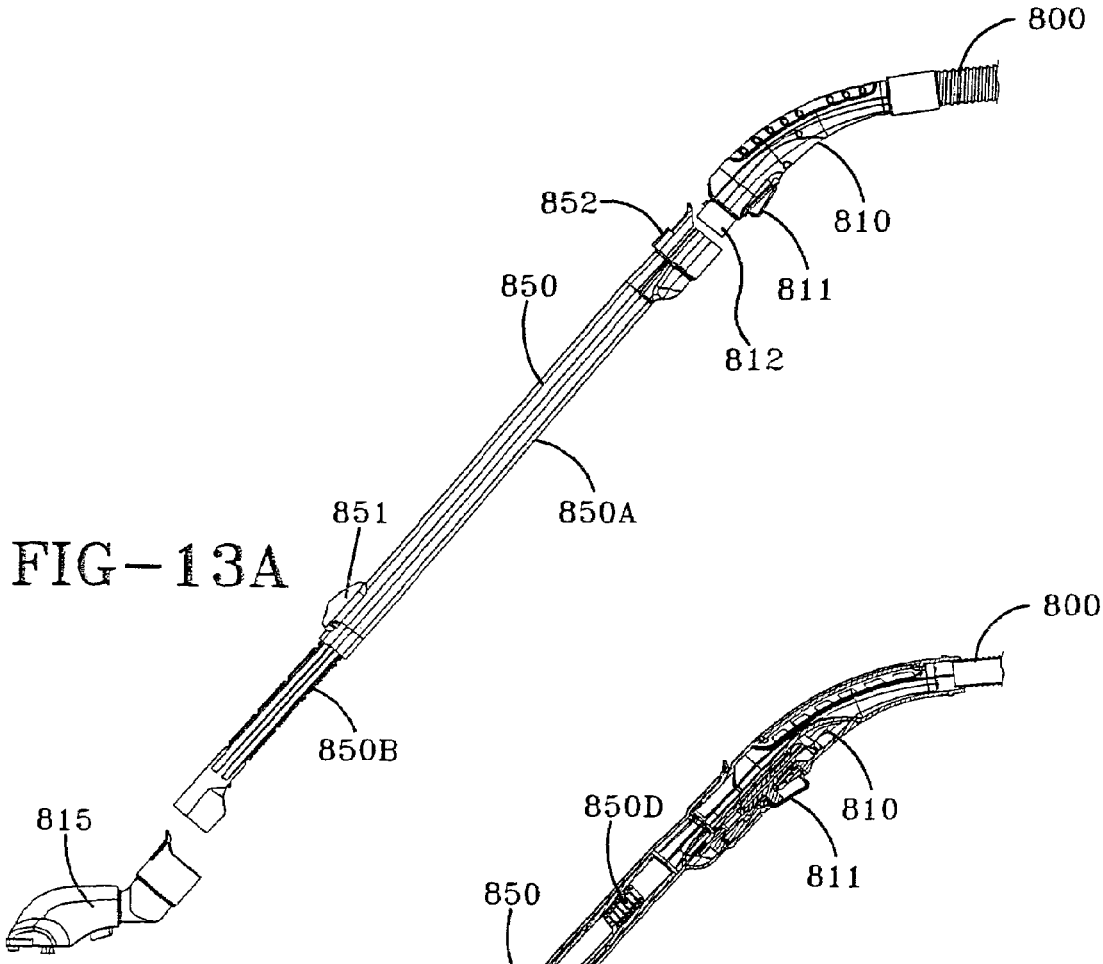
FIG. 13A shows an exploded view of a telescoping wand and an accessory suction nozzle of a floor care appliance connected to a cutaway portion of an accessory hose, according to the preferred embodiment of the present invention.
Figure 13B:
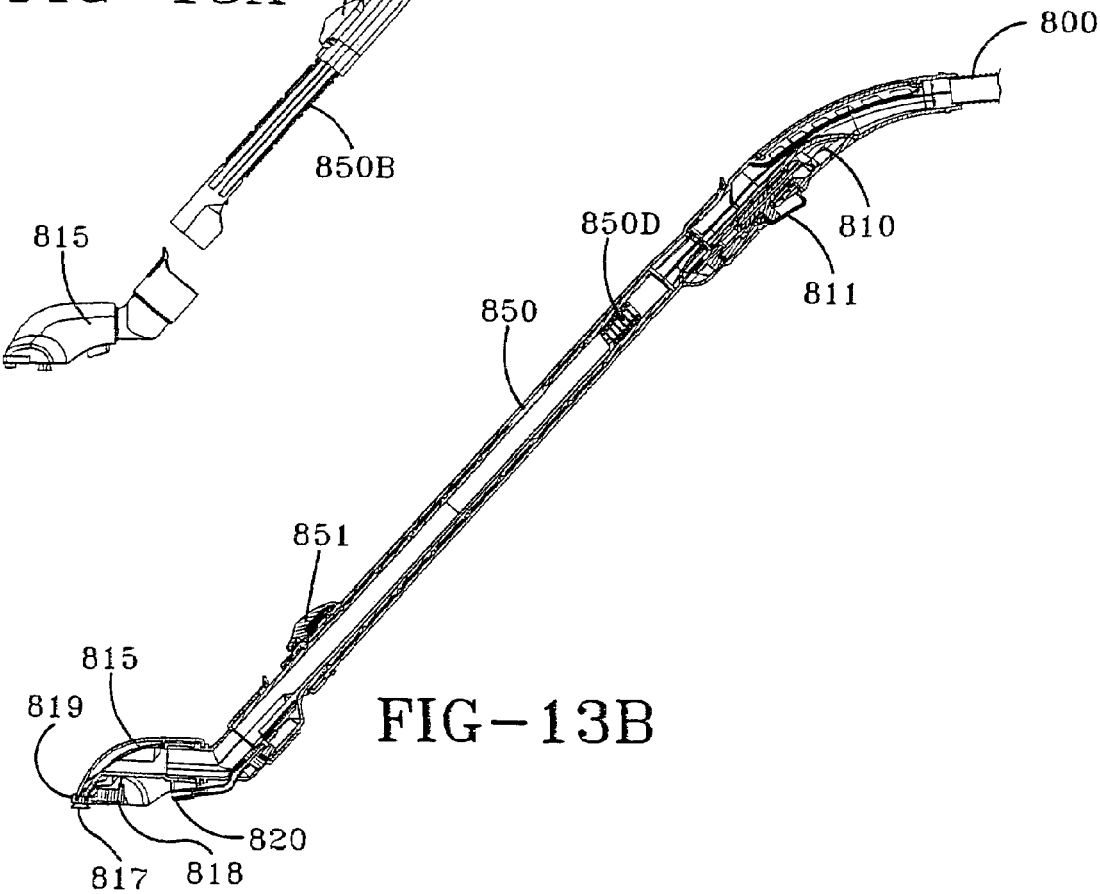
FIG. 13B shows a cross-sectional view of a telescoping wand and an accessory suction nozzle of a floor care appliance connected to a cutaway portion of an accessory hose, according to the preferred embodiment of the present invention

Referring now to FIG. 4G, shown is a cleaning solution delivery assembly 415. A cleaning solution reservoir 430 (shown in greater detail in FIG. 4H) receives cleaning solution from the solution tank connector 432A for further distribution. The cleaning solution can be dispensed onto the floor surface by depressing trigger 405 (FIG. 2) or by depressing the trigger 811 on handgrip 810 (FIG. 13) when using the accessory hose 800 (FIG. 12) and telescoping wand 850 (FIG. 12). Depressing trigger 405 (FIG. 2) urges control rod 416 downward (shown in FIGS. 4F, 5 and 5A) which urges actuator rod 420 downward. The lower end 416B (FIGS. 4F and 5A) of control rod 416 operates upon the upper end 420A (FIG. 4H) of actuator rod 420A. The lower end 420B of actuator rod 420 operates upon valve assembly 431. When valve assembly 431 is depressed, cleaning solution is allowed to flow to a solution conduit 440 which supplies cleaning solution to the cleaning solution distributor bar 256. The solution release valve 431 is operated by pressing downward upon the elastomeric release valve member 431A by the lower end 420B of actuator rod 420 thereby deflecting the center of flange 431B downward urging nose 431C downward and away from valve seat 432C permitting the passage of cleaning solution therethrough into discharge port 433D and tube 440. Energy stored within flange 431B, as a result of being deflected downward will, upon release of the force applied by the lower end 420B of actuator rod 420, returns the valve member 431 to its normally closed position. Such an arrangement is similar to that disclosed in U.S. Pat. No. 5,500,977; the disclosure of which is incorporated by reference. Extending outward from an upper valve body 432 is a solution tank connector 432A for connection to the valve seat 407 (FIG. 4A) of the solution tank assembly 400 (FIG. 4A). A groove 432C on the distal end of solution tank connector 432A is for placement of an O-ring 432B for sealing. The upper valve body 432 fits into a lower valve body 433 which has a nipple 433B extending therefrom for connection to a supply conduit 434 for supplying cleaning solution to the air turbine pump assembly 425 for further distribution to the accessory hose 800 (FIG. 12) and telescoping wand (FIG. 12). A nipple 425A on the air turbine pump fluidly connects to supply conduit 434. Another nipple (not shown) on air turbine pump 425 connects air turbine pump 425 to a short fluid supply conduit 445 for further connection to a nipple 451C on the quick disconnect valve assembly 450. Another fluid supply conduit 440 is fluidly connected to a nipple 433C (FIG. 4H) on the solution reservoir 430 for delivering by gravity cleaning solution to the cleaning solution distribution bar 256 located above brush block 216 (FIG. 7A). The fluid supply conduit 440 is connected to a fitting 328 on the cleaning solution distribution bar 256 (FIG. 7A). A plurality of suction inlets 425C on air turbine pump 425 allow suction to be applied from the motor-fan assembly for providing operating pressure. The suction connector 520*d* from suction duct 520 fits over the rim portion 425D of air turbine 425. The connection of suction duct 520 to air turbine pump 425 can also be seen in FIG. 4E.

Cleaning solution is also normally supplied to air turbine pump 425 by a solution conduit 434 for further distribution to quick disconnect coupling 450. Quick disconnect coupling 450 is positioned so that the solution connection nipple 451D is exposed at port 175. This allows the solution connector 805*d* (FIG. 12A) of the accessory cleaning hose wand connector 805 (FIG. 12A) to be connected to the solution connection nipple 451D and pressurized cleaning solution is delivered to the accessory hose 800 (FIG. 12) and telescoping wand (FIG. 12). In an alternate embodiment of the invention, air turbine pump 425 can be replaced with an electric pump for supplying pressurized cleaning solution to quick disconnect coupling 450.

Figure 4I:
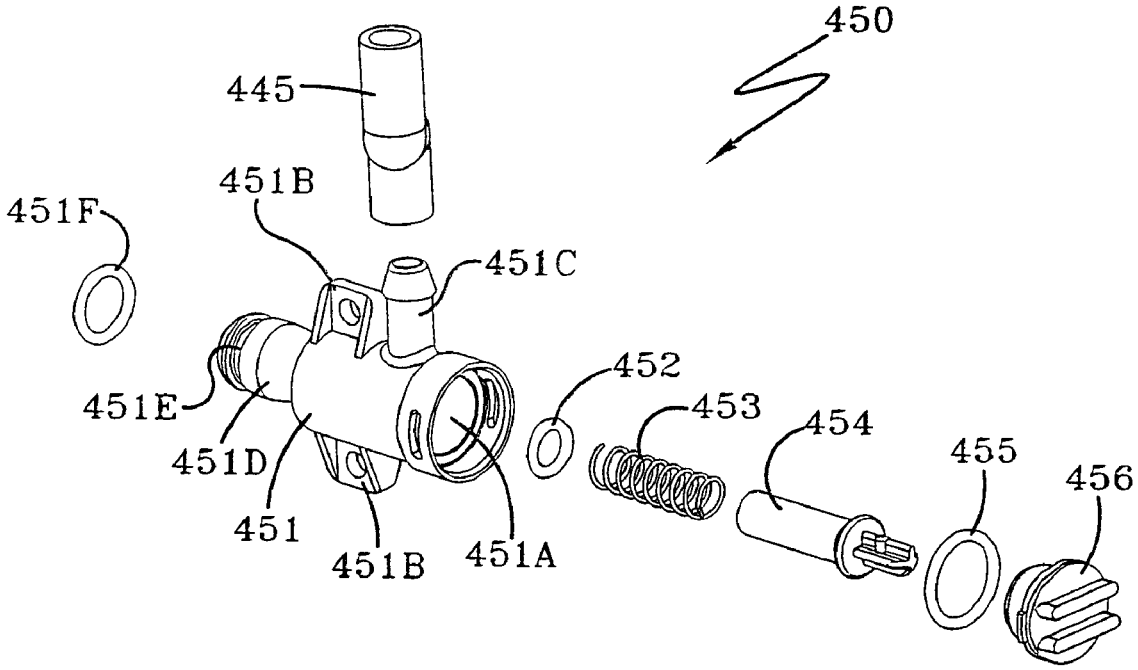
FIG. 4I is an exploded view of a quick disconnect coupling for a cleaning appliance, according to the preferred embodiment of the present invention.
Figure 12A:
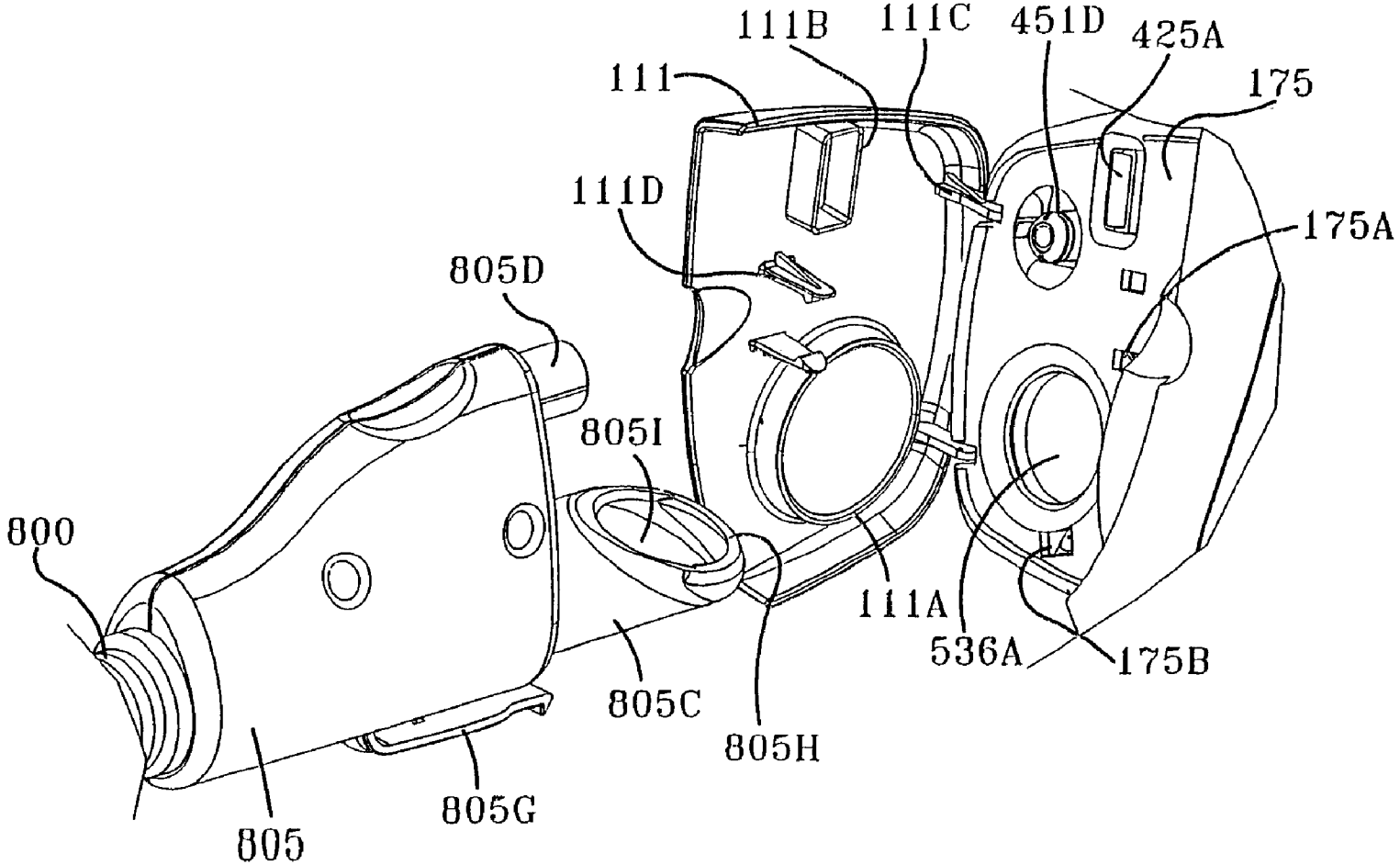
FIG. 12A is an enlarged front perspective view of an accessory hose connector removed from a connection port located on the upper housing of a floor care appliance, according to the preferred embodiment of the present invention.

Referring now to FIG. 4I, the quick disconnect coupling 450 is comprised of a valve body 451 having a bore 451A on one end for receiving an o-ring 452, spring 453, valve stem 454, o-ring 455 and cap 456. A nipple 451*c* on the valve body 451 fluidly connects to a solution conduit 445. A pair of securing tabs extend from valve body 451 for securing the valve body to the interior of floor cleaner 10. The solution connector nipple 451D has a groove 451E for receiving an o-ring 451F. The o-ring 451F acts as a seal when the cleaning solution connector 805D, (FIG. 12A) is connected to solution connector 451D (FIG. 12A). In addition, valve stem 454 is depressed which allows the pressurized cleaning solution to flow to the solution connector 805D (FIG. 12A). Spring 453 urges valve stem 453 back into the closed position when solution connector 805D is removed. In an alternate embodiment of the invention, air turbine pump 425 can be replaced with an electric pump for supplying pressurized cleaning solution to quick disconnect coupling 450. The electric pump is energized when the connector 805D is connected to solution connector 451D (FIG. 12A).

Figure 4J:
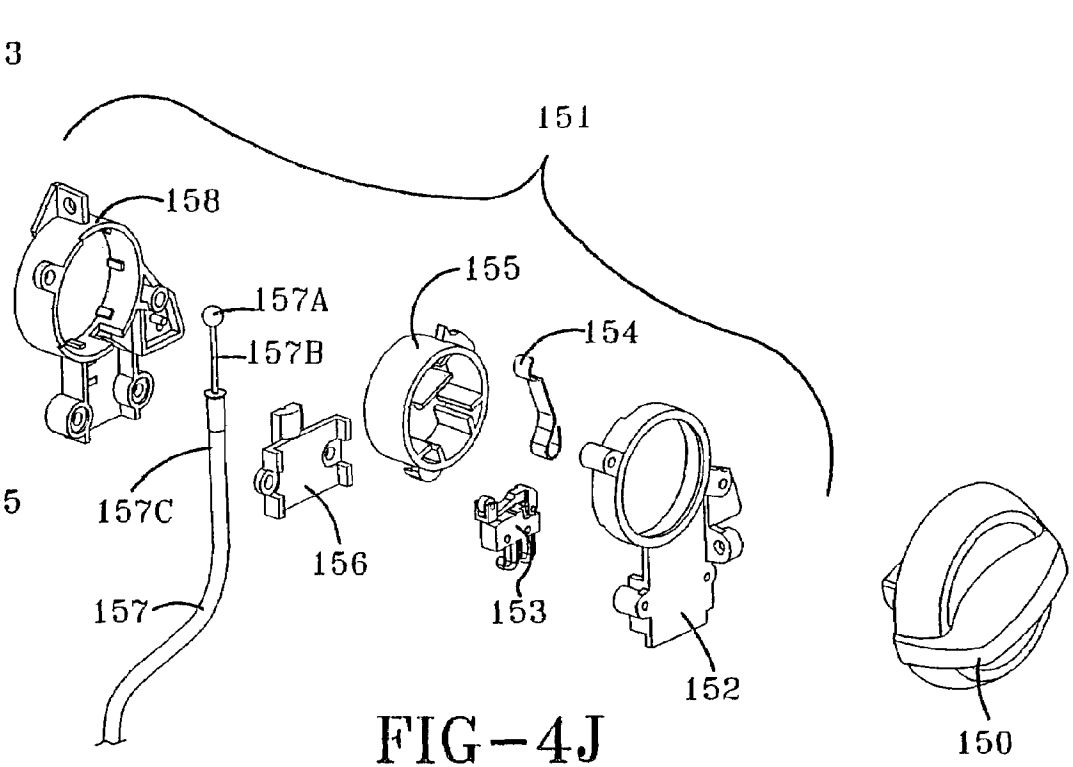
FIG. 4J is an exploded view of the mode control assembly exploded from the upper housing of a cleaning appliance, according to the preferred embodiment of the present invention.
Figure 4K:
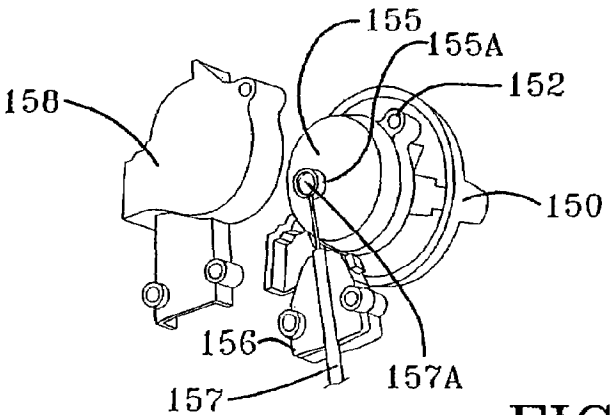
FIG. 4K is a partially exploded view of the mode control assembly shown in FIG. 4J, according to the preferred embodiment of the present invention.

Referring now to FIGS. 4J and 4K, shown are exploded views of a mode control assembly 151 and mode control selector 150. In FIG. 4J, the mode control selector assembly 151 and mode control selector 150 are removed from removed from a bore 113 formed in a portion of carrying handle 105. Mode control selector 150 allows the cleaning mode to be selected by utilizing a cable 157 that extends from the mode control assembly 151 to a lifting mechanism 134 that raises and lowers the suction nozzle 250 and the brush block 216 for use in respective dry and wet modes. The lifting mechanism 134 includes a wheel carriage assembly 136 (FIG. 7C) positioned in a complimentary recessed area formed in the bottom side of the frame 252 (FIG. 7C) and pivotally connected at the rearward end of the recessed area by trunnions 137 (FIG. 7A).

The mode control assembly 151 is comprised of left mode control bearing 152, mode control microswitch 153, mode control detent spring 154, mode control actuator 155, mode control cable retainer bracket 156, mode control cable 157, and right mode control bearing 158. A ball 157A at one end of cable 157B fits into a socket 155A on mode control actuator 155. The mode control retainer bracket 156 grips the sheaf 157C of cable 157. When mode control selector 150 is rotated, mode control actuator 155 is also rotated causing the cable 157B to extend and retract to cause the brush block 216 and suction nozzle 250 to be raised or lowered for the respective mode. Rotation of mode selector 150 also causes the microswitch 153 to be activated so that current is switched on and off to the drive motor 700 (FIG. 7A) powering the rotary agitators 226 (FIG. 7D) in brush block 216 (FIG. 7D). In an alternate embodiment of the invention, the mode control 150 can be replaced with a lever, a slide selector, or electrical switches on the pivoting handle which control the height of the suction nozzle 250 and the brush block and the operation of the agitator drive motor and other features. A microprocessor could be further utilized with the switches to control the height of the suction nozzle and the brush block and the operation of the agitator drive motor and other features.

Figure 5:
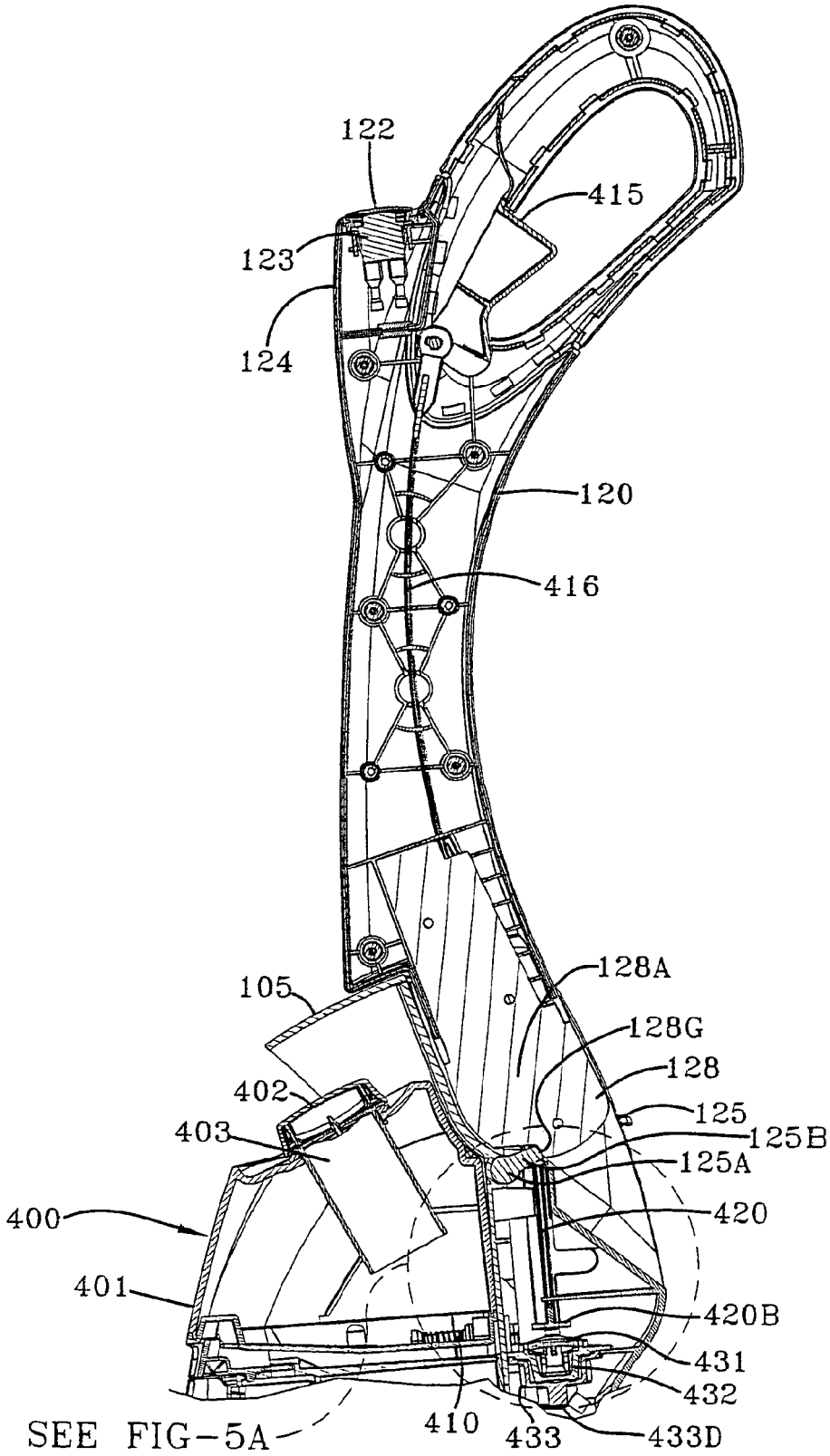
FIG. 5 is a cross-sectional view of a portion of the upper housing and the pivoting handle of a cleaning appliance, according to the preferred embodiment of the present invention.
Figure 5A:
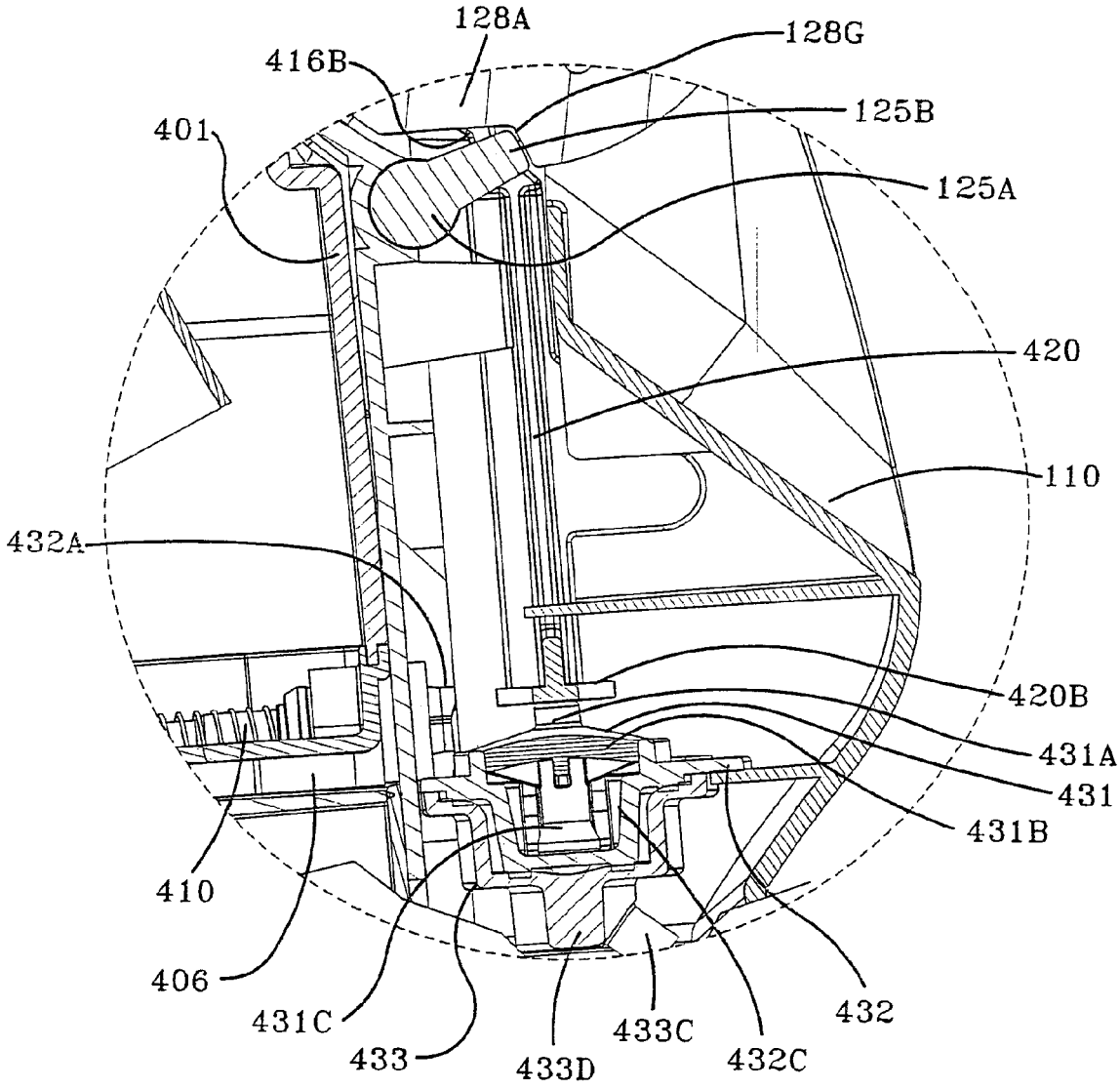
FIG. 5A is an enlarged view of a portion of cross-sectional view of a portion of the upper housing and the pivoting handle for a cleaning appliance, according to the preferred embodiment of the present invention.

Referring now to FIGS. 4F, 5 and 5A, shown are various views of pivoting handle 120 including a cross-sectional view in FIG. 5A of the pivoting handle 120 pivotally connected to a portion of the body shell 110. A main power switch assembly 123 is electrically connected to the suction motor assembly 300 (FIG. 4) and power supply (not shown) and thus, is used to turn on and off the suction motor assembly 300 (FIG. 4). The switch assembly 123 is mounted on a pedestal 124 that is located on the front of pivoting handle portion 120 forward of the looped handgrip portion 121. A cleaning solution dispensing trigger 405 is installed on pivoting handle 120 so that a user may depress trigger 405 when grasping the looped handgrip portion 121. Trigger 405 has a resilient portion 405*a* at one end and a pair of projections 405*b* (only one can be seen in FIG. 4F) acting as pivot points so that trigger 405 can pivot when depressed but is forced into the released position by resilient portion 405*a* when released. When trigger 405 is depressed, a projection 405C connected to an eyelet 416A on one end of control rod 416 forces control rod 416 downward to depress actuator rod 420 (FIGS. 5 and 5A). In order to depress actuator rod 420, control rod 416 must pass through a channel 128C in the left portion 128R of upper handle core 128. The lower end 416B of control rod 416 engages an abutment 420A on the end of actuator rod 420.

Pivoting handle 120 is comprised of a right shell 120R and left shell 120L which is assembled with screws or the equivalent. Each of the right shell 120R and left shell 120L has a sleeve 120A and 120B extending therefrom, respectively. Each of the sleeves 120A, 120B has a channel 120C, 120D (not shown) formed therein for receiving the respective upper portions of the handle cores 128E, 128D. Each of the upper portions of the handle cores 128E, 128D has a locking tab 128F (not shown for the upper portion of handle core 128E) for locking the upper portions of the handle cores 128E, 128D into the channels of sleeves 120A, 120B, respectively. Handle core sections 128E and 128D are assembled together with a plate portion 128A sandwiched therebetween to form handle core 128.

Figure 6A:
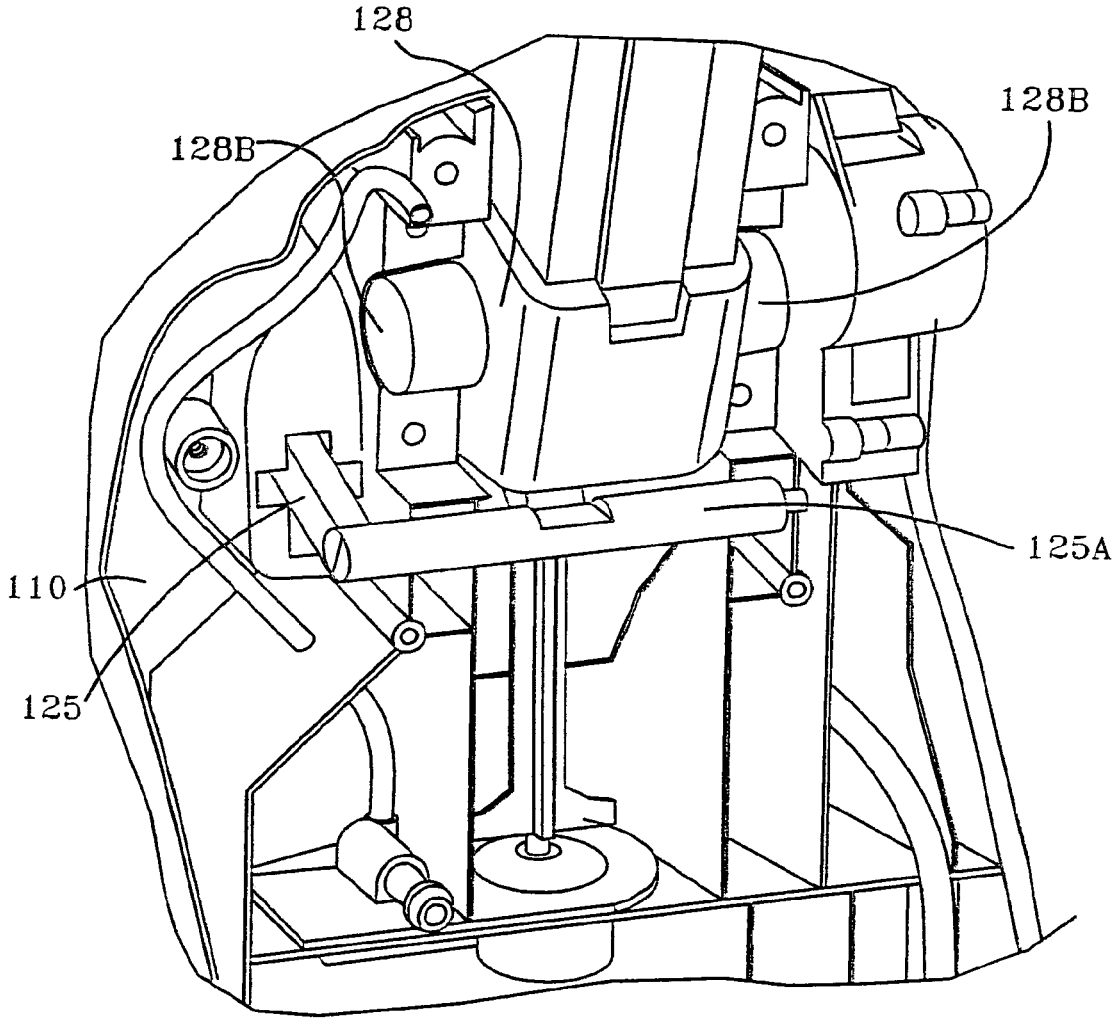
FIG. 6A is a front perspective cutaway view of a portion of the upper housing of a cleaning appliance, according to the preferred embodiment of the present invention.

Referring now to FIG. 6 and FIG. 6A, pivoting handle 120 is capable of being moved in the direction of arrow A from the in-use position V shown in the phantom lines to the storage position V' by depressing a handle release lever 125 located on the rear of body shell 110. When depressed, the handle release lever 125 rotates a cylindrical portion 125A which is connected to a keyed portion 125B (FIG. 5A). When cylindrical portion 125A is rotated, the keyed portion 125B is rotated away from a notched portion 128G formed in the plate portion 128A of handle core 128 (FIG. 5A). Thus, when the handle release lever 125 is depressed, the keyed portion 125B no longer restricts plate portion 128A and pivoting handle 120 is free to pivot relative to body portion 110. When the handle release lever 125 is released, the keyed portion 125B is forced back into the notched portion 128G in plate portion 128A by a spring (not shown) and pivoting handle 120 when rotated back to position V is again locked into place. Also shown in FIG. 6 is an upper cord holder 106 and a lower cord holder 107 for electrical cord storage. Upper cord holder 106 is free to rotate for releasing the cord while lower cord holder 107 is fixed and serves only to allow the electrical cord to be wrapped around.

Figure 16:
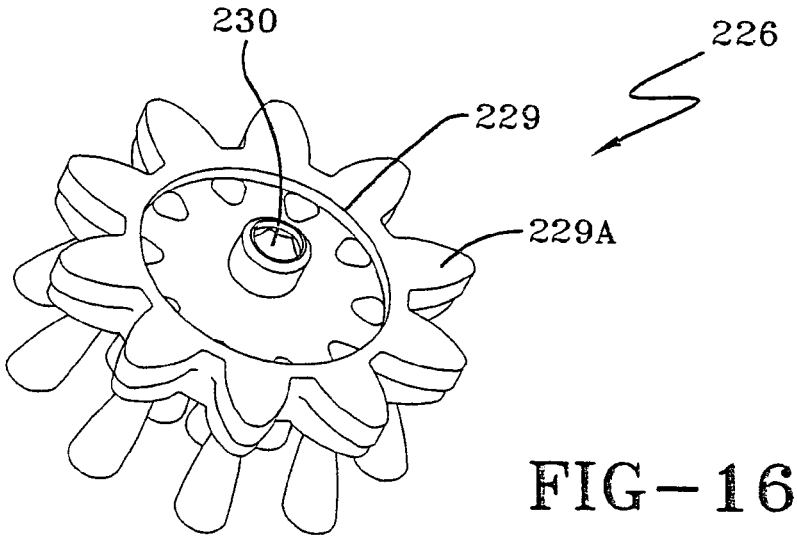
FIG. 16 shows a perspective view of a rotary agitator, according to the preferred embodiment of the present invention.
Figure 16A:
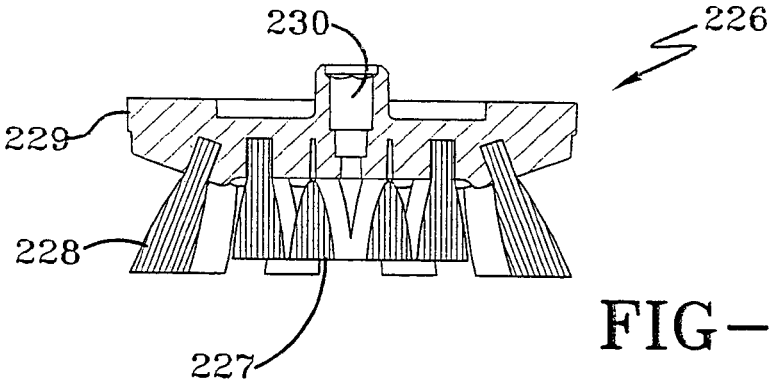
FIG. 16A shows a side cross-sectional view the rotary agitator of FIG. 16, according to the preferred embodiment of the present invention.
Figure 16B:
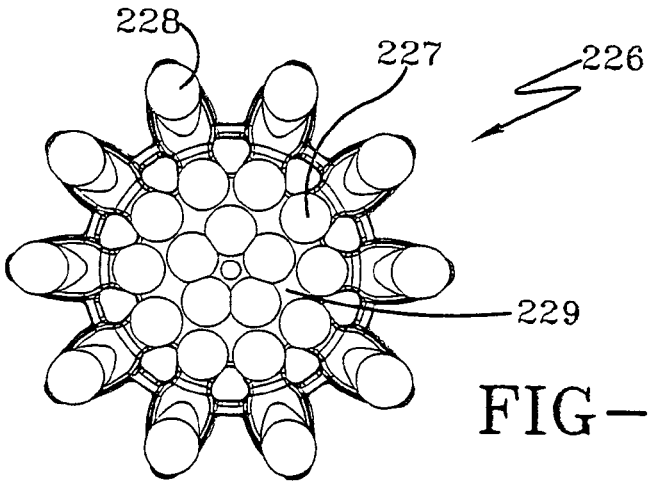
FIG. 16B shows a bottom view of the rotary agitator of FIG. 16, according to the preferred embodiment of the present invention.

Referring now to FIG. 7, shown is an exploded view of the base assembly 200 which is comprised of a unitary molded frame 252 and two laterally displaced rear wheels 260. Each wheel is rotatably connected to a cantilevered axle 256 that is journaled into the frame 252 and retained therein by an e-ring 258. The base assembly 200 includes a suction nozzle 250 that is removably attached to the front of frame 252. A pair of slide latches 251 on the opposite sides of suction nozzle 250 are used for removably securing suction nozzle 250 to frame 252. Slide latches 251 each have a lateral tongue member 251A that is slidingly inserted into complementary grooves 252A located on the front of frame 252. Before insertion of the lateral tongue members 251A into grooves 252A, the lateral tongue members 251A are into a channel 250A attached to the rear side of the suction nozzle 250 to secure suction nozzle 250 to frame member 252. The suction nozzle 250 includes an elastomeric squeegee 246 ringing the periphery of the suction nozzle inlet 250B of suction nozzle 250. The suction nozzle 250 is composed of a rigid material such as plastic and may be clear, translucent or opaque. The suction nozzle has a connector 250B extending rearwardly which mates to lower duct portion 249 before being connected to the lower recovery duct 537 via connector 535. A hood or cover 251 snap fits onto the frame 252. A brush block assembly 216 (best seen in FIG. 7D) is removably secured to the frame 252 for agitating the surface to be cleaned. The brush block assembly 216 is comprised of a plurality of vertical axis rotary brushes 226. A nearly identical brush block assembly was disclosed in U.S. Pat. No. 6,640,386 owned by a common assignee and incorporated by reference herein. However, in the present invention, there is provided two brush block assemblies 216 that are interchangeable depending on the bare floor surface to be cleaned. In the two brush block assemblies provided for the present invention, the arrangement and orientation of the bristle bundles on each of the vertical axis rotary brushes 226 have been modified as compared to the bristle bundles in the '386 patent. In the preferred embodiment of the invention, brush block assembly 216 is equipped with a plurality of rotary agitators 226 having two sets of bristle bundles as shown in FIGS. 16, 16A and 16B for cleaning conventional bare floor surfaces such as linoleum and wood. Each of the plurality of rotary agitators have a plurality of bristle bundles 227 in the center which are a greater distance from the floor surface than the bristle bundles 228 extending radially outward from the outer periphery of the hub 229 of the vertical axis rotary brush 226. This arrangement of the bristle bundles 227, 228 allows the maximum amount of bristle coverage in terms of surface area on the floor surface since the bristle bundles 228 on the outer periphery of the hub 229 will tend to deflect even further radially outward when pressure is applied to the hub 229. However, this arrangement is unsuitable for cleaning tiles floors where the spaces between the tile is filled with grout which typically is a lower elevation than the tile. The bristles bundles 227 in the center contacting the floor surface would prevent the radially extending bristles bundles 228 from penetrating into the lower elevation grout between the tiles. The alternate embodiment brush block 216 has a plurality of rotary agitators (shown in FIGS. 17, 17A, and 17B) which were designed specifically to reach down into the space between the tiles to clean the grout. This is accomplished by eliminating the bristle bundles 227 in the center so that only the bristle bundles 228 extending radially from the hub 229.

Figure 17:
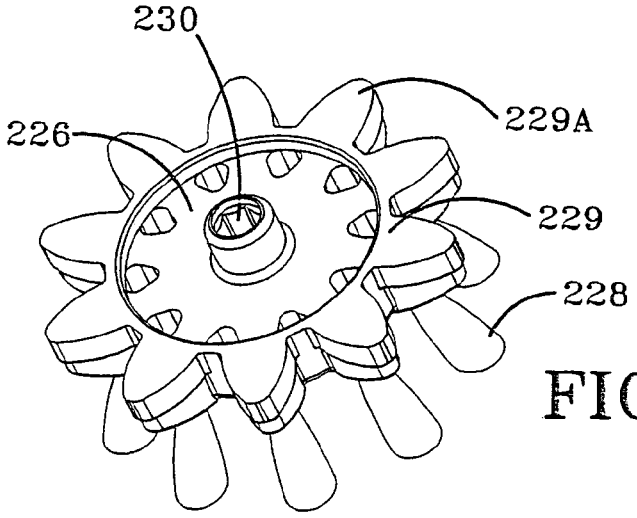
FIG. 17 shows a perspective view of a rotary agitator, according to the alternate embodiment of the present invention.
Figure 17A:
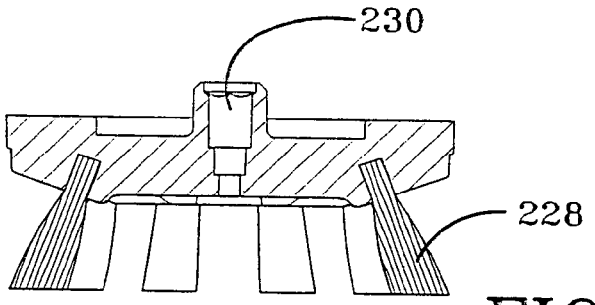
FIG. 17A shows a side cross-sectional view the rotary agitator of FIG. 17, according to the alternate embodiment of the present invention.
Figure 17B:
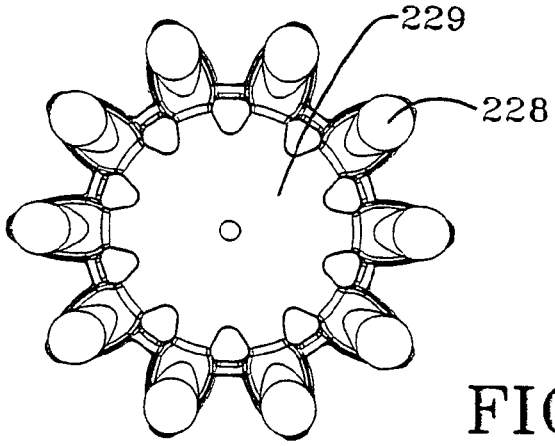
FIG. 17B shows a bottom view of the rotary agitator of FIG. 17, according to the alternate embodiment of the present invention.

The base assembly 200 further includes a cleaning solution distribution bar 256 comprised of an upper plate 256A and a lower plate 256B. A cleaning solution distribution channel 256C is formed in lower plate 256B for distributing cleaning solution to a series of drip apertures 262 (best seen in FIG. 7C) formed in lower plate 256B. The drip apertures 262 allow cleaning solution to drip into a plurality of complementary apertures 216A (FIG. 7A) in brush block assembly 216 so that cleaning solution is applied to the bare surface when trigger 405 (FIG. 2) is depressed. The cleaning solution distribution bar 256 (FIG. 7C) is inserted to a cavity on the underside of frame 252 (FIG. 7C) wherein a pair of apertures 256D (FIG. 7C) are inserted over a guide post 253 (FIG. 7C) extending downwardly from frame 252. A pair of pivoting latches 280 (FIG. 7A) each having a laterally extending tongue 280A (FIG. 7A) secure brush block assembly 216 to the underside of solution distribution bar 256 (FIG. 7E). A plurality of hooks 216B (FIG. 7A) extending from the upper surface of brush block 216 (FIG. 7A) are grasped by tongue members 280A (FIG. 7A). The brush block 216 with a plurality of rotary agitators 226 can best be seen in the cutaway view seen in FIG. 7D. Each of the plurality of rotary agitators 226 is comprised of a plurality of bristle bundles extending downwardly from a gear tooth hub 229. In the preferred embodiment of the brush block 216 shown in FIGS. 7D and 7E, a plurality of bristle bundles 227 extends downwardly from hub 229 and a plurality of bristle bundles 228 extend downwardly and radially outwardly from hub 229. A square or hexagonal drive shaft 225 drives one of the rotary agitators 226 by insertion into a complementary aperture 230 (FIGS. 16, 16A, 17 and 17A) in the center of hub 229 (FIGS. 16, 16A, 17 and 17A). Thus, each of the rotary agitators 226 (FIG. 7E) is rotated by the adjacent rotary agitator 226 (FIG. 7E) by the intermeshing gear teeth 229A (FIGS. 16 and 17).

A wheel carriage 137 is pivotally connected to the underside of the frame 252 to aid in movably supporting the frame 252 and base assembly 200 over the floor surface. Wheel carriage 137 is comprised of a pair of trunnions 137 pivotally connecting the wheel carriage 136 to the underside of frame 252 (FIG. 7C). Two pairs of wheels 138 (also shown in FIG. 7C) each mounted on an axle 139 rotatably support wheel carriage 136 over the floor surface. A crank arm 163 having a cam portion 163A (FIG. 7C) contacts the upper surface of wheel carriage 136 (FIG. 7C) urges the frame 252 away from wheel carriage 136 to raise and lower the height of the frame 252 in relation to the floor surface. In this manner, when suction nozzle 250 is installed, suction nozzle 250 is also raised and lowered in relation to the floor surface. The position of the crank arm 163 and cam portion 163A is controlled by cable 157 and mode selector 150 (FIG. 2). A second crank arm 161 is pivotally linked by an arm 162 to crank arm 163 to raise and lower the brush block assembly 216 in relation to the floor surface and to frame 252. A cam portion 161A (FIG. 7A) on crank arm 161 (FIG. 7A) contacts the upper surface of brush block 216 to urge brush block 216 up and down in relation to frame 252.

Figure 7B:
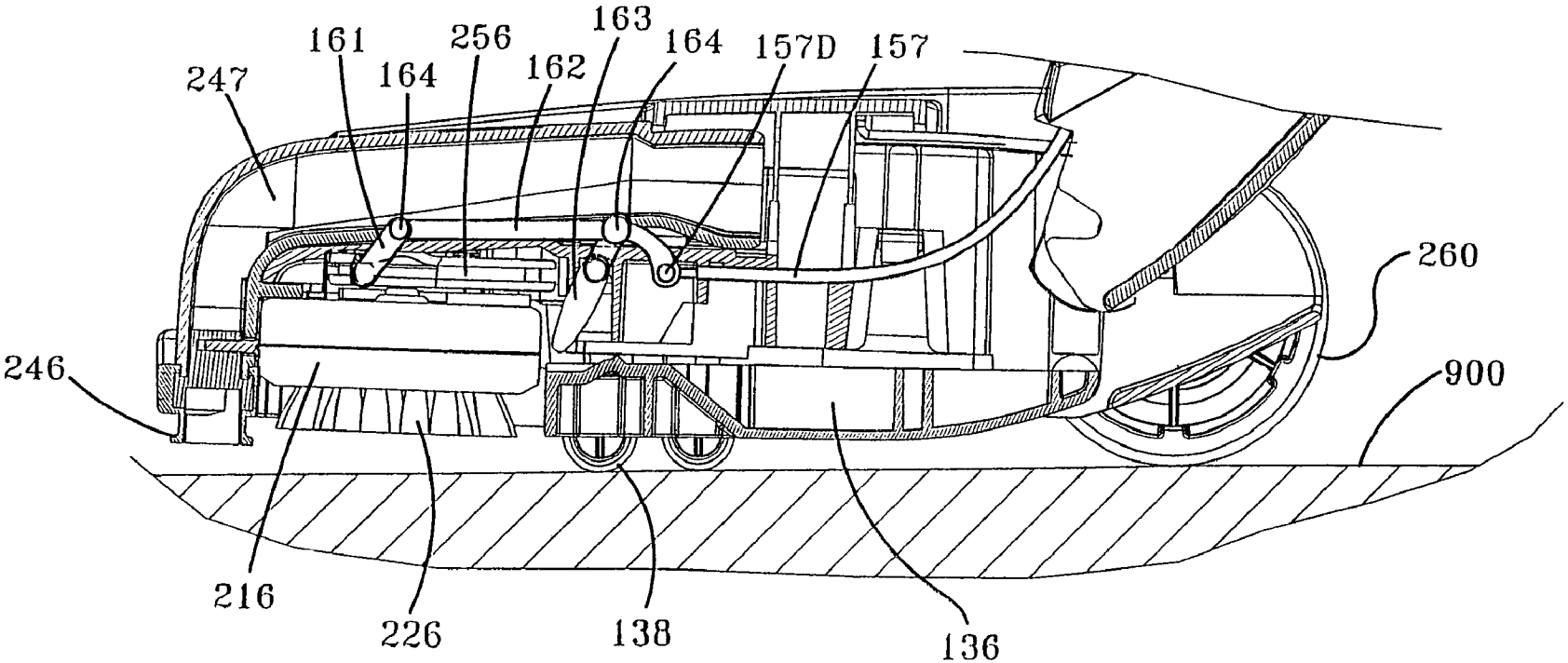
FIG. 7B is a cross-section of the base assembly of a cleaning appliance, according to the preferred embodiment of the present invention.
Figure 7C:
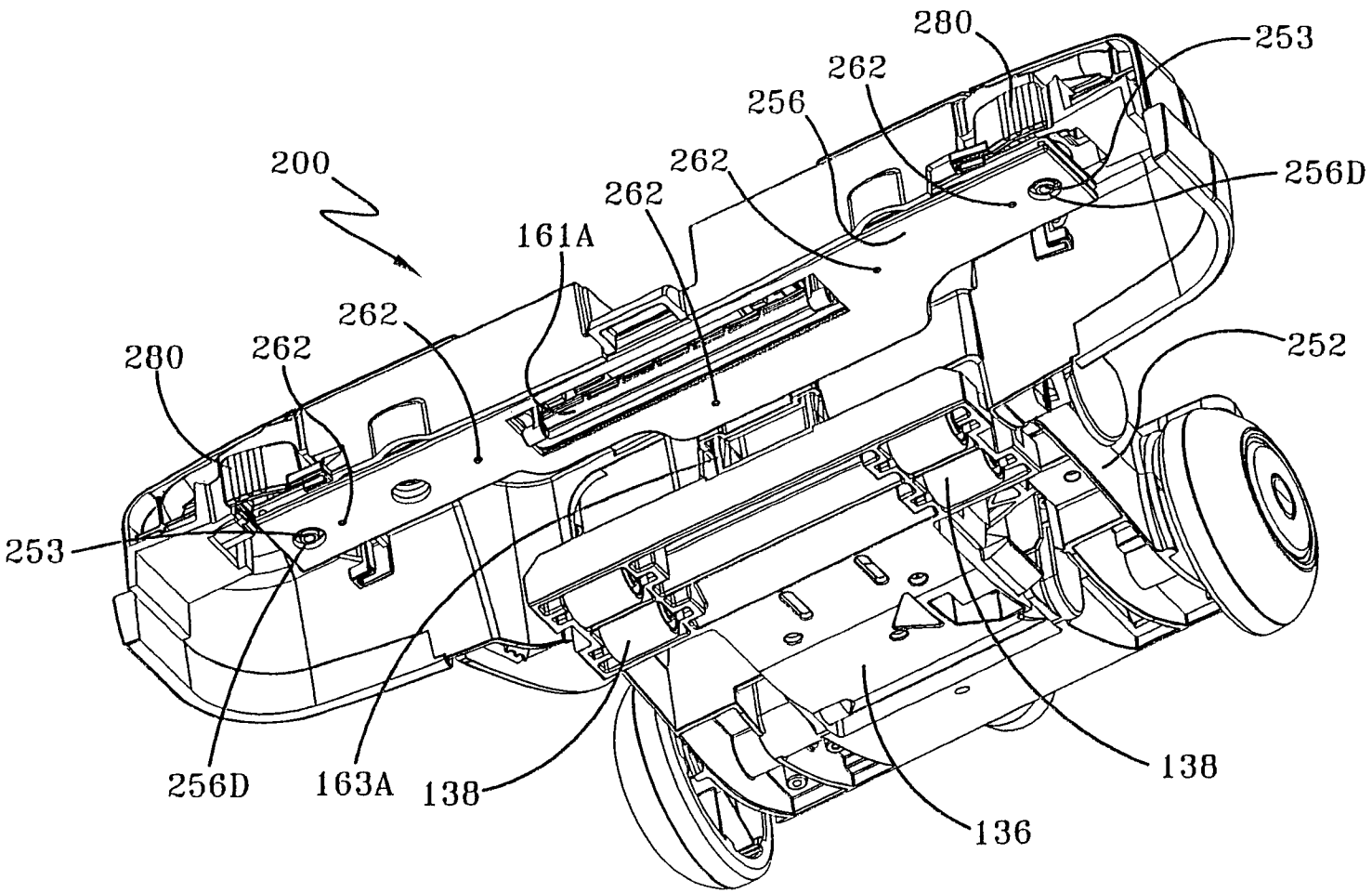
FIG. 7C is a bottom perspective view of a portion of the base assembly of a cleaning appliance, according to the preferred embodiment of the present invention.
Figure 7D:
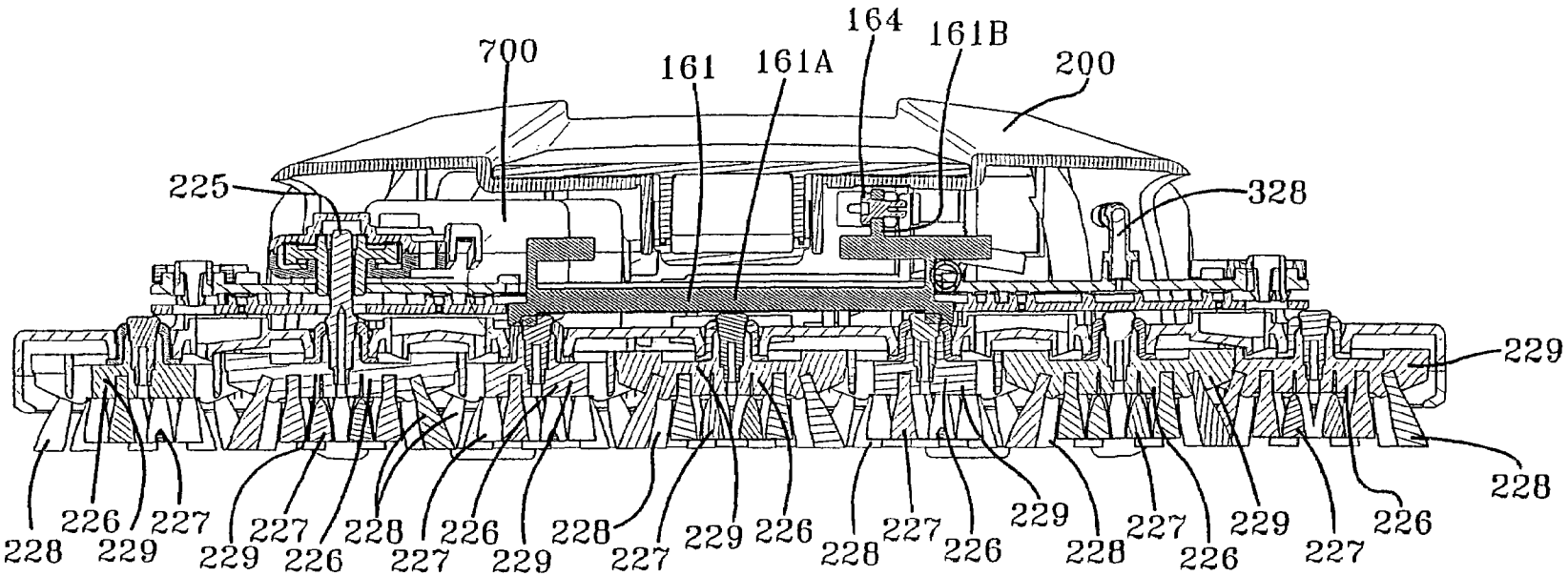
FIG. 7D is a front cross-sectional view of the base assembly of a cleaning appliance, according to the preferred embodiment of the present invention.
Figure 7E:
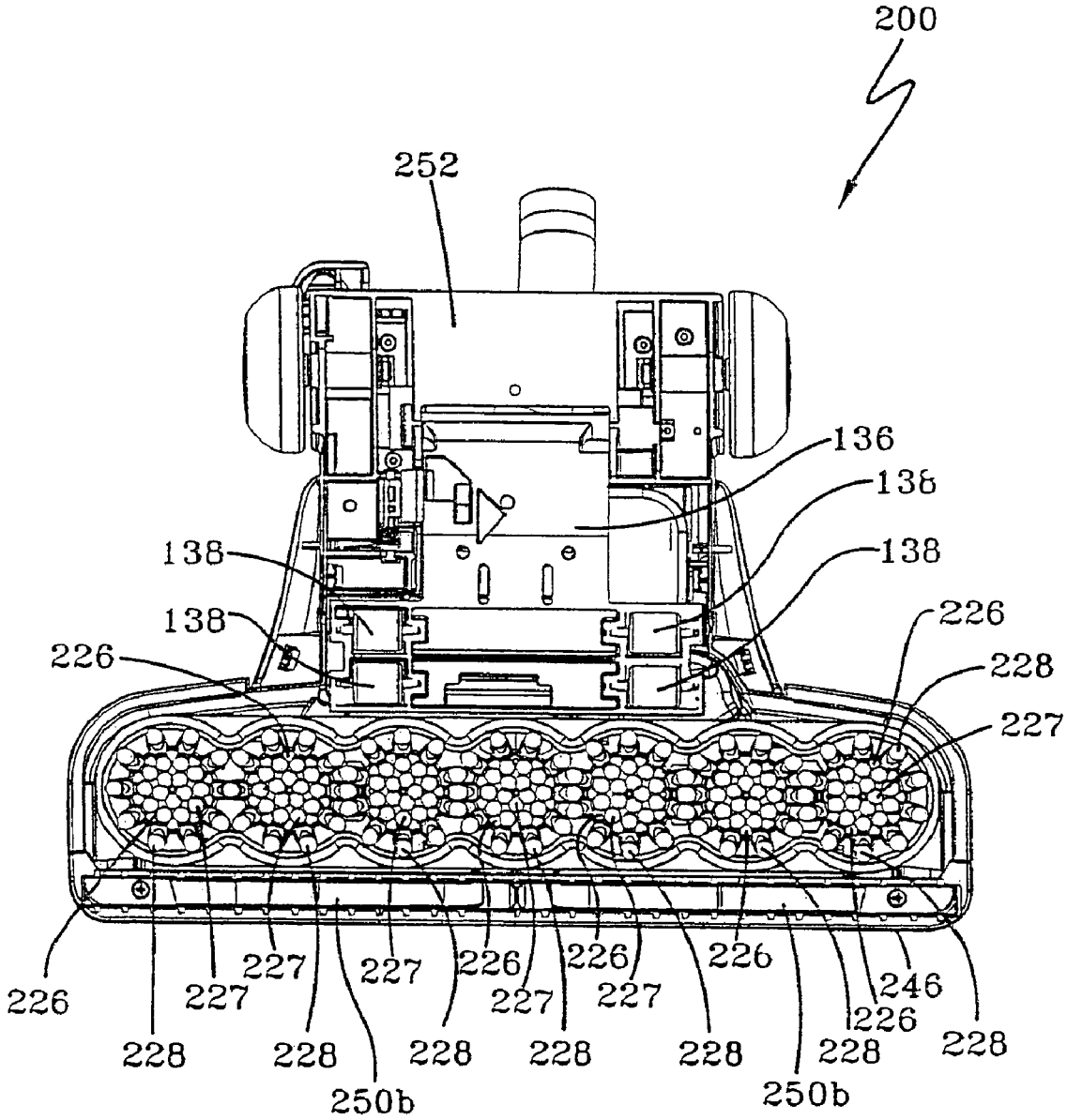
FIG. 7E is a bottom view of the base assembly of a cleaning appliance, according to the preferred embodiment of the present invention.

Referring now to FIG. 7B, the end of cable 157 has a ball 157D that is connected to arm 162 which translates laterally as mode selector 150 is rotated to the positions shown in FIGS. 9, 10 and 11. Crank arm 163 is pivotally connected to arm 162 with a pin 164. Crank arm 163 is pivotally mounted on frame 252 and has a cam portion contacting wheel carriage 136. Thus, the rotation of mode selector 150 causes crank arm 163 to rotate and causes cam portion 163A to urge against wheel carriage 136 to raise and lower frame 252 and suction nozzle 250 in relation to the floor surface. Similarly, crank arm 161 is pivotally mounted on frame 252 and connected by a pin 164 to arm 162. As mode selector 150 is rotated, arm 162 causes crank arm 161 to pivot which causes the cam portion 161A to urge brush block 216 away from frame 252 to raise and lower brush block 216 in relation to frame 252 and the floor surface.

Each of the various floor cleaning modes and the positions of the brush block 216, suction nozzle 250 including squeegee 246 can be seen in FIGS. 9, 10, and 11. In FIG. 9, mode selector 150 is rotated to the "DRY VAC" position so that the suction nozzle 250 is urged away from wheel carriage 136 and raised to the maximum height above the floor surface 900. The brush 216 is not urged downward in relation to frame 252 so that the brush block 216 is at the maximum height above the floor surface 900. The height of the suction nozzle 250 and brush block 216 are now optimum for vacuuming particles from a dry floor surface 900. In FIG. 11, mode selector 150 is rotated to the "WASH" position so that the suction nozzle 250 is not urged away from wheel carriage 136 and lowered to the a position slightly above floor surface 900. In addition, crank arm 164 and cam portion 164A now urges brush block 216 away from frame 252 so that brush block 216 is lowered to a position such that the plurality of rotary agitators 226 are contacting the floor surface 900. At the same time, the mode selector 150 closes microswitch 153 in mode assembly 151 (FIGS. 4J and 4K) so that independent drive motor 700 (FIG. 7) is energized to rotate the plurality of rotary agitators 226 is agitate the floor surface. Cleaning solution from the solution tank assembly 400 (FIGS. 3 and 4) can also be applied by squeezing the trigger 405 (FIG. 2) on pivoting handle 120 (FIG. 2). Thus, a complete cleaning operation can be performed on the floor surface 900 including the removal of dirt and used cleaning solution by the suction nozzle 250 and squeegee 246. In FIG. 11, mode selector 150 is rotated to the "WET PICKUP" position so that so that the suction nozzle 250 is not urged away from wheel carriage 136 and lowered to the a position slightly above floor surface 900. However, unlike the configuration shown in FIG. 10, crank arm 164 and cam portion 164A no longer urges brush block 216 away from frame 252 so that brush block 216 is raised back to a maximum position above the floor surface 900 and the plurality of rotary agitators 226 are no longer contacting the floor surface 900. Mode selector 150 also opens microswitch 153 so that independent drive motor 700 is no longer energized and the plurality of rotary agitators 226 no longer rotate. This allows liquid such as used cleaning solution to be removed from the bare floor surface 900 by a vacuuming and squeegee operation without having to agitate the floor surface 900.

Figure 7F:
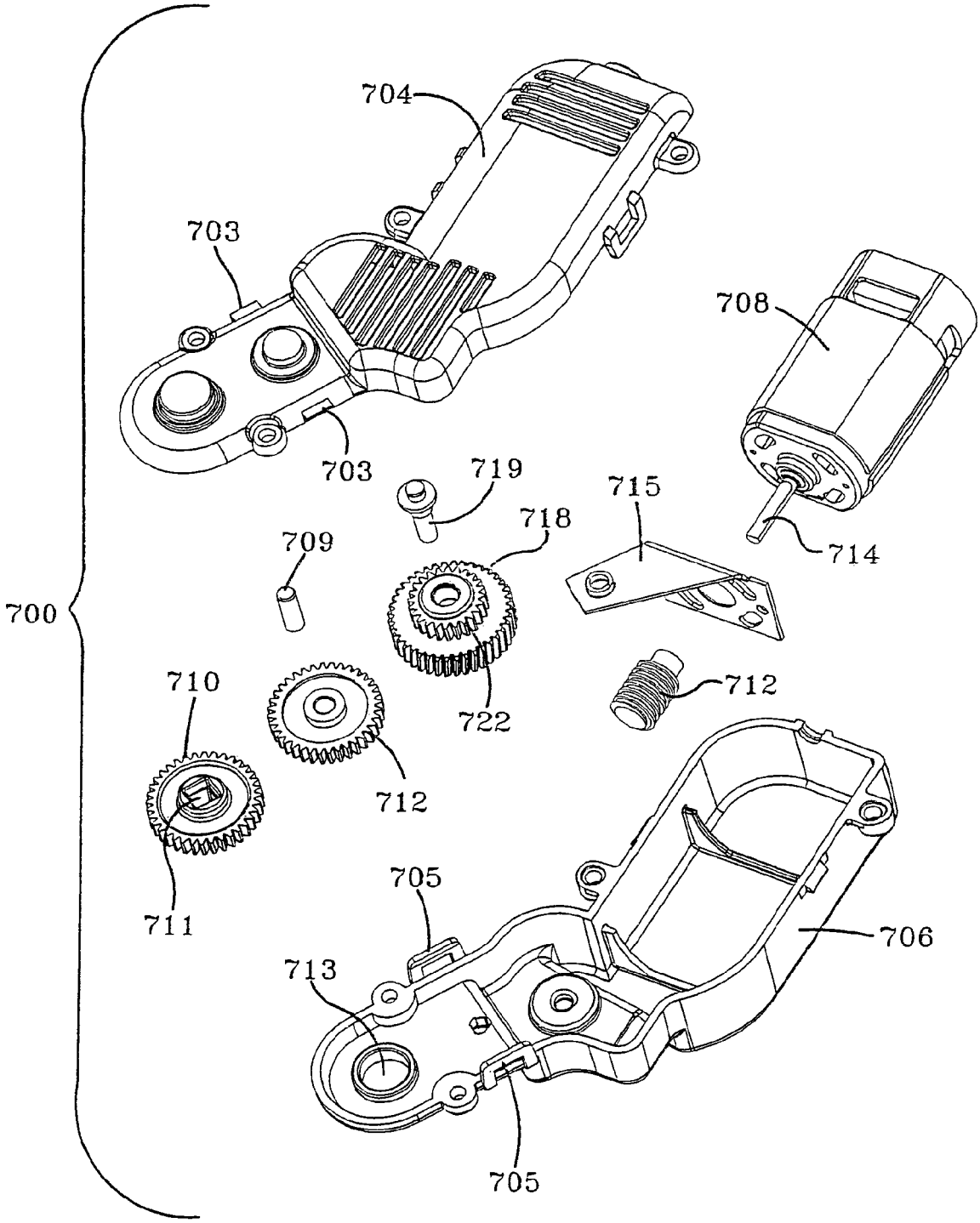
FIG. 7F is an exploded perspective view the independent motor assembly for powering the rotary agitators of a cleaning appliance, according to the preferred embodiment of the present invention.

Referring now to FIG. 7F, independent drive motor 700 is mounted on the underside of the frame 252 directly above the wheel carriage assembly 136. The brush motor assembly 700 comprises a generally L-shaped motor housing 706 that includes an upper cover 704 that is snap connected to the lower cover 706. In particular, locking tabs 703 integrally formed on the upper cover 704 engage catches 705 formed on the lower cover 706. Screws (not shown) secure the brush motor assembly 700 to the frame 252. Seated within the housing 702 is a grounded, internally rectified DC motor 708 and a gear train for rotating the plurality of rotary agitators 226 (FIG. 7D). A worm gear 712 is press fitted onto the shaft 714 of the motor 708. A worm gear 718 is mounted on an axial shaft 719 and engages the worm 712. A bracket 715 having a reinforced aperture also is mounted over axial shaft 719 and is further mounted to the front of motor 708 strengthening the transmission of rotary power from worm gear 712 to worm gear 718. A spur gear 722 is also mounted on the axial shaft 719 above the worm gear 718. An intermediate radial gear 712 mounted on an axial shaft 709 which engages the spur gear 722 to transmit the rotary power of the motor 708 to a radial gear 710. Bores formed in upper motor cover 704 and lower motor cover 706 receive the ends of axial shafts 719 and 709 for holding axial shafts 719 and 709 in place. An aperture 713 in the lower motor cover 713 allows a drive shaft 225 (FIG. 7D) to be inserted into a keyed aperture 711 in radial gear 710.

Returning to FIG. 7 and referring to FIG. 8, the base assembly 200 has a foot pedal 102 (best seen in FIGS. 3, 6 and 7) that is pressed to release a locking mechanism 104 (FIG. 7) located in the base assembly 200 to allow upright housing portion 200 to pivot in the direction of arrow R from a storage or locked position P (shown in phantom lines) to a pivoted in use or pivoted position P'. When the upright housing 100 is moved back to the upright position P, a locking mechanism 104 in the base assembly 200 prevents the upright housing 100 from moving to the in use or pivoted position P' until the foot pedal 102 (best seen in FIG. 6) is depressed. Also, the nozzle assembly 250 is raised off the floor from position Q to the position Q' when the upright housing 100 is pivoted to the upright position P to prevent deformation of the squeegee 246 during storage. A torsion spring 103, secured between the inner end of the foot pedal 102 and frame 252, urges the handle release pedal 102 back up to its original position when released. Similarly, a torsion spring 105 urges locking mechanism 104 back into the normal position when foot pedal 102 is released. The operation and construction of the suction nozzle lifting mechanism (not shown) described herein for storage is identical to the suction nozzle lifting mechanism used for storage disclosed in U.S. Pat. No. 6,640,386 owned by a common assignee and incorporated by reference fully herein.

Figure 12B:
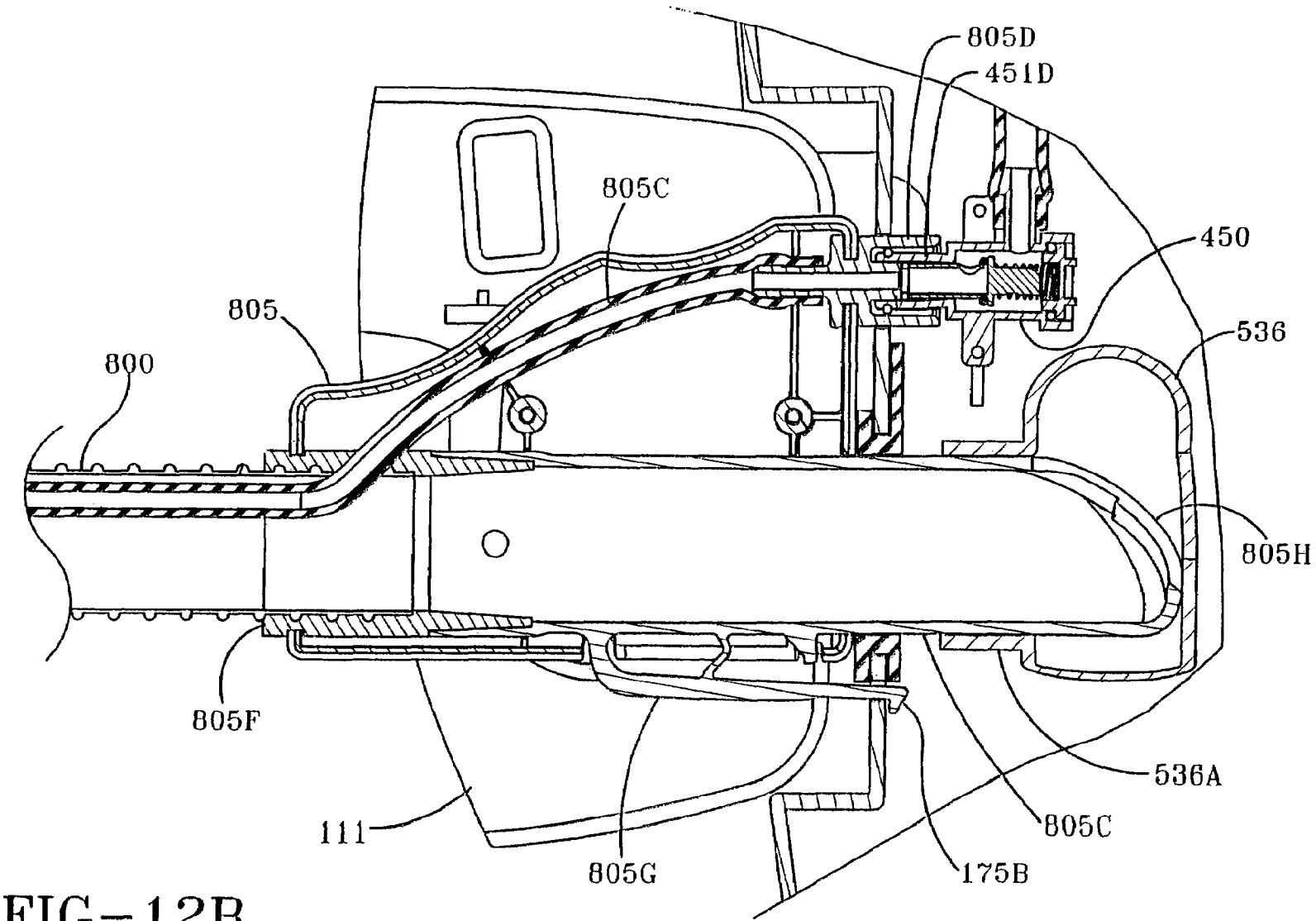
FIG. 12B is an enlarged cutaway front view of an accessory hose connector inserted into a connection port located on the upper housing of a floor care appliance, according to the preferred embodiment of the present invention.
Figure 14A:
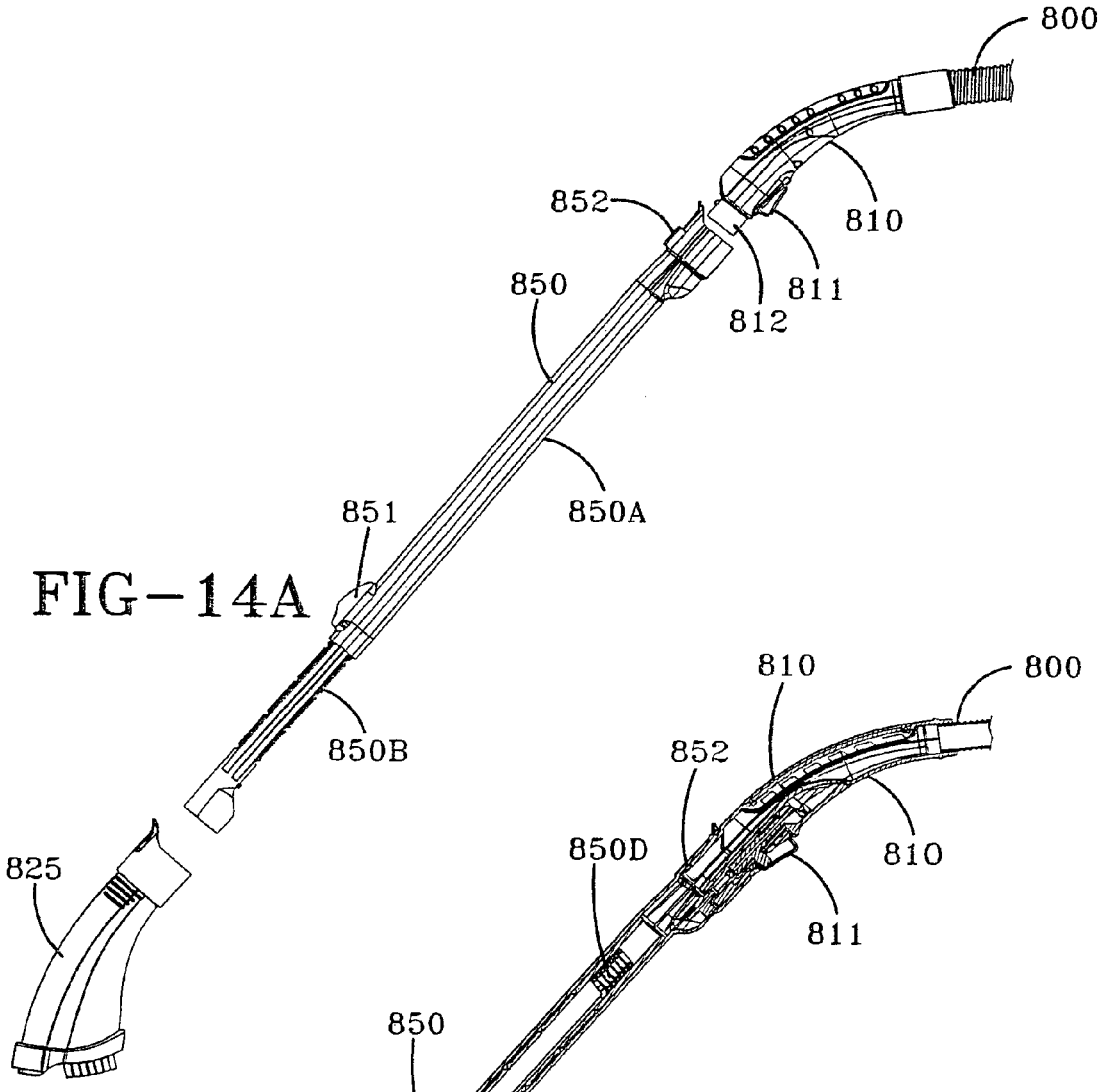
FIG. 14A shows an exploded view of a telescoping wand and an accessory suction nozzle of a floor care appliance connected to a cutaway portion of an accessory hose, according to the preferred embodiment of the present invention.
Figure 14B:
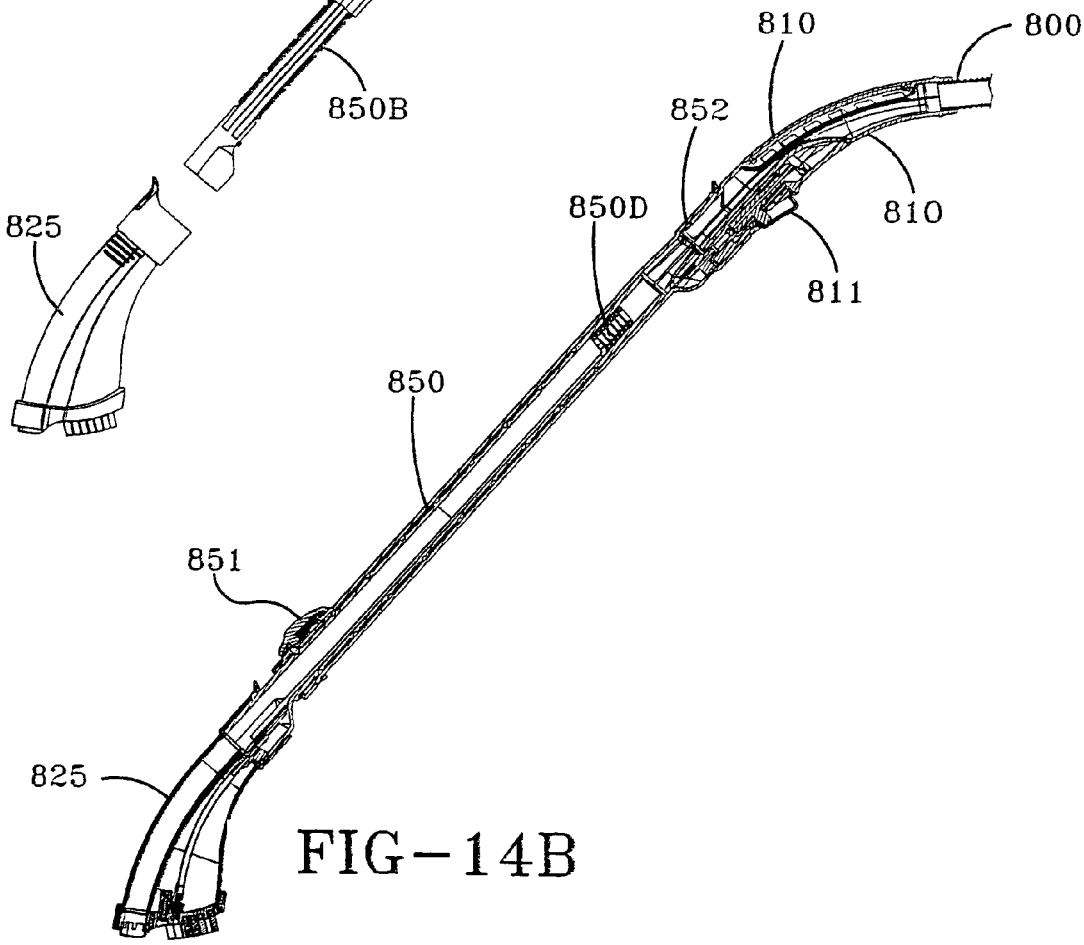
FIG. 14B shows a cross-sectional view of a telescoping wand and an accessory suction nozzle of a floor care appliance connected to a cutaway portion of an accessory hose, according to the preferred embodiment of the present invention.

Referring now to FIGS. 12, 12A and 12B, shown is an upright floor cleaner 10 similar to the one shown in FIG. 1 but having an accessory hose 800 and telescoping wand 850 connected into a port 175 in the upper housing 100 for cleaning hard to reach bare floor areas and other bare surfaces. Port 175 delivers liquid recovery suction and pressurized cleaning fluid to accessory hose 800, telescoping wand 850 and an attached accessory cleaning tool such as an accessory suction nozzle 815 (FIGS. 13 and 13A) or a grout tool 825 (FIGS. 14 and 14A). The end of the accessory hose 800 has a connector 805 for connection to the port 175. A port door 111 is opened to reveal a cleaning solution connector 451D and a suction connector 536A for connection to the hose connector 805 on one end of accessory hose 800. Solution connector 451D extends from the quick disconnect coupling 450 previously described in FIG. 41. An air turbine inlet 425A is also exposed to the atmosphere when port door 111B is opened causing air turbine pump 425 (FIG. 4) to start running and pressurizing cleaning solution at solution connector 451D. When port door 111 is closed, projections 111B and 111A fit into air turbine inlet 425A and suction connector 536A to seal when not in use. A hook 111D on the inner surface of port door 111 fits into a notch 175A in port 175 to hold port door 111 in the closed position. A solution connector 805D on hose connector 805 fits over the solution connector 451D. The solution connector 805D is fluidly connect to a solution conduit 805E that extends through hose connector 805 to accessory hose 800 and then transitions into the interior of accessory hose 800. A suction connector 805C having an angled portion 805H is inserted into suction connector 536A and suction that was previously delivered to suction nozzle 250 through recovery duct 530 is now diverted to accessory hose 800 through aperture 805G. A resilient hook 805G on the lower side of hose connector 805 is inserted into a notch 175B beneath suction connector 536A to secure hose connector 805 to port 175 while in use.

Referring now to FIGS. 13A, 13B, 14A, and 14B, the opposite end of accessory hose 800 is permanently connected to a handgrip 810 which has a nipple 812 extending from the free end thereof for the connection of a telescoping wand 850. Telescoping wand 850 is comprised of two hollow tubular sections 850A and 850B. An accessory tool such as the accessory suction nozzle 815 or the grout tool 825 may then be removably attached to the distal end of the telescoping wand 850 for cleaning the hard to reach areas and the other bare floor surfaces. The telescoping wand 850 has a connector 852 for connection to the nipple 812 on handgrip 810 and a connector at the opposite end for connection to the accessory suction nozzle 815 or the grout tool 825. A latch 851 on telescoping wand 850 allows the length of telescoping wand 850 to be varied according to user preference by the user simply pressing latch 851 and extending or retracting the lower wand section 850B inside the upper wand section 850A. A trigger 811 on handgrip 810 allows pressurized cleaning solution to flow through solution conduit 850D inside telescoping wand 850 to accessory suction nozzle 815 or grout tool 825. The solution conduit 850D is fluidly connected to a solution conduit fluidly connecting solution conduit 805E inside accessory hose 800 to the cleaning solution valve body 810F (FIG. 15) located inside handgrip 810. The cleaning solution valve body 810F (FIG. 15) is also fluidly connected to a solution connector 850E (FIG. 15) located at one end of telescoping wand 850 for delivering cleaning solution to solution conduit 850D. Cleaning solution is then delivered to the respective spray nozzles in accessory suction nozzle 815 and grout tool 825. A portion of the solution conduit 850D extending through the interior of telescoping wand 850 is coiled in a helix to allow the solution conduit 850D to extend and retract as telescoping wand 850 extends and retracts.

Figure 15:
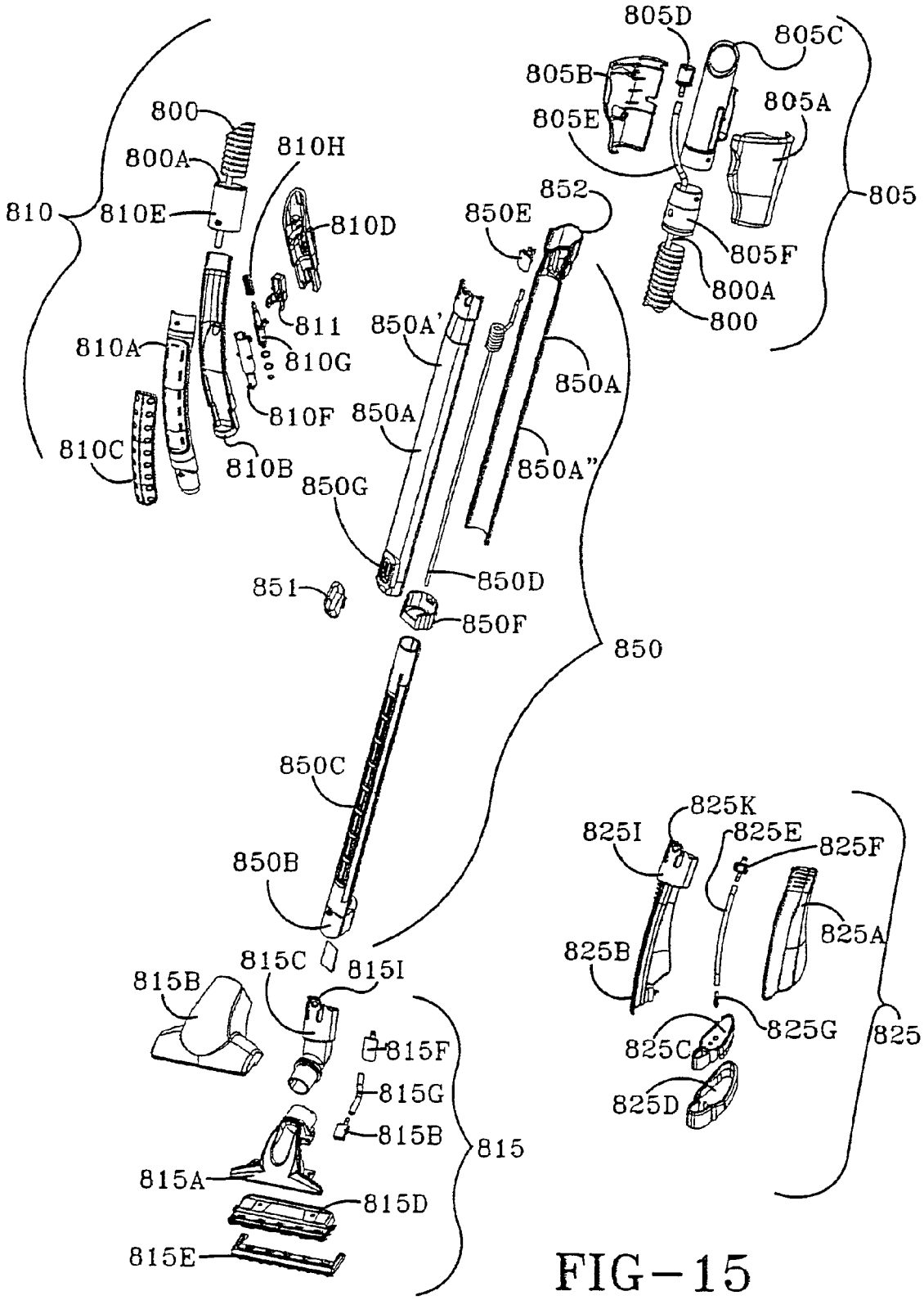
FIG. 15 shows an exploded perspective view of a portion of the accessory hose connector, telescoping wand, handgrip, accessory suction nozzle, and grout tool of a floor care appliance, according to the preferred embodiment of the present invention.
Figure 15A:
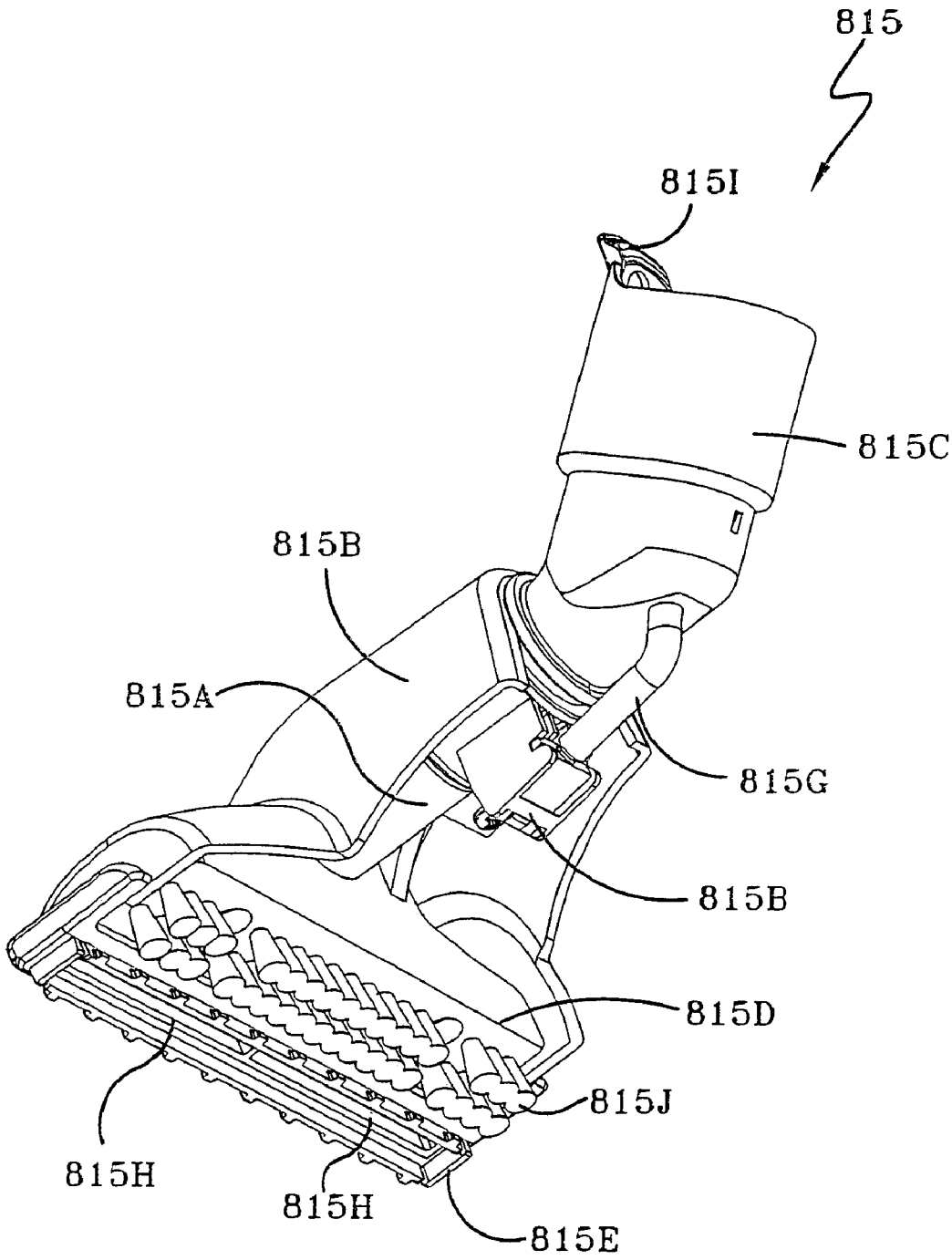
FIG. 15A shows a bottom perspective view of an accessory suction nozzle of a floor care appliance, according to the preferred embodiment of the present invention.
Figure 15B:
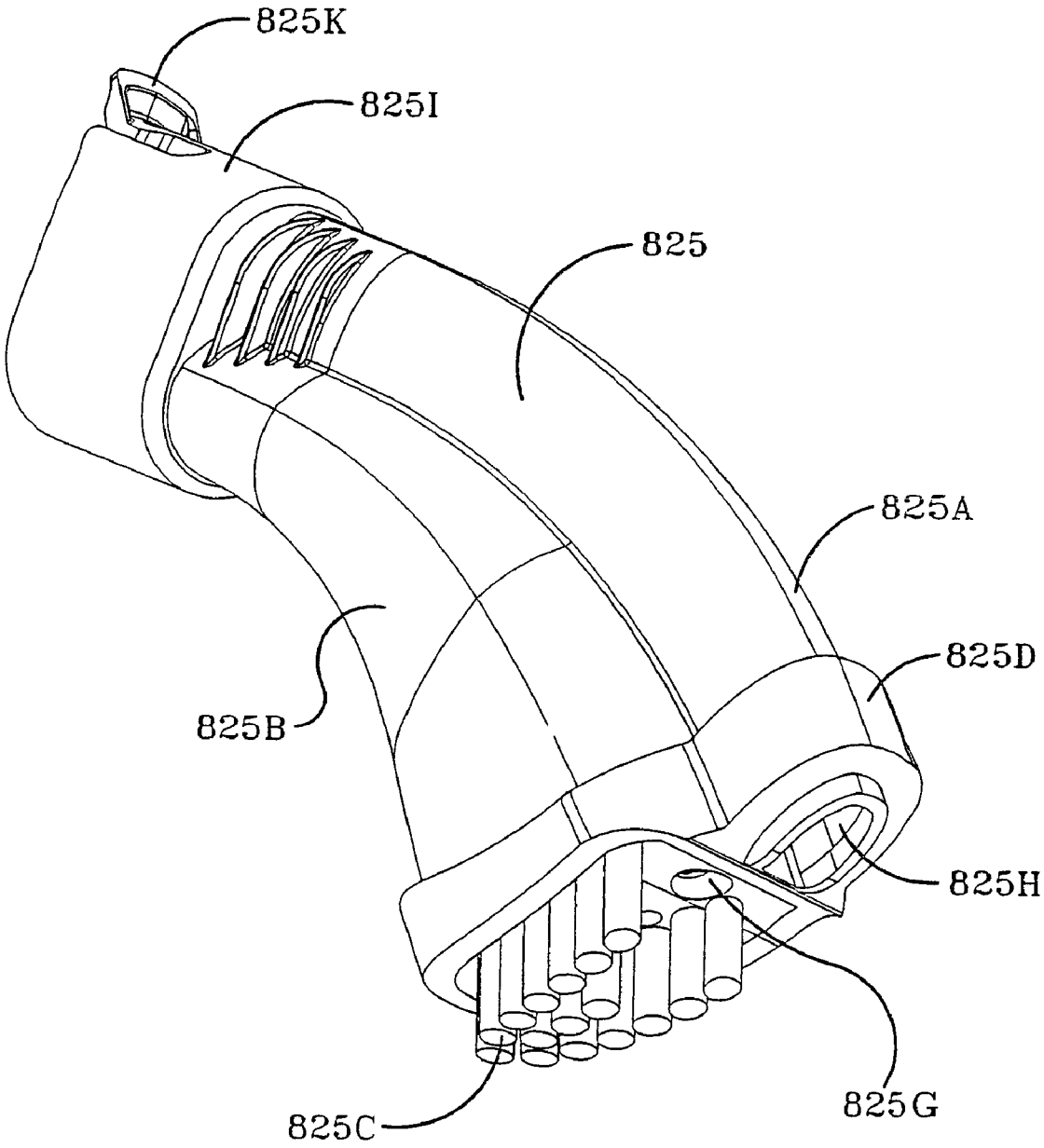
FIG. 15B shows a front perspective view of a grout tool, according to the preferred embodiment of the present invention.

Referring now to FIG. 15, shown are exploded views of handgrip 810, connector 805, telescoping wand 850, accessory suction nozzle 815, and grout tool 825. Connector 805 includes a bayonet connector 805C that is fitted between left and right clamshell portions (805A, 805B), a solution conduit connector 805D connected to a solution conduit 805E, and an accessory hose adapter 805F. The handgrip 810 includes an upper portion 810A, lower portion 810B, grip 810C, trigger housing 810D, accessory hose connector 810E, solution valve body 810F, solution valve stem 810G, and return spring 810H. The solution valve body 810F is fluidly connected to the solution conduit 800A passing through accessory hose 800. The telescoping wand 850 and is comprised of an upper portion 850Aa formed from two elongated half-sections 850A' and 850A", a lower elongated hollow section 850B having a plurality of equally spaced integrally molded detents extending the length on the outer surface, a solution conduit 850D including a helical portion, a solution conduit connector 850E for fluidly connecting the solution conduit 850D to valve body 810F, a collar 850F for receiving the lower portion 850B into upper portion 850A, a latch body 850 integrally molded on the lower end of upper portion 850A, and a latch 851 that is received into latch body 850G. Accessory nozzle 815 includes a main body portion 815A, a hood 815B, a swivel connector 815C, an agitator block 815D, a squeegee 815E, a solution conduit connector 815F, a solution conduit 815G, and a spray nozzle 815B. A latch 8151 removably attaches accessory suction nozzle 815 to the lower end of the lower portion 850B of telescoping wand 850. An bottom perspective view of accessory suction nozzle 815 is shown in FIG. 15A. The agitator block 815 includes bristles 815J and there is a suction inlet 815H located in between the opposing sides of squeegee 815E. Grout tool 825 is comprised of two clamshell sections 825A and 825B, an agitator block assembly 825C, a squeegee 825D, a solution conduit 825E, a solution conduit connector 825F, and a spray nozzle 825G. An additional view of the grout tool can is shown in FIG. 15B where a collar 8251 and a latch 825K is seen for removably connecting to the lower end of the lower portion 850B of telescoping wand 850. A suction inlet 825 is provided on the interior of squeegee 825D for removal of dirt and used cleaning solution. The spray nozzle 825G is located forward of the agitator block assembly 825C. In this manner, when trigger 811 is depressed, cleaning solution is deposited on the grout before the bristles from agitator block 825C work the cleaning solution into the grout. The used cleaning solution and dirt are then squeegeed into the suction inlet 825H for removal.

Figure 18:
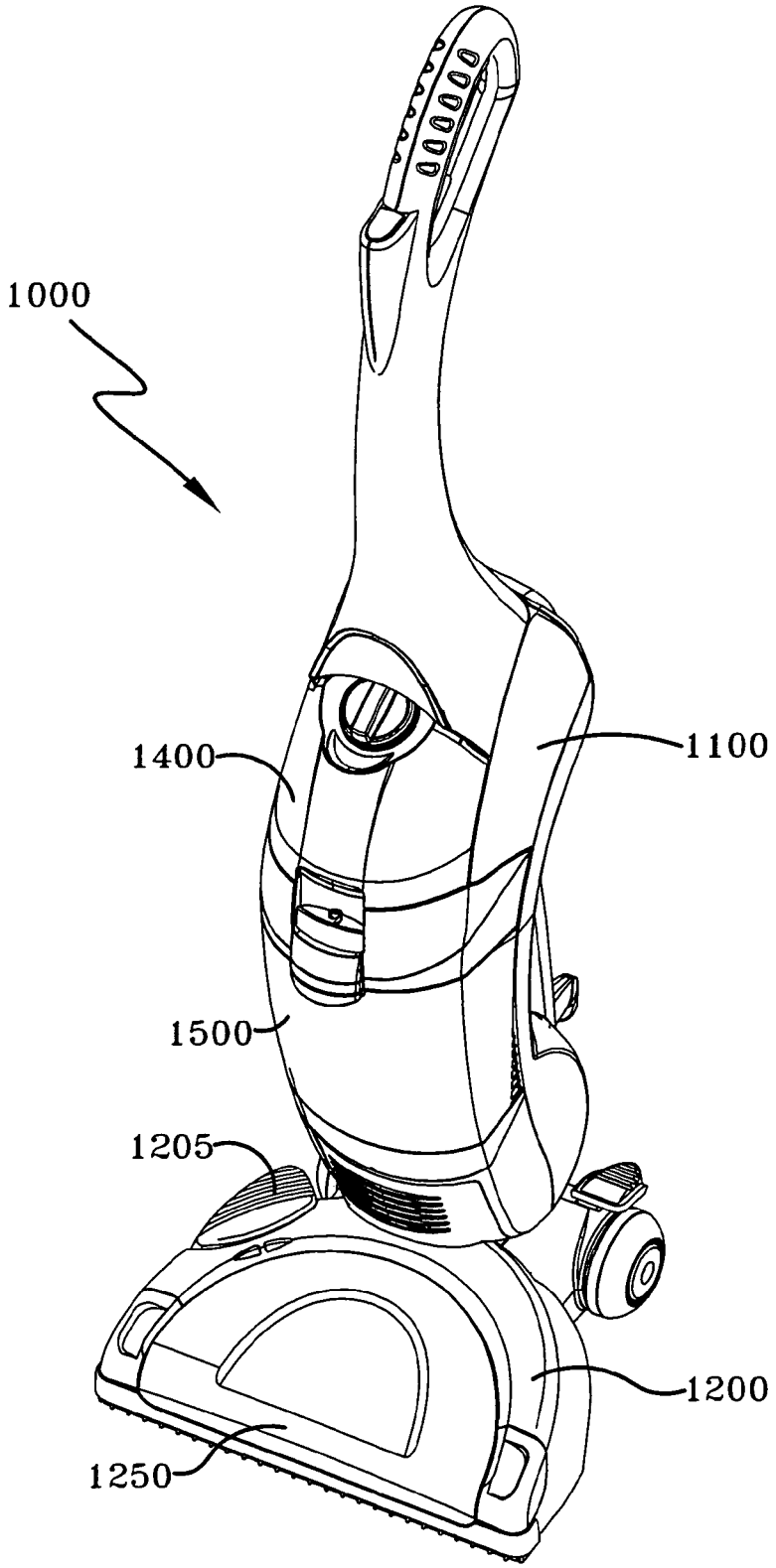
FIG. 18 shows a perspective view of a bare floor care cleaner, according to the second alternate embodiment of the present invention.

Referring now to FIG. 18, shown is a second alternate embodiment of an upright floor care cleaner 1000 for cleaning bare for cleaning bare surfaces such as floors and tile. The upright floor care cleaner 1000 comprises an upright housing portion 1100 pivotally connected to a base assembly 1200 that is propelled over a bare floor surface for cleaning. A pair of trunnions (not shown) are formed on the lower end of upright portion 1100 are journaled into a complementary pair of bores (not shown) in a frame (not shown) partially forming base assembly 1200 to form the pivotal connection. The trunnions are secured into the bores by a trunnion cover (not shown).

The upright housing portion 1100 is nearly identical to that disclosed in the preferred embodiment and includes a combined air/liquid separator and recovery tank assembly 1500 and a cleaning solution storage tank assembly 1400. The upper housing portion 1100 also includes a motor fan assembly (not shown) for generating suction for liquid and soil recovery, and a trigger (not shown) for selectively distributing cleaning solution to the floor surface.

Figure 19:
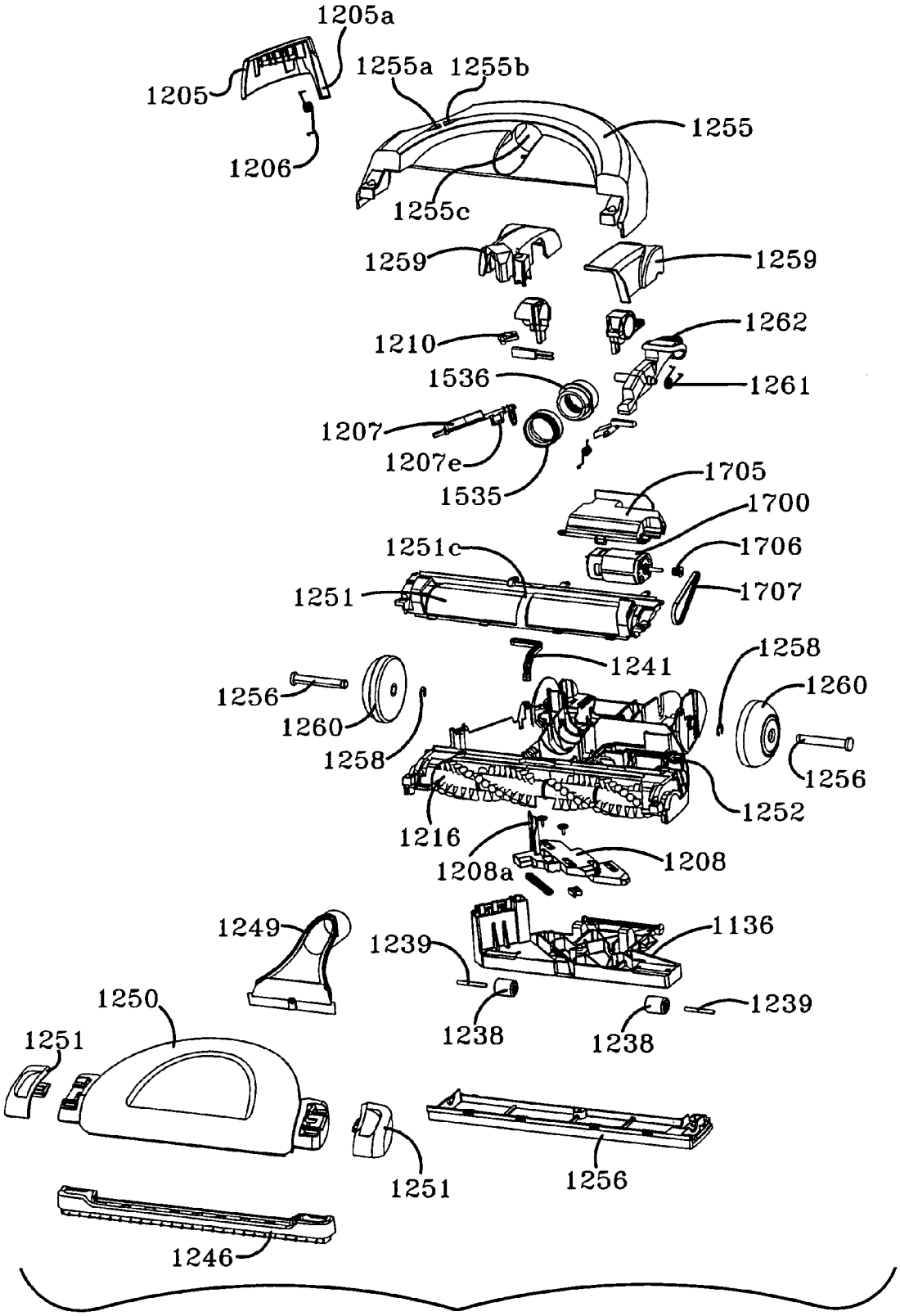
FIG. 19 shows an exploded perspective view of the foot of the bare floor care cleaner of FIG. 18, according to the second alternate embodiment of the present invention.
Figure 20:
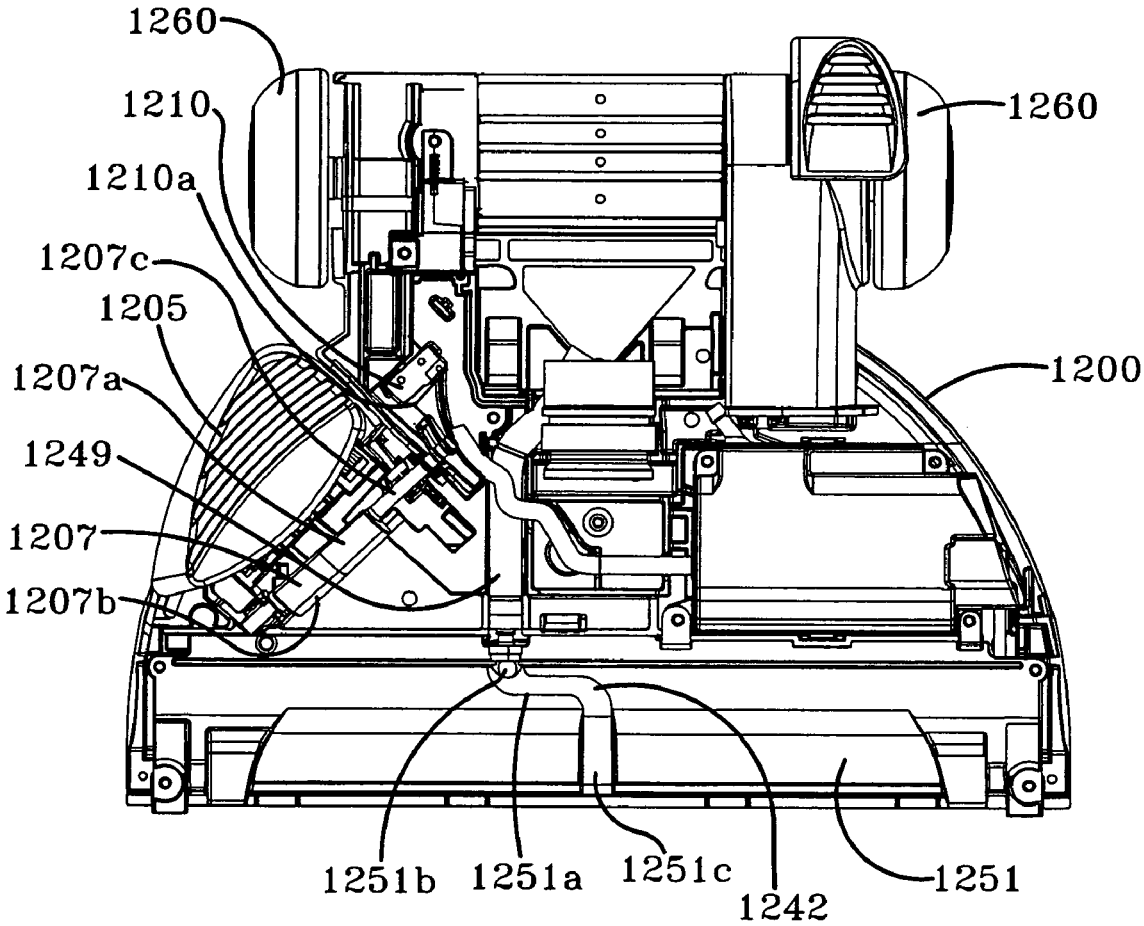
FIG. 20 shows a top view of the foot of the bare floor care cleaner of FIG. 18 with the hood removed, according to the second alternate embodiment of the present invention.
Figure 20A:
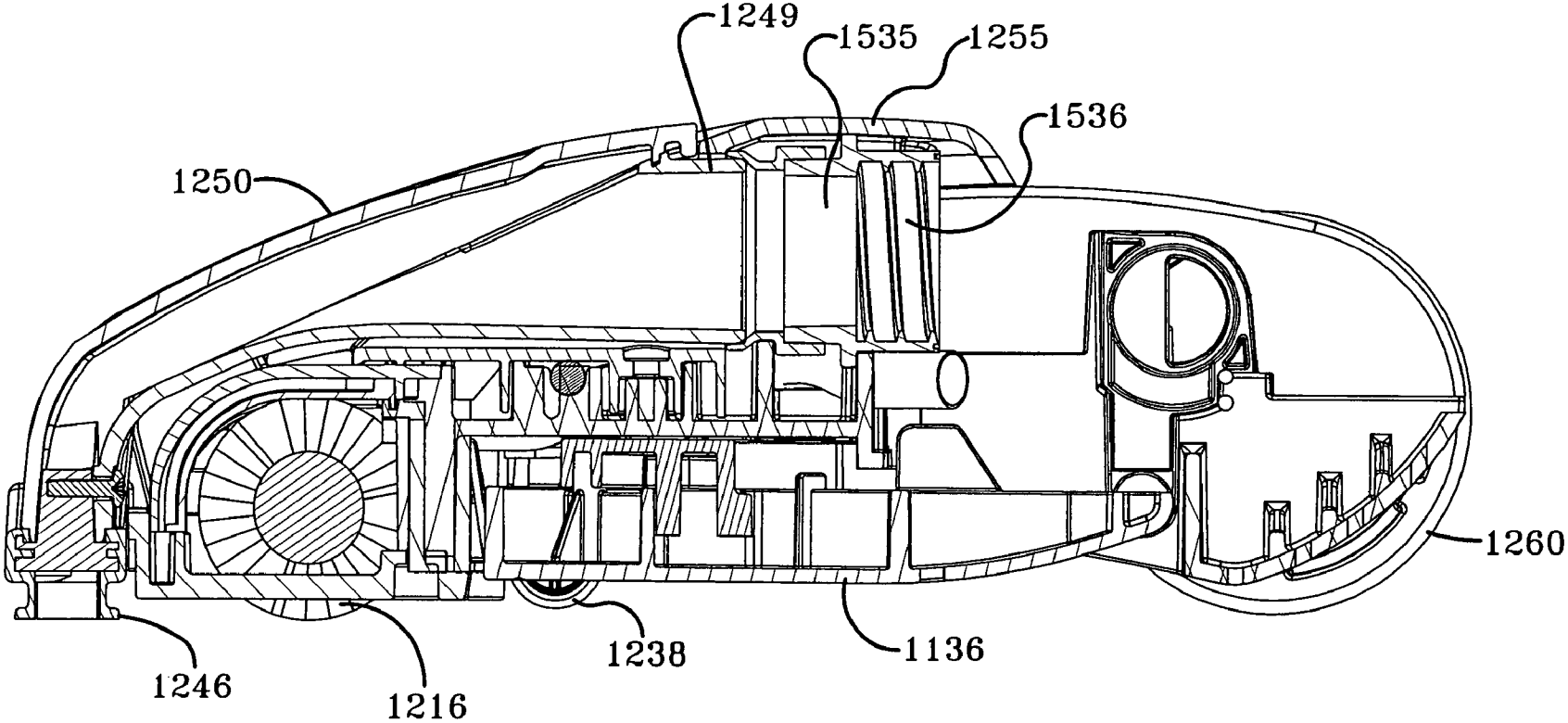
FIG. 20A shows a cross-sectional view of the foot of the bare floor care cleaner of FIG. 18, according to the second alternate embodiment of the present invention.
Figure 20B:
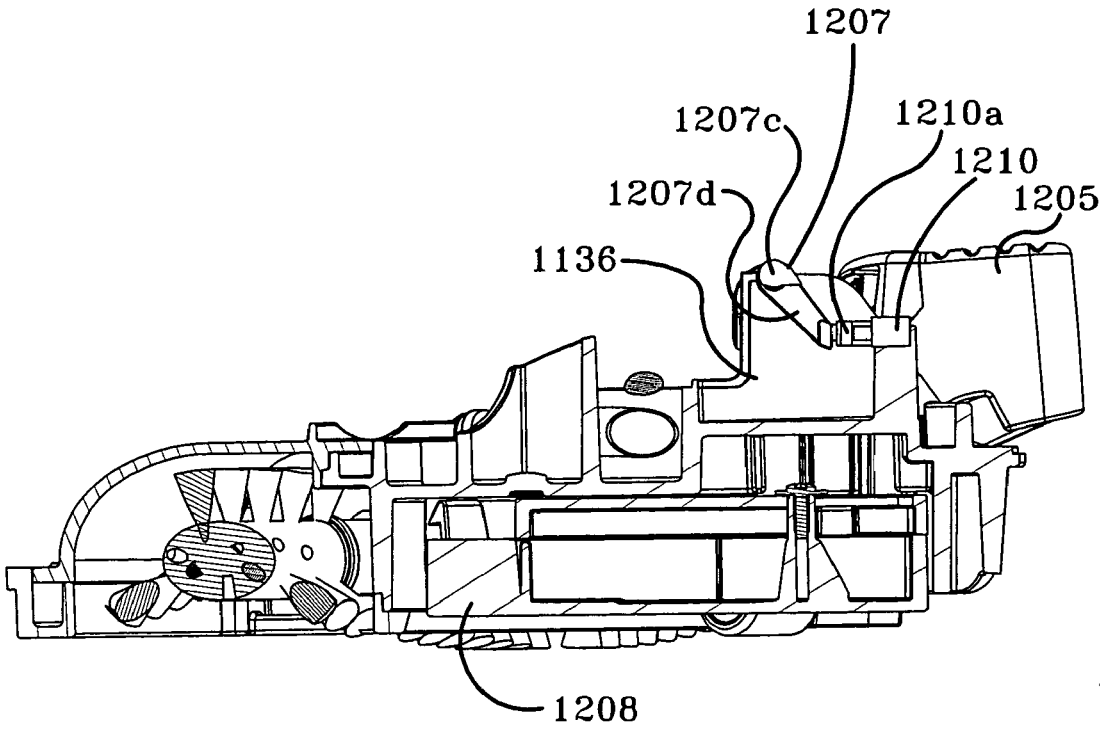
FIG. 20B shows a cross-sectional view of the foot of the bare floor care cleaner of FIG. 18 showing the detail of the foot pedal interconnected to the mode indicator and independent agitator drive motor electrical switch, according to the second alternate embodiment of the present invention.
Figure 20C:
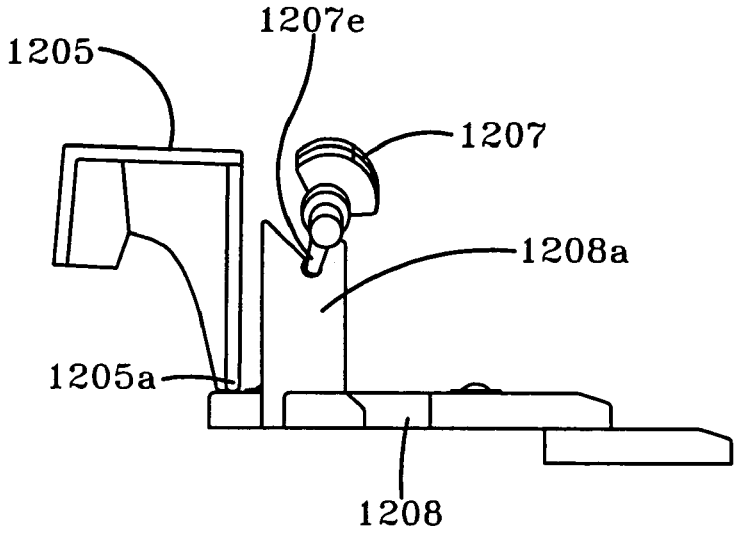
FIG. 20C shows a close up perspective view of the foot pedal interconnected to the mode indicator and independent agitator drive motor electrical switch, according to the second alternate embodiment of the present invention.

A suction nozzle 1250 in base assembly 1200 is used for the recovery of dirt and used cleaning solution delivered to the floor surface from the cleaning solution tank assembly 1400. Suction nozzle 1250 could be made from a transparent or opaque material. The cleaning solution is agitated on the floor surface to loosen soil and dirt by a horizontal rotary agitator 1216 (FIGS. 19, 20A, 20D) located in base assembly 1200 behind suction nozzle 1250. The cleaning appliance 1000 is supported on the floor surface by a pair of wheels 1260 (FIGS. 19 and 20) at the rear of the base assembly 1200 and a pair of rollers 1238 (FIGS. 19 and 20A) mounted on a wheel carriage 1136 (FIG. 19). The horizontal axis rotary agitator 1216 (FIG. 19) is powered by an independent agitator drive motor 1700 (FIG. 19). Both the motor-fan assembly (not shown) and the independent agitator drive motor 1700 (FIG. 19) are powered by electrical power source such as a conventional alternating current source or other power source such as rechargeable batteries.

Referring now to FIG. 19, the base assembly includes a main body 1252 which the pair of rear wheels 1260 are mounted to with axles 1256 and c-clips 1258. A pivoting wheel carriage 1136 is mounted on the underside of main body 1252. The pair of rollers 1238 are mounted on wheel carriage 1136 with axles 1239. Wheel carriage 1136 supports the forward portion of main body 1252 on the floor surface and serves to raise and lower the suction nozzle 1250 in relation to the floor surface when the height adjustment pedal 1205 is depressed (as described more fully hereinbelow). The horizontal rotary agitator 1216 is powered by an agitator drive motor 1700 through a pulley 1706 and belt 1707. The agitator drive motor 1700 fits into a specially formed recess in main body 1252 and an agitator drive motor cover 1705 fits over the agitator drive motor 1700. A transparent agitator chamber tunnel cover 1251 fits over the horizontal axis rotary agitator 1216 partially forming the agitator chamber. The suction nozzle 1250, made from a transparent or opaque material, is installed over the agitator chamber tunnel cover 1251 so that the suction inlet (not shown) sits in front of the agitator chamber and the horizontal axis rotary agitator 1216. The transparent agitator chamber tunnel cover 1251 and transparent suction nozzle 1250 allow the horizontal axis rotary agitator 1216 to be seen in the agitator chamber and the recovered solution and dirt to be seen as it is drawn into the recovery tank assembly 1500 (FIG. 18). A suction duct 1249 is connected to the suction nozzle 1250 and is connected to the suction duct 1536 by a suction duct connector 1535. The suction duct 1536 delivers suction from the motor fan assembly (not shown) to the suction duct 1250 and delivers the recovered solution and dirt to the recovery tank assembly 1500 (FIG. 18). The suction nozzle 1250 is mounted to the main body 1252 with a pair of latches 1251 on the outer edges. A squeegee 1246 is mounted around the suction inlet (not shown) of the suction nozzle 1250 to wipe the floor and guide solution into the suction inlet (not shown).

Referring now to FIGS. 19, 20, and 20A-20E, a bottom plate 1256 fits over the bottom of the agitator chamber and a plurality of solution distribution holes 1256*c* are formed in the front portion of bottom plate 1256. The front portion of bottom plate 1256 has a channel 1256*b* formed therein and for receiving cleaning solution and distributing cleaning solution to the plurality of fluid distribution holes 1256*c*. A solution duct 1242 is formed from a channel 1251*c* formed in the upper surface of the agitator chamber tunnel cover 1251 and a solution channel cover 1241 for delivering solution to the solution channel 1256*a* formed in the front portion of bottom plate 1256. Alternately, the channel 1251*c* could be formed in the lower surface of agitator chamber tunnel cover 1251 and fitted with a channel cover 1241. Solution channel 1242 is fluidly connected by tubing 1249 to the solution distribution assembly 1400 (FIG. 18) in a similar fashion as in the preferred embodiment.

Referring specifically to FIG. 19, a hood 1255 fits over the assembled base assembly 1200 and has a channel 1255*c* formed therein for receiving the suction inlet of suction duct 1249. Suction duct 1249 is fluidly connected to suction nozzle 1250 to fluidly connect suction nozzle 1250 to suction duct connector 1535 and suction duct 1536 which pass through channel 1255*c* in hood 1255.

A foot pedal 1260 and spring 1261 release the upright housing 1100 from the upright and locked position to the in use position. A pair of trunnion covers 1259 fit over the wheels 1260 and secure the trunnions (not shown) of the upright housing 1100 to the bores located on main body 1252. A sliding block 1208 is located between wheel carriage 1136 and main body 1252 which urges against wheel carriage 1136 to raise the front portion of main body 1252 and suction nozzle 1250 away from the floor surface when pedal 1205 is depressed. An arm 1205*a* extending from pedal 1205 urges sliding block 1208 away from pedal 1205. A spring 1206 returns pedal 1205 and to the normal position after being depressed. Sliding block 1208 also lowers main body 1252 and suction nozzle 1250 towards the floor surface when pedal 1205 is depressed again. The movement of sliding block 1208 causes an arm 1208*am* extending from sliding block 1208 to engage a crank arm 1207*e* extending from mode indicator 1207 to rotate the mode indicator 1207. Another arm 1207*d* extending from the mode indicator 1207 toggles an electrical switch 1210 controlling the agitator drive motor 1700. Electrical switch 1210 has a resilient lever which is urged by crank arm 1207*d*. Thus, the agitator drive motor 1700 is energized and de-energized when the pedal 1205 is depressed and then depressed again in a push-push fashion. Specifically, upon pushing pedal 1205 once, agitator drive motor 1700 is energized to rotate the horizontal rotary agitator 1216 when suction nozzle 1250 is in the position closest to the floor surface. When pedal 1205 is depressed again, suction nozzle 1250 is raised to its highest position above the floor surface and the mode indicator 1207 is again rotated to further cause the arm 1207*d* to toggle the electrical switch to the off position and de-energize the agitator drive motor. The operation of the foot pedal allows the cleaner to be used in a "wet" mode where the horizontal rotary agitator 1216 works cleaning solution into the floor surface for further recovery by the suction nozzle or in a "dry" mode where no solution is used and the suction nozzle only picks up dry particles. In the "wet" mode, the suction nozzle and the horizontal rotary agitator are lowered to the position closest to the floor surface. In the "dry" mode, the horizontal rotary agitator 1216 and the suction nozzle 125Q are raised to the highest position above the floor surface. The interconnectedness of the electrical switch 1210, mode indicator 1207, sliding block 1208 and foot pedal 1205 is shown in detail in FIGS. 20B and 20C. The body 1207*c* has a pair of surfaces that are color coded so that when the body 1207*c* of mode indicator 1207 is rotated, one of the colored surfaces is rotated underneath an aperture 1255*a* formed in hood 1255 to indicate the currently selected floor care mode. The other color coded surface is alternately rotated underneath an aperture 1255*b* formed in hood 1255*b* to indicate when the floor care cleaner 1000 is shifted into the other floor care mode.

Figure 20D:
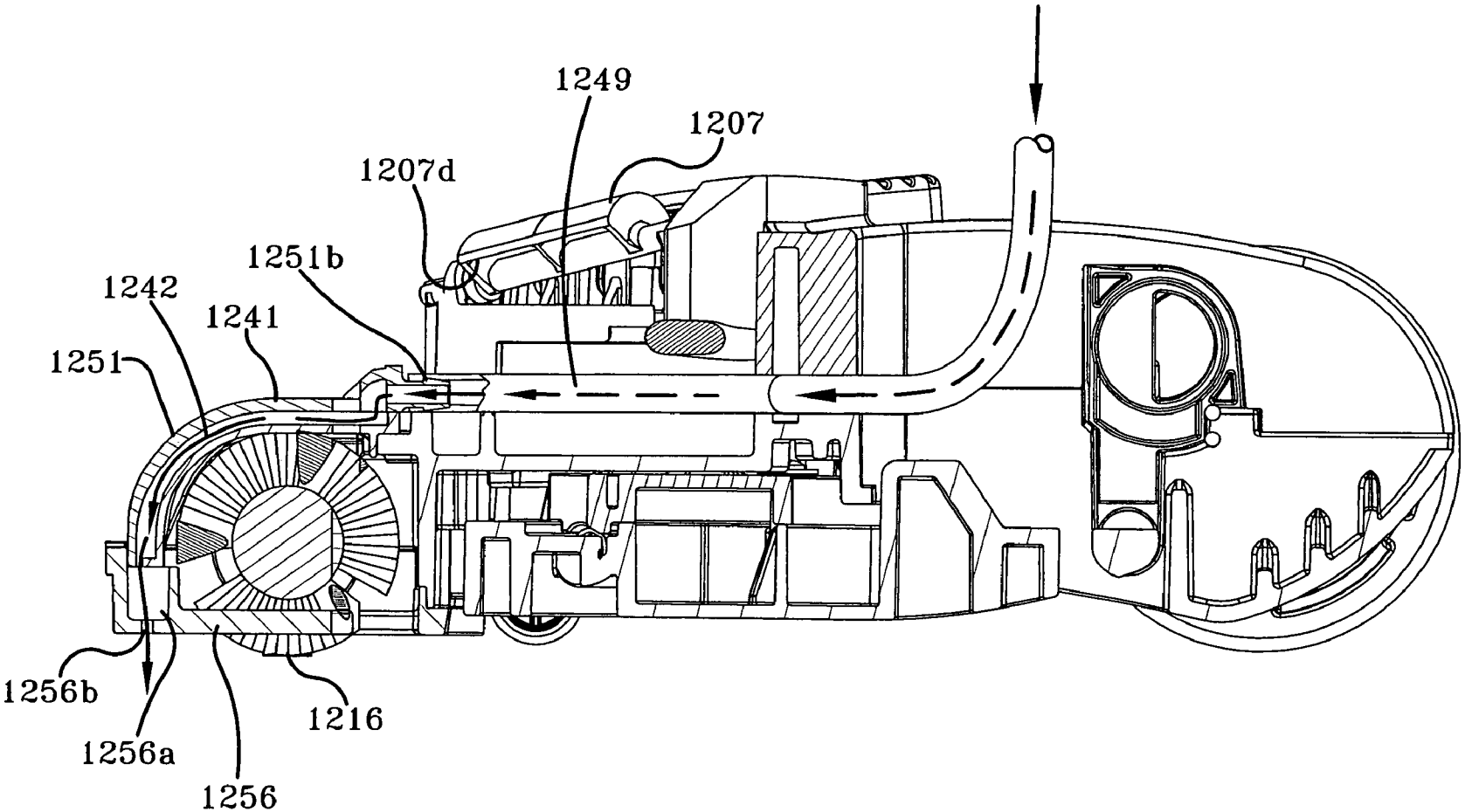
FIG. 20D shows atop view of the foot of the bare floor care cleaner of FIG. 18 with the hood removed and a cutaway portion of the agitator chamber tunnel cover to show the solution delivery holes formed in the bottom plate, according to the second alternate embodiment of the present invention.
Figure 20E:
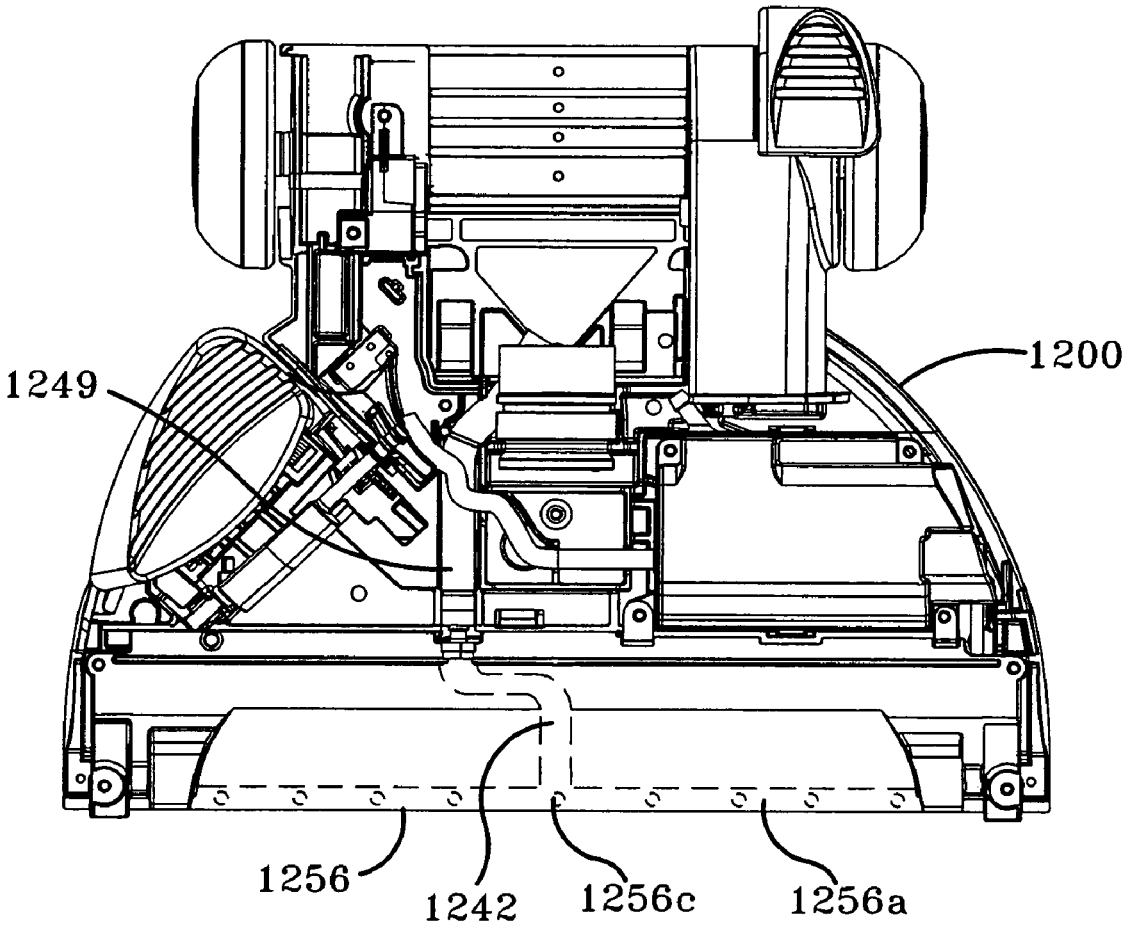
FIG. 20E shows a cross-sectional view of the foot of the bare floor care cleaner of FIG. 18 with the suction nozzle removed and showing the solution delivery tube connected to the solution duct formed in the agitator chamber tunnel cover delivering solution to the plurality of solution distribution holes formed in the bottom plate, according to the second alternate embodiment of the present invention.

FIGS. 20D and 20E show in detail the flow path of solution via solution delivery tube 1249 connected to solution duct 1242 formed from a channel 1251*c* in agitator chamber tunnel cover 1251 and a solution duct cover 1241 fitted over channel 1251*c* and welded thereon. A nipple 1251*b* at one end of solution duct 1242 is fluidly connected to solution tube 1249. Solution is delivered from solution duct 1242 to a channel 1256*a* formed in the front portion of bottom plate 1256. The solution is delivered to a plurality of solution distribution holes 1256 formed in the front portion of bottom plate 1256 and dribbled onto the floor surface for the removal of dirt thereon. In this fashion, solution is delivered to the floor surface over the horizontal rotary agitator 1216 to an area in front of the horizontal rotary agitator 1216.

The present invention has been described byway of example using the illustrated embodiment. Upon reviewing the detailed description and the appended drawings, various modifications and variations of the preferred embodiment will become apparent to one of ordinary skill in the art. All such obvious modifications and variations are intended to be included in the scope of the present invention and of the claims appended hereto. In view of the above, it is intended that the present invention not be limited by the preceding disclosure of a preferred embodiment, but rather be limited only by the appended claims.

The invention claimed is:

1. A floor care appliance, comprising:

a suction nozzle for performing a cleaning operation on a floor surface;

a foot pedal for raising and lowering the suction nozzle in relation to the floor surface;

a rotary agitator;

a drive motor for powering the rotary agitator; and a switch connected in circuit with the drive motor, the switch having a first position at which the motor is energized and having a second position at which the motor is de-energized, as the suction nozzle is moved in relation to the floor surface; and an actuator in operative contact with said foot pedal and said switch.

2. The floor care appliance of claim 1, wherein said actuator includes a first arm which urges said foot pedal when said foot pedal is depressed, thereby rotating said actuator.

3. The floor care appliance of claim 2, wherein said actuator includes a second arm which urges against said switch when said actuator is rotated to toggle said switch between said first and second positions.

4. The floor care appliance of claim 1 wherein said actuator includes at least two indicia for indicating the status of said drive motor and height of said suction nozzle.

5. The floor care appliance of claim 4 further including a hood having at least two apertures for viewing said at least two indicia for determining the status of said drive motor and said suction nozzle.

6. A floor care appliance, comprising:

a suction nozzle attached to a base;

a hood fitted over the base;

a pair of apertures formed in the hood;

a foot pedal for raising and lowering the suction nozzle;

a rotary agitator;

a drive motor for powering the rotary agitator; and a switch connected in circuit with the drive motor, the switch having a first position at which the motor is energized and having a second position at which the motor is de-energized, as the suction nozzle is moved between a first position and a second position;

a mode indicator in operative contact with the foot pedal and the switch for toggling the switch from the first position to the second position as the suction nozzle is raised and lowered;

wherein said mode indicator further includes a first arm which urges said foot pedal when said foot pedal is depressed, thereby rotating said mode indicator; and wherein said mode indicator includes a second arm which urges against said switch when said mode indicator is rotated to toggle said switch between said first and second positions;

two visual indicia located on the mode indicator with one visual indicia associated with the first position of the switch and the first position of the suction nozzle and the other visual indicia being associated with the second position of the switch and the second position of the suction nozzle wherein the visual indicia are moved into a position where the indicia can be seen through an associated aperture in said hood to indicate the status of said drive motor and said suction nozzle.

* * * * *